US006335154B1

(12) United States Patent
Asami et al.

(10) Patent No.: US 6,335,154 B1
(45) Date of Patent: Jan. 1, 2002

(54) SILVER HALIDE PHOTOGRAPHIC EMULSION AND LIGHT-SENSITIVE MATERIAL CONTAINING THE SAME, AND IMAGE-FORMING METHOD USING THE LIGHT-SENSITIVE MATERIAL

(75) Inventors: Masahiro Asami; Makoto Kikuchi; Tadanobu Sato, all of Minami-ashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/533,326

(22) Filed: Mar. 22, 2000

(30) Foreign Application Priority Data

Mar. 24, 1999 (JP) ..... 11-080618
Mar. 24, 1999 (JP) ..... 11-080620

(51) Int. Cl.[7] ..... G03C 1/035; G03C 1/09; G03C 1/42

(52) U.S. Cl. ..... 430/567; 430/566; 430/605

(58) Field of Search ..... 430/567, 566, 430/605

(56) References Cited

U.S. PATENT DOCUMENTS

| | | | | | |
|---|---|---|---|---|---|
| 5,503,971 | A | * | 4/1996 | Daubendiek et al. | 430/567 |
| 5,518,872 | A | * | 5/1996 | King et al. | 430/567 |
| 5,536,632 | A | | 7/1996 | Wen et al. | 430/567 |
| 5,576,168 | A | | 11/1996 | Daubendiek et al. | 430/567 |
| 5,576,171 | A | * | 11/1996 | Olm et al. | 430/567 |
| 5,604,086 | A | * | 2/1997 | Reed et al. | 430/567 |
| 5,716,772 | A | * | 2/1998 | Taguchi | 430/543 |
| 5,804,358 | A | * | 9/1998 | Komatsu et al. | 430/463 |
| 5,965,332 | A | | 10/1999 | Kikuchi | 430/351 |

FOREIGN PATENT DOCUMENTS

| | | | |
|---|---|---|---|
| JP | 7-128769 | 5/1995 | G03C/1/035 |
| JP | 9-204031 | 8/1997 | G03C/8/40 |
| JP | 9-274295 | 10/1997 | G03C/8/40 |

OTHER PUBLICATIONS

Patent Abstract of Japan 09204031 Aug. 5, 1997.
Patent Abstract of Japan 09274295 Oct. 21, 1997.
Patent Abstract of Japan 07128769 May 19, 1995.

* cited by examiner

*Primary Examiner*—Hoa Van Le
(74) *Attorney, Agent, or Firm*—Sughrue Mion, PLLC

(57) ABSTRACT

There is disclosed a silver halide photographic emulsion comprising silver halide grains, wherein 50% or more of the projected area of the silver halide grains to be contained is occupied by tabular grains having an aspect ratio of 2 or more and a grain thickness of 0.2 μm or less, with the tabular grains each having a phase with the content of silver bromide being 10% or more, and wherein in the phase, the tabular grains each contain a metal complex dopant in an amount necessary to increase the density of a dislocation. This emulsion produces high contrast and better granularity while it has high sensitivity. Further, there is also disclosed a silver halide photographic emulsion, wherein the average equivalent-circle diameter of the total tabular grains among the silver halide grains contained is 2.0 to 4.0 μm, and the tabular grains contain at least one metal complex having, as a ligand, a heterocyclic compound in a number more than half of the coordination number of the metal atom. This emulsion has high sensitivity and excellent photographic characteristics exhibiting little change of gradation upon exposure to high-intensity illumination. In addition, the present invention provides a silver halide color photographic light-sensitive material using the emulsion, and a color image forming process that is simple and rapid and places little load on the environment, using the material.

23 Claims, 1 Drawing Sheet

SILVER HALIDE PHOTOGRAPHIC EMULSION AND LIGHT-SENSITIVE MATERIAL CONTAINING THE SAME, AND IMAGE-FORMING METHOD USING THE LIGHT-SENSITIVE MATERIAL

FIELD OF THE INVENTION

The present invention relates to a silver halide emulsion having such characteristic as high sensitivity and high contrast, which are suitable for use for shooting. The present invention also relates to a silver halide color photographic light-sensitive material using the emulsion. Further, the present invention relates to a simple and rapid method for forming a color image by using the light-sensitive material.

Further, the present invention relates to a silver halide emulsion having high sensitivity and excellent characteristics exhibiting little change of gradation upon exposure to high-intensity illumination. The present invention also relates to a silver halide color photographic light-sensitive material using the emulsion. Further, the present invention relates to a simple and rapid color-image-forming process using the light-sensitive material.

BACKGROUND OF THE INVENTION

Owing to remarkable development of photographic light-sensitive materials utilizing silver halides, high-quality color images are now easily available. For example, ordinarily, according to so-called color photography, color prints are obtained by taking a photograph utilizing a color negative film, processing the film, and optically printing the image information that is recorded in the processed color negative film onto color printing paper. In recent years, this process has made remarkable progress, and large-scale, centralized color laboratories, in which a large quantity of color prints are produced high-efficiently, and the so-called mini labs, which are installed in shops and are designed to use compact and simple printer-processors, have spread widely. Therefore, anyone can enjoy color photography easily.

In addition, recently, a new-concept APS system, which uses a color negative film capable of recording various information as magnetic records by utilizing a support coated with a magnetic material, has been introduced into the market. This system proposes simplicity in handling films and photographic pleasure, such as capability to change the print size by recording information at the time photographs are taken. In addition, this system proposes a tool for compiling or processing images by reading out image information from a processed negative film by means of a simple scanner. Such methods enable high-quality image information of silver salt photographs to be digitized easily, and they are making the use of the image information commonplace beyond the traditional scope of enjoyment as photographs.

The color photography, now in common use, reproduces color by the subtractive color process. Generally, a color negative film comprises a transparent support and light-sensitive layers formed thereon utilizing silver halide emulsions as light-sensitive elements rendered sensitive to blue, green or red regions, respectively, and containing so-called color couplers capable of producing a yellow, magenta or cyan dye having a complementary hue in each light-sensitive layer. A color negative film image-wise exposed during photographing is processed in a color developing solution containing an aromatic primary amine developing agent. At this time, the developing agent develops, i.e., reduces, the exposed silver halide grains, and the oxidized product of the developing agent, which is formed concurrently with the foregoing reduction, undergoes a coupling reaction with the color coupler to form dyes. The metal silver (developed silver) generated by the development, and the unreacted silver halides, are removed through a bleaching process and a fixing process, respectively. As a result, a dye image is obtained. Subsequently, color photographic printing paper, which is a color light-sensitive material comprising a reflective support and light-sensitive layers coated thereon having a combination of light-sensitive wavelength regions and hues to be produced in each layer similar to that of the color negative film, is optically exposed to light through the processed color negative film. Then, the resultant paper is subjected to the color developing, bleaching and fixing processes, as in the case of the negative film, to obtain a color print having a color image composed of dye images, so that an original scene is reproduced.

In contrast with these classic image forming processes, recently it has been made possible to convert the image information recorded in a color negative to digital information, using a scanner, and to subject the digital information to various image treatments, so that the image quality of prints to be obtained is upgraded. Actually, a mini lab system having this technology has been made public.

Under this situation, as to the image forming process of color negatives, there is a growing demand for a simpler system.

On the other hand, so-called digital still cameras utilizing a CCD as an imaging element are making rapid progress. Cameras for amateurs which are mounted with a CCD element having millions or more of pixels have been put on the market for the past several years to obtain image qualities close to those of photographs. These digital still cameras save a step of developing the film taken, in contrast to usual color photographic systems, and they can produce directly digitized image information. Therefore, it can be made easy to confirm the image directly on a liquid crystal monitor when taking a photograph and to make use of the resulting digital information variously. The image information can be transferred to a printer to make a print readily, it can be variously processed using a personal computer, and it makes image transfer through an internet easy. Along with recent progresses in high density CCDs and in the abilities of equipment treating massive digital data, high quality images worth being appreciated as a photograph have come to be available. Discussion has been made on the possibilities of these digital still cameras being substituted for general photographing means.

In this situation, it is desired to further investigate the high sensitivity and high latitude possessed by silver halide light-sensitive materials with the view of further developing a silver salt photographic system in opposition to a digital still camera system. Although the performance of CCDs used as imaging elements of a digital still camera have been improved remarkably, there is a limitation on the provision of high sensitivity while increasing pixels in elements having a limited size. Also, it is basically difficult to impart high latitude under the restrictions imposed on an inexpensive and simple camera system. Hence, if silver halide light-sensitive materials with high sensitivity and latitude are attained and mounted on inexpensive and readily handlable products, e.g., films with a lens, a system attractive to customers will be provided.

In the meanwhile, it is an urgent problem to make it possible to carry out the developing step, which is a weak point of the silver halide light-sensitive material, more easily and rapidly. The strength of the digital still camera lies, after all, in the point that liquid development processing is not required. On the contrary, the development processing of the silver halide light-sensitive material needs private treating equipment and careful control and is hence utilized only in limited bases at present. This reason is as follows. The first reason for this is that expertise and skilled operation are necessary due to the requirement of strict control of the composition and the temperature of the solutions in processing baths for the above-mentioned procedure of color development, bleaching and fixation. The second reason is that equipment to be used exclusively for the developing process is often required, due to substances, contained in the processing solutions, such as color-developing agents and bleaching agents comprising an iron chelate compound and others the discharge of which is regulated from the standpoint of environmental protection. The third reason is that the currently available systems do not satisfactorily fulfill the requirement for rapid reproduction of recorded images, because the above-mentioned development processes still take time, although this time has been shortened with recent advances in technology.

Based on the background stated above, a requirement for a technology, which will lessen the load on the environment and contribute to the simplification of the system by establishing a color image formation system without the use of the color developing agents or bleaching agents now in use in current systems, is ever increasing.

In view of these aspects, many improved technologies have been proposed. For example, IS & T's 48th Annual Conference Proceedings, pp.180, disclose a system in which the dye formed in the developing reaction is transferred to a mordant layer and thereafter a light-sensitive material is stripped off, to remove the developed silver and unreacted silver halide without the use of a bleach-fixing bath which has been indispensable to conventional color photographic processing. However, this technology cannot perfectly solve environmental problems because a developing process using a processing bath containing a color developing agent is still necessary.

Fuji Photo Film Co., Ltd. has provided Pictrography system which dispenses with a processing solution containing a color developing agent. In this system, a small amount of water is supplied to a light-sensitive material containing a base precursor, and then the light-sensitive material and an image receiving material are put together face to face and heated, to cause the developing reaction. This system does not use the aforementioned processing bath and, in this regard, is advantageous with respect to environmental protection. However, since this system is used in the application where the formed dye is fixed in the dye fixing layer which is then appreciated as a dye image, there has been a demand for a system usable as a recording material for photographing.

In particular, due to a digital lab system which has rapidly developed recently, there has been an increasing need for a system or recording medium which digitizes photographed image information in a simple and rapid way. It is believed that, for example, in Digital Lab System Frontier, manufactured by Fuji Photo Film Co., Ltd. (input machine "High-Speed Scanner/Image Processing Work Station" Scanner & Image Processor SP-1000 and output machine "Laser Printer/Paper Processor" Laser Processor LP-100P), the performance of the system will be enhanced if the photographic negative as input information is processed more simply and rapidly.

In order to meet such demands, a heat development light-sensitive material system in which the light-sensitive material incorporates a developing agent has been proposed as a photographic negative which can be processed simply and rapidly without placing a heavy load on the environment. For example, techniques in which photographic light-sensitive materials can be developed by the same simple and rapid processing as in the aforementioned Pictrography system are disclosed in the specifications of JP-A-9-204031 ("JP-A" means unexamined published Japanese patent application) and JP-A-9-274295.

Since this system is used for photographing, the emulsion to be used needs to have a further upgraded sensitivity. In addition, high-level requirements have been made for the betterment of sensitivity/granularity ratios, sharpness, gradation, and the like.

A technology for upgrading the sensitivity of a silver halide emulsion is the use of tabular grains. Advantages of this technology are known to be upgraded sensitivity including the enhancement of spectral sensitizing efficiency by spectral sensitizing dyes, betterment of sensitivity/granularity ratios, enhancement of sharpness owing to the optical properties specific to the tabular grains, enhancement of covering power, and the like.

The technologies using tabular grain emulsions in a heat development light-sensitive material system in which the light-sensitive material incorporates a developing agent are disclosed in, for example, JP-A-9-274295 and JP-A-10-62932. However, in these patent applications, no mention is made of the technology of the present invention using a silver halide tabular grain emulsion containing a metal complex having, as a ligand, an organic compound such as a heterocyclic compound in a number more than half of the coordination number of the metal atom.

Meanwhile, in view of the above-described points, the use of an emulsion containing tabular grains in a heat development system silver halide color photographic light-sensitive material incorporating a color-developing agent, which material is a material for shooting and enables simple and rapid image recording without placing a heavy load on the environment, has been found to present a practically intolerable problem that, when exposed to high-intensity illumination, a change of gradation (softening of tone) tends to occur at the time of heat development in comparison with ordinary development using a conventional developing solution, and the problem is remarkably exasperated particularly when tabular grains each having a large average equivalent-circle diameter (the diameter of a circle equivalent to a projected area of individual grain) are used.

High sensitization of the silver halide light-sensitive material can be generally attained by increasing the grain size of silver halide grains used as photocells (photosensors). However, this poses the problem of impaired granularity (graininess) as the grain size increases. As measures to increase the sensitivity without impairing the granularity, the use of an emulsion comprising tabular grains with a grain thickness smaller for the projected diameter of a grain (the diameter of a circle equivalent to the projected area of a grain) is disclosed in, for instance, the specifications of U.S. Pat. Nos. 4,434,226 and 4,439,520. In the descriptions of photographic emulsion grains, the value calculated by dividing the projected diameter of a grain by the thickness of the grain, which value is called as an aspect ratio, is used. These specifications describe the fact that grains with a high aspect ratio exhibit better sensitivity/graininess ratio than those having low aspect ratios. In the case of comparing grains having the same rain projected diameter, it is considered that by increasing the aspect ratio, the number of grains can be increased, whereby the granularity can be improved even if the amount of silver to be applied is the same.

However, it has been clarified that if the aspect ratio of grains is increased and the thickness of the grain is designed to be thin, it is hard to obtain high sensitivity and a deterioration of the contrast is further caused by a reduction in the maximum color density.

Such a phenomenon, although the way of its appearance differs depending upon the composition and size of emulsion grains, generally starts to appear as a problem when the thickness of a grain is 0.2 μor less and becomes significant when the thickness of a grain is 0.15 μm or less. Various techniques have been reported as attempts to solve this problem. Examples of these techniques may include a technique in which an epitaxial microcrystalline portion having a different halogen composition is formed on the external surface of a grain, especially at the top thereof or such a portion is doped with a 6-cyano iron group complex, as disclosed in the specifications of U.S. Pat. Nos. 5,536,632 and 5,576,168. However, it has been confirmed that the use of these techniques is insufficient although an improvement in the sensitivity is observed and a reduction in the contrast is not improved occasionally.

It has been also confirmed that in a thermal developing treatment as disclosed in the above mentioned JP-A-9-204031 and JP-A-9-274295, in which a photographic light-sensitive material is made to contain a developing agent, overlapped on a processing material containing a basic precursor in the presence of a small amount of water and heated at 60° C. or higher, the aforementioned problem offered when the tabular grains having high aspect ratio is used, particularly a reduction in the contrast, becomes more significant.

SUMMARY OF THE INVENTION

As is apparent from the fact mentioned above, an object of the present invention is to provide a silver halide photographic emulsion which produces high contrast and better granularity while it has high sensitivity. Another object of the present invention is to provide a photographic light-sensitive material of high image quality, using the silver halide photographic emulsion. Still another object of the present invention is to provide a simple method for forming a color image by using the light-sensitive material.

Further, another object of the present invention is to provide a silver halide photographic emulsion having high sensitivity and excellent photographic characteristics exhibiting little change of gradation upon exposure to high-intensity illumination. Still another object of the present invention is to provide a silver halide color photographic light-sensitive material using the emulsion. A further object of the present invention is to provide a color image forming process which uses the light-sensitive material and which is simple and rapid and places little load on the environment.

Other and further objects, features, and advantages of the invention will appear more fully from the following description, taken in connection with the accompanying drawing.

DETAILED DESCRIPTION OF THE INVENTION

Figure 1:
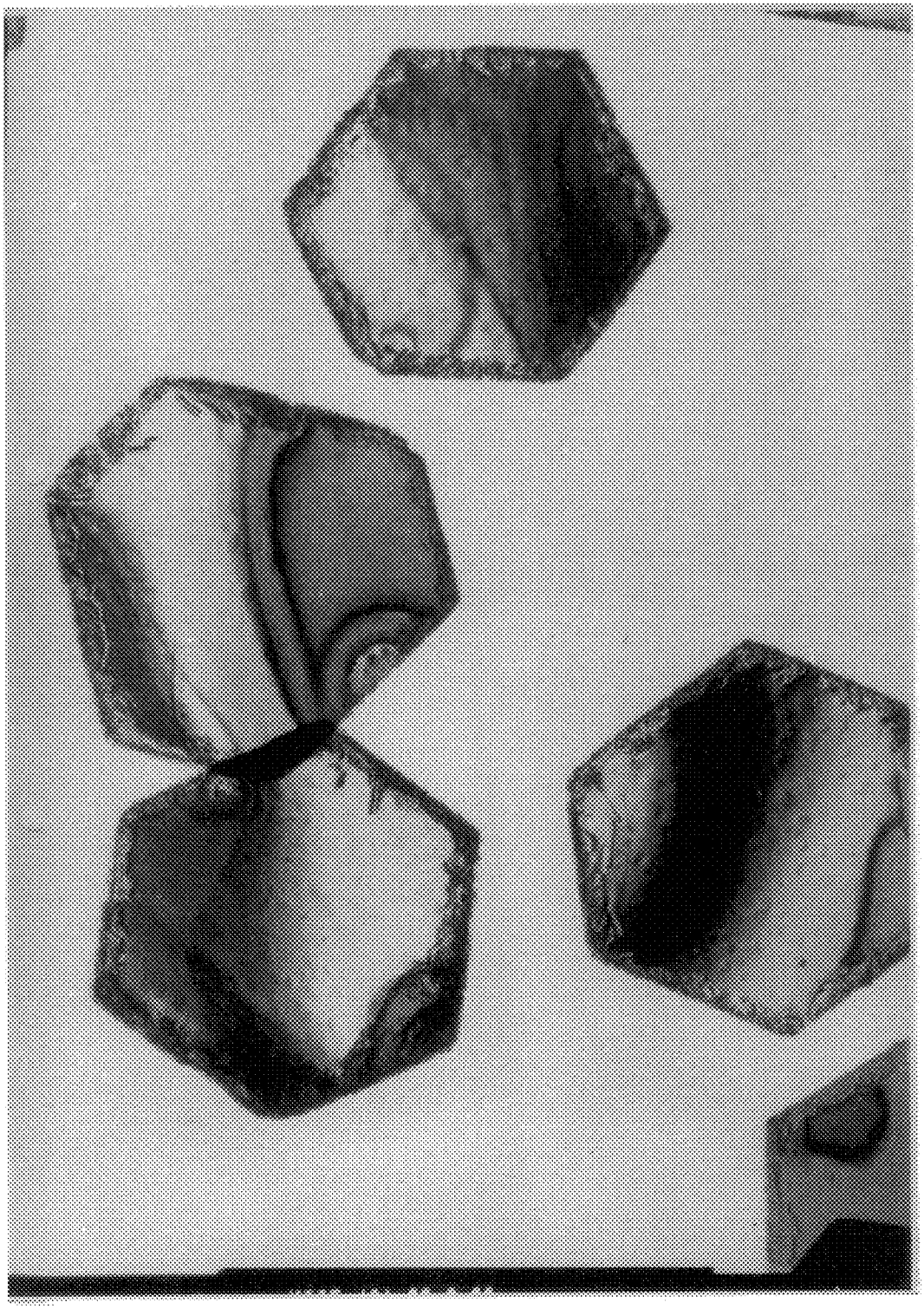
FIG. 1 is the photograph taken by an electron microscope and indicating the shapes of the tabular grains in the photographic emulsion of the present invention.

As a result of diligent studies, the present inventors have found that the use of a silver halide tabular grain emulsion, made up of grains having large average equivalent-circle diameter and containing a metal complex having, as a ligand, an organic compound such as a heterocyclic compound in a number more than half of the coordination number of the metal atom, in a heat development system color photographic light-sensitive material for shooting incorporating a developing agent, exhibits an unexpected effect on upgrading the sensitivity and prevention of softening of tone upon exposure to high-intensity illumination.

The aforementioned objects have been efficiently attained by the following means.

(1) A silver halide photographic emulsion comprising silver halide grains, wherein 50% or more of the projected area of the silver halide grains contained is occupied by tabular grains having an aspect ratio of 2 or more and a grain thickness of 0.2 μm or less that have a phase containing 10% or more of silver bromide, and wherein in the phase, the tabular grains each contain a metal complex dopant in an amount necessary to increase the density of dislocations.

(2) The silver halide photographic emulsion according to (1), wherein 50% or more of the projected area is occupied by tabular grains having a grain thickness of 0.15 μm or less.

(3) The silver halide photographic emulsion according to (1) or (2), wherein the content of silver bromide is 10% or more and the phase containing the metal complex dopant further contains 1 mol % or more of silver iodide.

(4) The silver halide photographic emulsion according to (1), (2) or (3), wherein the metal complex dopant contained has, as a ligand, a heterocyclic compound in a number (the number of coordinated atoms when the heterocyclic compound is a chelate compound) exceeding one-half of the coordination number of the metal atom.

(5) The silver halide photographic emulsion according to (1), (2), (3), or (4), wherein the metal complex dopant to be contained is a complex containing magnesium, calcium, strontium, barium, titanium, chromium, manganese, iron, cobalt, nickel, ruthenium, rhodium, palladium, osmium, iridium, platinum, gold, copper, zinc, cadmium or mercury, as a central metal.

(6) A silver halide photographic light-sensitive material containing the silver halide emulsion according to (1), (2), (3), (4) or (5) on a support.

(7) The silver halide color photographic light-sensitive material according to claim 6, containing a developing agent.

(8) A silver halide color photographic light-sensitive material containing a silver halide emulsion and a developing agent on a support, wherein at least one kind of the silver halide emulsion is a silver halide emulsion comprising silver halide grains, in which 50% or more of the projected area of the silver halide grains contained is occupied by tabular grains having an aspect ratio of 2 or more and grain thickness of 0.2 μm or less that have a phase containing 10% or more of silver bromide, and wherein the grains contain a metal complex dopant having, as a ligand, an organic compound that does not have any electronic charge and that does not form any coordination bond with a metal other than the central metal, or with a metal ion thereof, in which the number of the organic compound exceeds one-half of the coordination number of the metal atom (when the ligand is a multidentate ligand, the number of coordinating atoms in the ligand exceeds one-half of the coordination number of the central metal, and the ligand is an organic compound that does not have any charge and that does not form any coordination bond with a metal other than the central metal or with a metal ion thereof).

(9) A silver halide color photographic light-sensitive material containing a silver halide emulsion and a developing agent on a support, wherein at least one kind of the silver halide emulsion is a silver halide emulsion comprising silver halide grains, in which 50% or more of the projected area of the silver halide grains contained is occupied by tabular grains having an aspect ratio of 2 or more and grain thickness of 0.2 μm or less that have a phase containing 10% or more of silver bromide, and wherein a metal complex dopant represented by any one of the following formula A, B or C is contained in the grains:

$[ML_nX_{(c-n)}]z$ formula A $[ML'_mX_{(c-2m)}]z$ formula B $[ML''_2]z$ formula C wherein M represents an arbitrary central metal or central metal ion, L, L' and L" represent a compound having a chain or cyclic hydrocarbon as the mother structure, or a compound in which a part of the carbon or hydrogen atoms of the mother structure is substituted by another atom or atomic group, and at least one compound of each of L, L' and L" is a compound capable of being coordinated to two or more metal ions at the same time, with the proviso that L is a monodentate compound coordinated to a central metal or a central metal ion, L' is a bidentate compound coordinated to a central metal or a central metal ion, and L" is a tridentate compound coordinated to a central metal or a central metal ion, in each formula, in the case L, L' and L" are present in a plurality, they can be the same compound, or different compounds, X represents an arbitrary ligand, C is 4 or 6 with the proviso that when C is 6, n is 4, 5 or 6, and m is 2 or 3, and when C is 4, n is 3 or 4, and m is 2, and z represents an integer (charge number) from −6 to +4.

(10) A silver halide color photographic light-sensitive material containing a silver halide emulsion and a developing agent on a support, wherein at least one kind of the silver halide emulsion is a silver halide emulsion comprising silver halide grains, in which 50% or more of the projected area of the silver halide grains contained is occupied by tabular grains having an aspect ratio of 2 or more and grain thickness of 0.2 μm or less that have a phase containing 10% or more of silver bromide, and wherein the grains contain a metal complex dopant having, as a ligand, an organic compound that has a moiety capable of having a negative charge, in which the number of the organic compound exceeds one-half of the coordination number of the metal atom.

(11) The silver halide color photographic light-sensitive material according to (8), (9), or (10), wherein the metal complex dopant contained is a complex containing magnesium, calcium, strontium, barium, titanium, chromium, manganese, iron, cobalt, nickel, ruthenium, rhodium, palladium, osmium, iridium, platinum, gold, copper, zinc, cadmium or mercury, as a central metal.

(12) The silver halide color photographic light-sensitive material according to any one of the above (7) to (11), wherein a compound represented by the following formula (I), (II), (III) or (IV) is contained, as the developing agent.

formula (I)

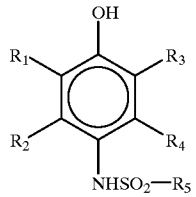

formula (II)

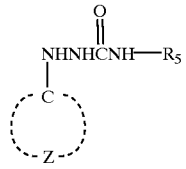

formula (III)

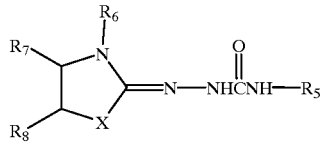

formula (IV)

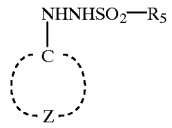

wherein $R_1$, $R_2$, $R_3$, and $R_4$ each represent a hydrogen atom, a halogen atom, an alkyl group, an aryl group, an alkylcarbonamide group, an arylcarbonamide group, an alkylsulfonamide group, an arylsulfonamide group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, or an acyloxy group; $R_5$ represents an alkyl group, an aryl group, or a heterocyclic group; Z represents a group of atoms to form a aromatic ring (including a hetroaromatic ring), if Z is a group of atoms necessary to form a benzene ring, the sum of Hammett's constant (σ) of its substituents is 1 or more; $R_6$ represents an alkyl group; X represents an oxygen atom, a sulfur atom, a selenium atom, or an alkyl- or aryl-substituted tertiary nitrogen atom; $R_7$ and $R_8$ each represent a hydrogen atom or a substituent, and $R_7$ and $R_8$ may bond together to form a double bond or a ring; further, at least one ballasting group having 8 or more carbon atoms is contained in each of formulae (I) to (IV), in order to make the molecule soluble in an oil.

(13) A method for forming a color image, comprising: subjecting the light-sensitive material according to the above (6), (7), (8), (9), (10), (11), or (12) to exposure image-wise, that is attached to a processing material face to face each other in the state that water equivalent to one-tenth to one-fold as much as that required for maximally swelling all the coated films of the light-sensitive material and the processing material is maintained between the light-sensitive material and the processing material, and heating the processing material and the light-sensitive material at a temperature of 60° C. or higher but 100 ° C. or lower for a time period of 5 seconds or more but 60 seconds or less, thereby forming an image in the light-sensitive material, wherein the processing material has a composition layer including a processing layer containing a base and/or a base precursor, applied on a support.

(14) A silver halide photographic emulsion, wherein the average equivalent-circle diameter of the total tabular grains among the silver halide grains contained (an average diameter of a circle equivalent to a projected area of individual grain) is 2.0 to 4.0 $\mu$m, and the tabular grains contain at least one metal complex having, as a ligand, a heterocyclic compound in number more than half of the coordination number of the metal atom (if the heterocyclic compound is a chelate compound, the number of the coordinated atom is regarded as the number of the heterocyclic compound).

(15) The silver halide color photographic emulsion described in (14) wherein the average equivalent-circle diameter of the total tabular grains is 2.5 to 4.0 $\mu$m.

(16) The silver halide color photographic emulsion described in (14) wherein the average equivalent-circle diameter of the total tabular grains is 3.0 to 4.0 $\mu$m.

(17) The silver halide photographic emulsion described in any one of (14) to (16) wherein the metal complex contained is a complex having magnesium, calcium, strontium, barium, titanium, chromium, manganese, iron, cobalt, nickel, ruthenium, rhodium, palladium, osmium, iridium, platinum, gold, copper, zinc, cadmium, or mercury, as the central metal.

(18) The silver halide photographic emulsion described in any one of (14) to (17) wherein the average aspect ratio of the total tabular grains is 8 to 40.

(19) The silver halide photographic emulsion described in any one of (14) to (18) wherein the silver halide emulsion is an emulsion in which tabular grains containing 10 or more dislocation lines per grain found substantially only in grain fringes account for 100 to 50% (in number) of the total grains.

(20) A silver halide photographic light-sensitive material having the silver halide photographic emulsion described in any one of the above (14) to (19) on a support.

(21) The silver halide color photographic light-sensitive material described in (20) containing a compound which forms a dye by a coupling reaction with a developing agent or an oxidized product of the developing agent.

(22) The silver halide color photographic light-sensitive material described in (21) wherein the developing agent is at least one compound among the compounds represented by the following formula (I), (II), (III), or (IV):

formula (I)

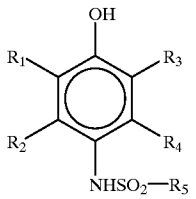

formula (II)

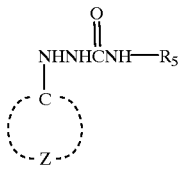

-continued formula (III)

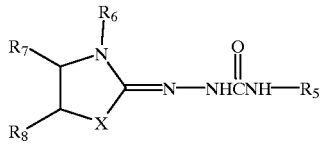

formula (IV)

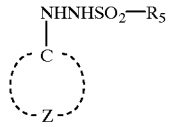

wherein $R_1$, $R_2$, $R_3$, and $R_4$ each represent a hydrogen atom, a halogen atom, an alkyl group, an aryl group, an alkylcarbonamide group, an arylcarbonamide group, an alkylsulfonamide group, an arylsulfonamide group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, or an acyloxy group; $R_5$ represents an alkyl group, an aryl group, or a heterocyclic group; Z represents a group of atoms to form an aromatic ring (including a hetroaromatic ring), if Z is a group of atoms necessary to form a benzene ring, the sum of Hammett's constant ($\sigma$) of its substituents is 1 or more; $R_6$ represents an alkyl group; X represents an oxygen atom, a sulfur atom, a selenium atom, or an alkyl- or aryl-substituted tertiary nitrogen atom; $R_7$ and $R_8$ each represent a hydrogen atom or a substituent, and $R_7$ and $R_8$ may bond together to form a double bond or a ring; further, at least one ballasting group having 8 or more carbon atoms is contained in each of formulae (I) to (IV), in order to impart oil-solubility to the molecule.

(23) The silver halide color photographic light-sensitive material described in (21) or (22) capable of forming an image by a process in which the light-sensitive material after being exposed, and a processing material comprising a support having a constituent layer coated thereon including a processing layer comprising a base and/or a base precursor, are put together face to face, so that the light-sensitive layer side of the light-sensitive material and the processing layer side of the processing material tightly adhere to each other, after water in an amount ranging from 1/10 to the equivalent of an amount that is required for maximum swelling of all the coating layers of these light-sensitive material and processing material except for respective backing layers is supplied to the light-sensitive layer side of the light-sensitive material or to the processing layer side of the processing material, and the light-sensitive material and the processing material are heated at a temperature not below 60° C. and not above 100° C. for a period of time not less than 5 seconds and not more than 60 seconds.

(24) A color-image-forming process, comprising: exposing the light-sensitive material described in (21), (22) or (23) to light image-wise, that is attached to a processing material comprising a support having a constitution layer coated thereon including a processing layer comprising a base and/or a base precursor together face to face, so that the light-sensitive layer side of the light-sensitive material and the processing layer side of the processing material tightly adhere to each other, after water in an amount ranging from 1/10 to the equivalent of an amount that is required for maximum swelling of all the coating layers of these light-sensitive material and processing material except for respective backing layers is supplied to the light-sensitive layer side of the light-sensitive material or to the processing layer side of the processing material, and heating the light-sensitive material and the processing material at a temperature not below 60° C. and not above 100° C. for a time period of not less than 5 seconds and not more than 60 seconds, thereby forming an image in the light-sensitive material.

The wording "having, as a ligand, an organic compound having a moiety that can have a negative charge, in the number over the half of the coordination number of a metal atom" means the matter that the ligand has a moiety that can have the negative charge and the moiety may be a coordinate atom or other than any coordinate atom.

In the present invention, change of gradation is hardly caused even by exposure to high-intensity illumination. The term "high-intensity illumination" in "scanning exposure to high-intensity illumination" as used herein preferably means an illumination intensity 100 times that at facial exposure, or more stronger intensity.

In the metal complex, a heterocyclic compound can be coordinated via a heteroatom.

Herein, the silver halide photographic emulsions as stated in the above (1) to (5), the silver halide color photographic light-sensitive materials as stated in the above (6) to (12), and the method of forming a color image as stated in the above (13) are referred to as the first embodiment of the present invention.

Further, the silver halide photographic emulsions as stated in the above (14) to (19), the silver halide color photographic light-sensitive materials as stated in the above (20) to (23), and the method of forming a color image as stated in the above (24) are referred to as the second embodiment of the present invention.

Herein, in the present specification and claims, a group on a compound includes both a group having a substituent thereon and a group having no substituent (i.e. an unsubstituted group), unless otherwise specified.

The silver halide photographic emulsion for use in the first embodiment of the present invention is described, and in the following description thereof, the present invention means the above first embodiment, unless otherwise specified.

In an embodiment of the silver halide emulsion of the present invention, it is necessary that silver halide grains to be contained have a phase containing silver bromide in a content of 10 mol % or more in a grain and the phase contains a metal complex dopant in an amount just sufficient to increase the density of a dislocation. As the silver halide grains of the present invention, silver chloride, silver bromide, silver chlorobromide, silver iodobromide, silver chloroiodide and silver chloroiodobromide may be used corresponding to the object. The most remarkable effect of the present invention is given by a silver iodobromide emulsion. As to the content of silver halide except for silver bromide in the silver halide composition, AgBrI containing AgI in an amount of up to about 20 mol % and high silver chloride containing AgCl in an amount of 50 mol % or more are cited as examples.

In the case of a silver iodobromide emulsion, since its limit amount in the formation of a solid solution is less than 40 mol % at most in a temperature range in which a usual photographic emulsion is prepared, almost all of a composition in the region doped with the complex dopant for use in the present invention comprises silver bromide. The effect of the present invention is more significant in the case of doping a region having a higher silver bromide content. As for the halogen composition in the region, the content of silver bromide is preferably 70 mol % or more and most preferably 80 mol % or more.

The silver halide emulsion used for the light-sensitive material of the present invention comprises tabular grains having a grain thickness of 0.2 μm or less, wherein 50% of the total projected area is occupied by the tabular grains. The grain thickness is more preferably 0.15 μm or less and most preferably 0.10 μm or less.

To describe the shape of grains contained in an emulsion, it is usual to use a so-called aspect ratio calculated by dividing the projected diameter of a grain by the thickness of the grain. The aspect ratio of the emulsion of the present invention is preferably 5 or more, more preferably 8 or more and most preferably 12 or more. In the case of using grains as relatively small as about 0.5 μm in terms of grain size represented by the diameter of a sphere having the same volume as the grain, it is preferable to use grains having a plate degree of 25 or more wherein the plate degree is calculated by further dividing aspect ratio by grain thickness.

In order to heighten the sensitivity of a photographic emulsion comprising tabular grains having a small grain thickness, that is high in aspect ratio, as the photographic emulsion of the present invention, it is known to be effective to form a dislocation at the fringe portion of the tabular grains. The dislocation is introduced as the edge dislocation so-called in crystallography. The density of such a dislocation can easily be confirmed by observing silver halide grains in a cooled condition by using an electron microscope. For instance, a gelatin in a silver halide emulsion is enzymatically decomposed to take out silver halide grains, which is then placed on a mesh for observation in the electron microscope to observe by a transmission method in a condition that it is cooled using liquid nitrogen to prevent the sample from being damaged by electron beams. At this time, it is desirable to use an accelerating voltage as high as 200 KV or more to increase the transmittance of the electron beams. It is effective to incline the sample at an angle in a range up to about 10 degrees to search the position where the diffraction contrast due to dislocation is high.

As an example of a method of introducing a dislocation which is disclosed in known art, a technique is known in which a core with a low iodine content is coated with a first shell having a high iodine content and on the first shell, a second shell with a low iodine content is deposited. At this time, a dislocation line based on crystallization asymmetry is formed on the shell deposited on the high-iodide phase (which shell corresponds to the fringe portion in the outer periphery of a grain in the case of tabular grains), thereby contributing to an increase in sensitivity. For the deposition of a phase with a high iodine content, use can be made preferably a method in which a solution of a water-soluble iodide such as potassium iodide is added singly or together with a solution of a water-soluble silver salt such as silver nitrate at the same time, a method in which fine grains of silver iodide is introduced into the system, and a method in which a compound (e.g., sodium p-iodinated acetoamidobenzene sulfonate) discharging an iodide ion by a reaction with an alkali or nucleophilic agent is added.

However, in such a method like these, it is occasionally necessary to introduce a large amount of silver iodide for introducing a dislocation, which poses various problems.

Firstly, the increase in the amount of silver iodide to be introduced causes chemical sensitization inhibition, thereby reducing the sensitivity conspicuously. Specifically, a tradeoff relation is established between the introduction of a dislocation and the sensitization inhibition, which is an obstacle to high sensitization.

The inventors of the present invention have found that the density of a dislocation is increased to thereby impart high sensitivity without the aforementioned drawbacks, by doping a phase containing 10 mol % or more of silver bromide with a certain type of metal complex dopant.

It is preferable that the so-called phase containing 10 mol % or more of silver bromide in the present invention be positioned on the outer peripheral portion of a grain for the purpose of introducing a dislocation at the fringe portion of a tabular grain, although it doesn't matter where the phase is positioned in the grain. Further, the ratio of the phase is preferably 50% or less and more preferably 40% or less based on the volume of a grain. When the thickness of a grain is 0.15 $\mu$m or less, the ratio is preferably 30% or less and more preferably 20% or less.

Also, preferably the phase (layer) contains 1 mol % or more of silver iodide.

It is preferable that the metal complex dopant for use in the present invention has, as a ligand, a heterocyclic compound in a number exceeding one-half the coordination number of a metal atom. Particularly, metal complexes having, as a ligand, a five- or six-membered nitrogen-containing heterocyclic compound are preferable.

The amount to be used of the metal complex dopant required to increase the density of a dislocation in the present invention is preferably $10^{-9}$ to $10^{-3}$ mols, more preferably $10^{-8}$ to $10^{-4}$ mols and most preferably $10^{-6}$ to $10^{-4}$ mols based on one mol of silver.

The mechanism in which the complex dopant in the present invention increases the density of a dislocation, though its detail is unclear, is estimated to relate to the relaxation of a strain in the vicinity of the dislocation. Specifically, when the low iodine-content phase is allowed to grow in succession to the high iodine-content phase, an edge dislocation is generated caused by a difference in lattice constant. It is considered that energy increases in the vicinity of the dislocation line due to the strain of a lattice. The doped complex of the present invention is incorporated into such a vicinity of the dislocation line to relax the strain of a crystal lattice, whereby it can produce the effect of stabilizing the dislocation.

A technique in which heavy metal impurities are added as dopants to silver halide emulsion grains for the purpose of improving photographic characteristics is known. For instance, the photographic effect of a metal complex doped into photographic silver halide grains is explained based on the interaction with photoelectrons created during exposure in R. S. Eachus, M. T. Olm, Cryst. Latt. Def. and Amorph. Mat., 18, 297–313 (1989). A hexachloroiridium (IV) acid complex picked up in this report is typically used among these metal complex dopants and there are many reports concerning this acid complex.

As is explained in the aforementioned report, these conventional metal complex dopants are considered to interact with photoelectrons created when the emulsion grains are exposed so that it plays a role as a transitional, temporary or permanent electron trap. From this point of view, various metal complexes are reported. However, many discussions are made on photographic effects in relation to a division or state of electrons in d-electron orbit of a central metal and the types of complex to be used are almost halogeno complexes or cyano complexes.

In the present invention, it has been found that a certain type of organic ligand complex produces a photographic effect differing from conventional ones currently in use and, at the same time, increases the density of a dislocation in the peripheral portion of a grain of a tabular emulsion with a high aspect ratio, and thus the invention has been completed.

A technique similar to the present invention is disclosed in the specification of JP-A-7-128769. In the patent specification, there is a description saying that a metal compound in which a distance between a metal atom and an atom, molecule or ligand bonded with the metal atom is smaller than 0.45 times or larger than 0.55 times the lattice constant of a silver halide crystal is added to 95 mol % or more of high silver chloride emulsion grains during the formation of grains, whereby a dislocation can be introduced and high sensitivity is hence obtained. However, it has been confirmed from the studies made by the inventors of the present invention that an expected level of effect is not obtained in the emulsions, such as emulsions used for photographic materials, which need high sensitivity. It has been confirmed that for the purpose of attaining high sensitivity in the case of grains in which silver bromide is introduced as a mixed crystal to a silver chloride emulsion, an emulsion comprising silver iodobromide is used or a phase containing 10 mol % or more of silver bromide is contained, an expected level of a dislocation is not created even if a metal complex fulfilling the aforementioned requirements is doped. This reason is considered to be due in part, to the effect of making the relaxation of a lattice strain easy and hence the generation of a dislocation difficult, by the introduction of a bromide ion with high polarizability. It is also considered that a variation in the distance between crystal lattices cannot be defined only by the bond distance between a metal atom and a ligand. Specifically, even if the bond distance is the same, the distance between crystal lattices when a metal complex is incorporated may vary depending on what value to select as the size (ionic radius and van der Waals' radius) of the ligand to be bonded and on what value to select as the polarizability of the ligand to be bonded.

The difference between the technique disclosed in the aforementioned patent specification and the present invention may be listed as follows. The technique of the patent is characterized in that:

① it is a technique for keeping high sensitivity, although the optical reflecting density of a light-sensitive material applied on a reflecting support at 680 nm is heightened, by introducing a dislocation line into high silver chloride grains containing 95 mol % or more of silver chloride;

② a distance between a metal atom and an atom, molecule or ligand bonded with the metal atom is defined to smaller than 0.45 times or larger than 0.55 times the lattice constant of a silver halide crystal;

③ the metal compound is preferably contained at the position close to the center of a silver halide grain, this differs from the present invention, and the technique does not intend to obtain an effect by doping the outer peripheral phase of a grain, containing 10 mol % or more of silver bromide, with the metal compound; and ④ the grain has preferably a cubic form and differs in shape from the tabular grains, having a grain thickness of 0.2 $\mu$m or less, which are used in the present invention.

It is understood that the above-mentioned conventional technique is quite different and is distinguished from the technique of the present invention in the object and means to attain the object.

In the patent specification, as the typical complexes, those having Cl, CN or $NO_2$ as a ligand are described, but there is no description about the ligands comprising an organic ligand, particularly a heterocycle which ligands have the effect in the present invention.

The metal complex to be used in the present invention is preferably a complex having as a ligand a heterocyclic compound in a number more than half of the coordination number of the metal atom. A metal complex having a 5- or 6-membered nitrogen-containing heterocyclic compound as a ligand is particularly preferable.

As a complex used in the present invention, it is preferred to use a metal complex having, as a ligand, an organic compound that does not have any charge, and that does not form any coordinate bond to a metal other than the center metal, or a metal ion thereof, in a number over the half of the coordination number of the metal atom (in the case that the ligand is a polydentate ligand, an organic compound which does not have any charge and does not form any coordinate bond to a metal or metal ion other than the center metal, with coordinate atoms in a number over the half of the coordination number of the central metal).

The organic compound in the present invention denotes a compound having a chain or cyclic hydrocarbon as the mother structure, or a compound in which a part of a carbon or hydrogen atom of the mother structure is substituted by another atom or atomic group. As mentioned above, in consideration of the size of the ligand field effect, an aromatic compound or a heterocyclic compound can be used preferably as the organic compound as a ligand in the complex. As the aromatic compound, a compound having substituents to be the coordination sites at two adjacent carbon atoms is preferable. Examples thereof include 1,2-dimethoxybenzene, catechol, (+/−)-hydrobenzoin, 1,2-benzenedithiol, 2-aminophenol, o-anisidine, 1,2-phenylenediamine, 2-nitronaphthol, 2-nitroaniline, 1,2-dinitrobenzene. Moreover, although it is not a compound having substituents bonded to an aromatic ring, which substituents can be the coordination sites bonded to adjacent two carbon atoms, an aromatic compound having two substituents to be the coordination sites provided at a distance capable of coordinated to one metal is also preferable. Concrete examples thereof include diphenyl diketone, 1,8-dinitronaphthalene, 1,8-naphthalenediol. The aromatic compounds provided here are preferable examples of a bidentate ligand. As a monodentate heterocyclic compound, it is preferable to have an oxygen atom, a sulfur atom, a selenium atom, a tellurium atom, and a nitrogen atom as a hetero atom in a ligand, and it is also preferable to have a phosphorus atom. As a bidentate or tridentate heterocyclic compound to be coordinated to a metal or a metal ion, a ring gathered heterocyclic compound with the monodentate heterocyclic compounds bonded with each other is preferable. Concrete preferable examples of a monodentate ligand include furan, thiophenine, 2H-pyrrol, pyran, pyridine, and a derivative thereof. As a bidentate ligand, a compound, in which the above-mentioned compounds that are preferable monodentate ligands are bonded with each other, is preferable. In particular, 2,2'-bithiophene and a derivative thereof are preferable. Moreover, 2,2'-biquinoline, 1,10-phenanthronine, and a derivative thereof having a fused ring in a skeleton of the bidentate ligands are also preferable. Furthermore, as a tridentate ligand, 2,2':5',2-tarthiophene, 2,2':5,2"-tarpyridine, and a derivative thereof are preferable. As a substituent in these derivatives, one not having interaction with a metal ion is preferable. However, even in the case it has a substituent capable of being coordinated to a metal, one having a donor atom in the substituent coordinated to the central metal, and capable of becoming a bidentate ligand or a tridentate ligand as the ligand as a whole is also preferable. Preferred examples of the substituent in the derivatives include a hydrogen atom, a substituted or unsubstituted alkyl group (e.g., methyl group, ethyl group, n-propyl group, isopropyl group, n-butyl group, t-butyl group, hexyl group, octyl group, 2-ethylhexyl group, dodecyl group, hexadecyl group, t-octyl group, isodecyl group, isostearyl group, dodecyloxypropyl group, and trifluoromethyl group), an alkenyl group, an alkynyl group, an aralkyl group, a cycloalkyl group (e.g., cyclohexyl group and 4-t-butylcyclohexyl group), a substituted or unsubstituted aryl group (e.g., phenyl group, p-tolyl group, p-anisyl group, p-chlorophenyl group, 4-t-butylphenyl group, and 2,4-di-t-aminophenyl group), a halogen atom (e.g., fluorine, chlorine, bromine, and iodine), a cyano group, a mercapto group, a hydroxyl group, an alkoxy group (e.g., methoxy group, butoxy group, methoxyethoxy group, dodecyloxy group, and 2-ethylhexyloxy group), an aryloxy group (e.g., phenoxy group, p-tolyloxy group, and 4-t-butylphenoxy group), an alkylthio group, an arylthio group, an acyloxy group, a sulfonyloxy group, a substituted or unsubstituted amino group (e.g., amino group, methylamino group, dimethylamino group, anilino group, and N-methylanilino group), and an acyl group (e.g., formyl group and acetyl group). Moreover, the adjacent substituents in the molecules may form a saturated carbon ring, an aromatic carbon ring or a hetero aromatic ring by ring closure. However, in the present invention, the above-mentioned ligand in a complex comprising a skeleton and a substituent is limited to an organic compound not having charges in the complex formation and not having interaction with a metal or a metal ion other than the central metal.

The central metal of the metal complex in the present invention is not particularly limited, but as disclosed in many documents and patents such as J. Phys.: Condens, Matter 9 (1997) 3227–3240, considering that a part of the grains and a dopant are replaced, that is, $[AgX_6]^{5-}$ ($X^-$= halogen ion) in the silver halide grains is substituted as one unit, at the time a sexidentate octahedral complex is taken in the silver halide grains as a dopant, one having a quadridentate structure or a sexidentate structure as the coordination structure around the metal is preferable. Furthermore, one not having an unpaired electron in the metal or the metal ion, or one having all the stabilized orbits filled with electrons in the case of the ligand field cleavage of the d orbit of the metal is more preferable. Concrete preferable examples include metal ions of an alkali earth metals, iron, ruthenium, manganese, cobalt, rhodium, iridium, copper, nickel, palladium, platinum, gold, zinc, titanium, chromium, osmium, cadmium, and mercury. Among these examples, iron, ruthenium, manganese, cobalt, rhodium, iridium, titanium, chromium, and osmium are particularly preferable. Moreover, ions of iron, ruthenium, and cobalt are most preferable.

The specific examples of the complex for use in the present invention (which correspond to metal complex defined in the above item (8) are shown below, however the complex is not limited to them.

| $[M(bpy)_3]^{2+}$ | $[M(phen)_3]^{2+}$ |
|---|---|
| $M = Fe^{2+}, Ru^{2+}, Co^{2+}$ | $M = Fe^{2+}, Ru^{2+}, Co^{2+}$ |
| bpy = 2,2'-bipyridine | phen = 1,10-phenanthroline |

-continued $[M(py)_6]^{2+}$
M = $Fe^{2+}$, $Ru^{2+}$, $Co^{2+}$
py = pyridine $[M(trpy)_2]^{2+}$
M = $Fe^{2+}$, $Ru^{2+}$, $Co^{2+}$
trpy = 2,2′:5′,2-terpyridine $[M(bpy)_2L_2]^{n+}$
M = $Fe^{2+}$, $Ru^{2+}$, $Co^{2+}$
bpy = 2,2′-bipyridine
n = 2, 1, 0

$[M(bpy)_2LL']^{n+}$
M = $Fe^{2+}$, $Ru^{2+}$, $Co^{2+}$
bpy = 2,2′-bipyridine
n = 2, 1, 0

L = Cl—, CN—, $NH_3$, $H_2O$, CO, $H_2$, $CH_3CN$, 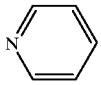

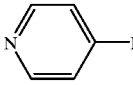

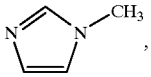

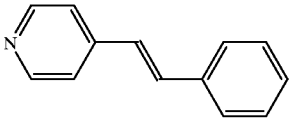

methyl-diphenyl-phosphine, butylamine

L, L′ = Cl—, 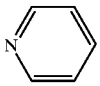 CN, 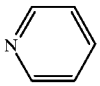

$CH_3CN$, Cl— CO, Cl— $H_2$, Cl—

$[M(bpy)_2L]^{2+}$
M = $Fe^{2+}$, $Ru^{2+}$, $Co^{2+}$
bpy = 2,2′-bipyridine

L = 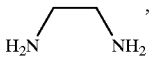 , 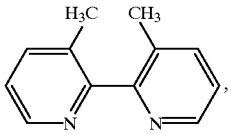 ,

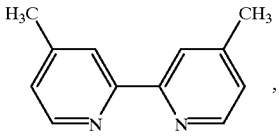 ,

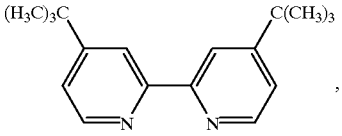 ,

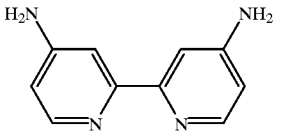

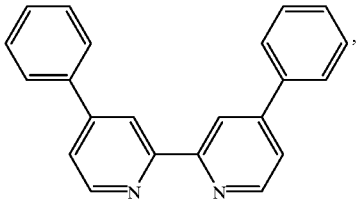 ,

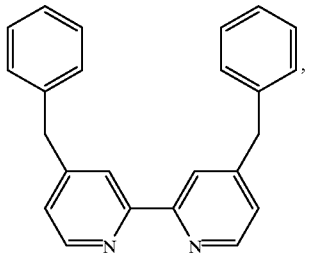 ,

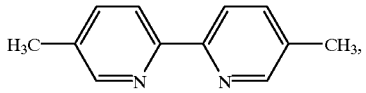 ,

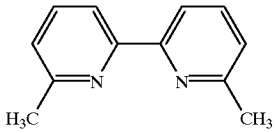

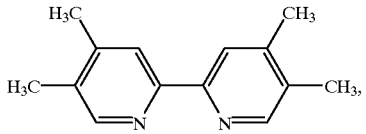 ,

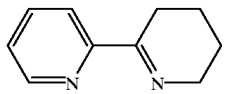 , 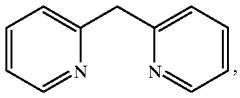 ,

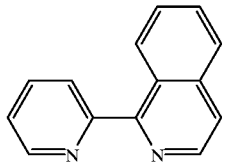 ,

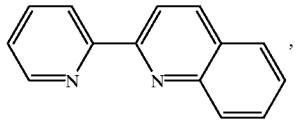 ,

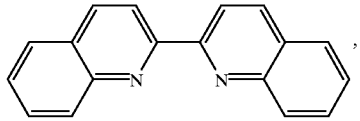 ,

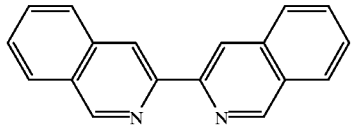

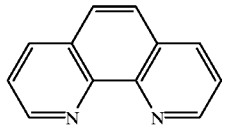 , 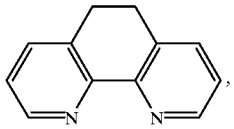 ,

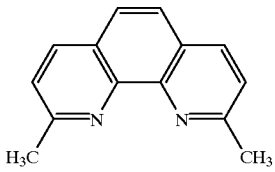 ,

-continued

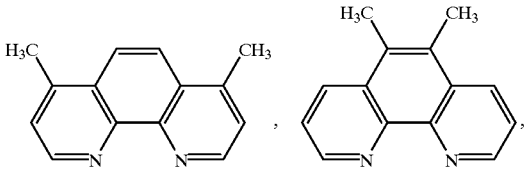

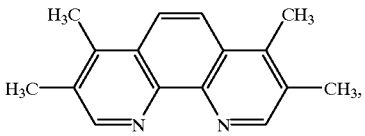

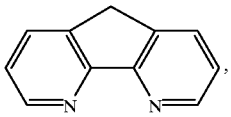

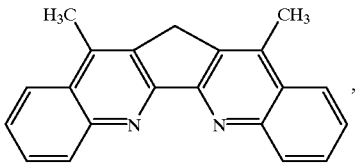

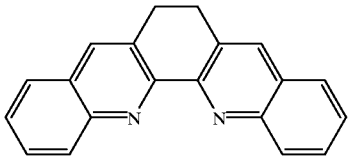

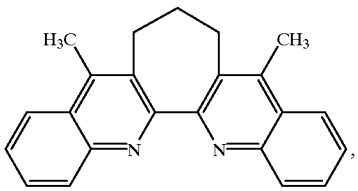

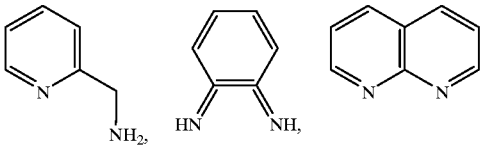

$[ML_2]^{2+}$

M = $Fe^{2+}$, $Ru^{2+}$, $Co^{2+}$

L =

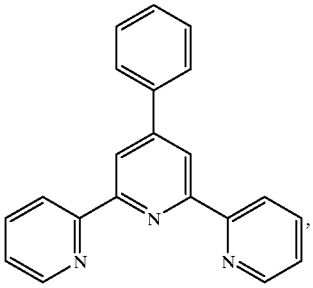

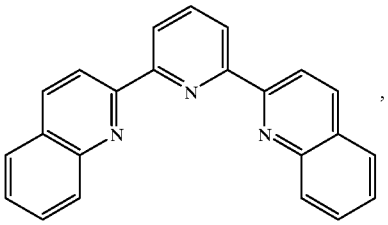

-continued

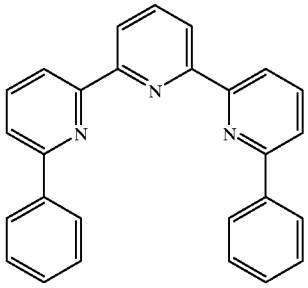

$[M(bpy)(phen)_2]^{2+}$
M = $Fe^{2+}$, $Ru^{2+}$, $Co^{2+}$
bpy = 2,2′-bipyridine
phen = 1,10-phenanthroline $[M(bpy)(phen)(py)]^{2+}$
M = $Fe^{2+}$, $Ru^{2+}$, $Co^{2+}$
bpy = 2,2′-bipyridine
phen = 1,10-phenanthroline
py = pyridine $[M(bpy)(py)(en)]^{2+}$
M = $Fe^{2+}$, $Ru^{2+}$, $Co^{2+}$
bpy = 2,2′-bipyridine
py = pyridine
en = ethylenediamine $[M(bpy)(py)(NH_3)]^{2+}$
M = $Fe^{2+}$, $Ru^{2+}$, $Co^{2+}$
bpy = 2,2′-bipyridine
py = pyridine $[M(bpy)(trpy)L]^{2+}$
M = $Fe^{2+}$, $Ru^{2+}$, $Co^{2+}$
bpy = 2,2′-bipyridine
trpy = 2,2′:5′,2″-terpyridine
L = Cl——, CN——, $NH_3$ In the case the complex molecule for doping is a cation so as to form a salt with an anion, as the paired anion, one easily soluble in water and suited for a precipitation operation of a silver halide emulsion is preferable. Concretely, it is preferable to use halogen ion, nitric acid ion, perchloric acid ion, tetrafluoroboric acid ion, hexafluorophosphoric acid ion, tetraphenylboric acid ion, hexafluorosilicic acid ion, and trifluoromethane sulfonic acid ion. Since the ligand exchange reaction with the ligand of the complex is generated if an anion with a strong coordination, such as cyano ion, thiocyano ion, nitrous acid ion, oxalic acid ion, or the like, is used as the paired anion so that the composition and the structure of the complex according to the present invention may not be sustained, it is not preferable to use these anions.

In the present invention, it is also preferable to use a complex having at least one compound capable of being coordinated to two or more metal ions at the same time as a ligand. The wording "two or more metal ions" means that one ion is a center metal or a center metal ion of a metal complex and the other(s) is a metal ion other than it.

For this purpose, as shown in Comprehensive Coordination Chemistry, vol. 5, 775–851, or Coord. Chem. Rev. 35 (1981) 253, 45 (1982) 307, 67 (1985) 297, 115 (1992) 141, 131 (1994) 1, and 146 Part 1 (1996)211, an atom or a substituent capable of interacting with (complex formation) an Ag ion introduced into a ligand, various substances can be used, for example, alcohol, carboxylic acid, peroxy acid, sulfonic acid, sulfinic acid, isocyanic acid, hydroperoxide, amido carboxylic acid, amine, imine, hydradine, ketone, aldehyde, ether, ester, peroxide, acid anhydride, acid halide, amido, hydrazido, imido, nitrile, cyanate, thiocyanate, nitro group, nitroso group, alkyl nitrate, alkyl nitrite, acylamine, nitrile oxide, hydroxylamine, azo group, azo methine, oxime, phosphine, arsenic, antimony, or the like. Considering that no charge is preferable, it is preferable to use amine, imine, hydrazine, ketone, aldehyde, ether, ester, peroxide, acid anhydride, acid halide, amido, hydrazido, imido, nitril, cyanate, thiocyanate, nitro group, nitroso group, alkyl nitrate, alkyl nitrite, acyl amine, or nitrile oxide, as the substituent. Moreover, in order to prevent disturbance at the time of taking in complex molecules due to the size of the ligand as mentioned above, a compound with a small molecule size, that is, a 5-membered or 6-membered heterocyclic compound, is preferable as the ligand. From the advantages of synthesis or molecular design, a complex having the same compounds at all the coordination sites as the ligand is preferable, but it is also preferable to use one or two halogen ions as the ligand in order to have a complex to be doped in the environment as close as to the silver halide grains. Moreover, in consideration of the electron state of the complex and the interaction of the silver ion at the same time, it is also preferable to use 2,2':6',2"-tarpyridine and a ligand having a portion capable of interacting with a silver ion at the same time.

As the ligand to interact with the silver ion, one having a site interacting with a skeleton itself is most preferable. Concrete preferable examples include oxazoline, oxazole, isooxazole, thiazoline, thiazole, isothiazole, thiadiazole, furazane, pyridazine, pyrimidine, pyradine, triazine, oxadiazine, thiadiazine, and dithiazine. Among these examples, oxazole, thiazole, and pyradine are particularly preferable. Since two coordinatable atoms exist facing with each other in the ring of these compounds, when they are doped, they are expected to be a complex having a structure most interactable with $Ag^+$, and thus they are preferable compounds. Furthermore, it is also preferable to have a derivative thereof as the ligand. Preferred examples of the substituent in the derivatives include a hydrogen atom, a substituted or unsubstituted alkyl group (e.g., methyl group, ethyl group, n-propyl group, isopropyl group, n-butyl group, t-butyl group, hexyl group, octyl group, 2-ethylhexyl group, dodecyl group, hexadecyl group, t-octyl group, isodecyl group, isostearyl group, dodecyloxypropyl group, trifluoromethyl group, and methanesulfonylaminomethyl group), an alkenyl group, an alkynyl group, an aralkyl group, a cycloalkyl group (e.g., cyclohexyl group and 4-t-butylcyclohexyl group), a substituted or unsubstituted aryl group (e.g., phenyl group, p-tolyl group, p-anisyl group, p-chlorophenyl group, 4-t-butylphenyl group, and 2,4-di-t-aminophenyl group), a halogen atom (e.g., fluorine, chlorine, bromine, and iodine), a cyano group, a nitro group, a mercapto group, a hydroxyl group, an alkoxy group (e.g., methoxy group, butoxy group, methoxyethoxy group, dodecyloxy group, and 2-ethylhexyloxy group), an aryloxy group (e.g., phenoxy group, p-tolyloxy group, p-chlorophenoxy group, and 4-t-butylphenoxy group), an alkylthio group, an arylthio group, an acyloxy group, a sulfonyloxy group, a substituted or unsubstituted amino group (e.g., amino group, methylamino group, dimethylamino group, anilino group, and N-methylanilino group), an ammonio group, a carbonamide group, a sulfonamide group, an oxycarbonylamino group, an oxysulfonylamino group, a substituted ureido group (e.g., 3-methylureido group, 3-phenylureido group, and 3,3-dibutylureido group), a thioureido group, an acyl group (e.g., formyl group and acetyl group), an oxycarbonyl group, a substituted or unsubstituted carbamoly group (e.g., ethylcarbamoyl group, dibutylcarbamoyl group, dodecyloxypropylcarbamoyl group, 3-(2,4-di-t-aminophenoxy) propylcarbamoyl group, piperidinocarbonyl group, and morpholinocarbonyl group), a thiocarbonyl group, a thiocarbamoly group, a sulfonyl group, a sulfinyl group, an oxysulfonyl group, a sulfamoyl group, a sulfino group, a sulfano group, a carboxylic acid or a salt thereof, a sulfonic acid or a salt thereof, and a phosphonic acid or a salt thereof. Moreover, substituents may form a saturated carbon ring, an aromatic carbon ring or a hetero aromatic ring by ring closure.

As a ligand to interact with a silver ion, one without having an interactable site in the skeleton itself but having an interactable site only in a substituent is also preferable. In these compounds, concrete preferable basic skeletons are furan ring, thiophene ring, pyridine ring, and/or benzene ring. As a preferable substituent as an interactable site, amine, imine, hydradine, ketone, aldehyde, ether, ester, peroxide, acid anhydride, acid halide, amido, hydrazido, imido, nitrite, residue of cyanate or thiocyanate, nitro group, nitroso group, alkyl nitrate, alkyl nitrite, residue of acyl amine, or residue of nitrile oxide, can be used.

Although the central metal of that kind of complex is not particularly limited, one having a quadridentate structure or a sexidentate structure as the coordination structure around the metal is preferable. More preferably, one without an unpaired electron in a metal or a metal ion, or one having all the stabilized orbits filled with electrons in the case of the ligand field cleavage of the d orbit of the metal is more preferable. The use of such a metal ion having a valency of +2 is further preferable. Concrete particularly preferable examples include metal ions of alkaline earth metals, iron (II), ruthenium (II), osmium (II), zinc, cadmium, and mercury is preferable. Among these ions, the use of metal ions of magnesium, iron (II), ruthenium (II), and zinc are most preferable.

The above mentioned metal complex having a compound which can coordinate to two or more metal ions at the same time, can be represented by the following formula A, formula B, or formula C. As the specific examples of L, L', L", M, and X in these formulas, those in the below shown specific examples of the complex can be mentioned.

The following will describe specific examples of the complex that can be used in the present invention (the metal complex which falls under the metal complex defined in the above item (9)). The complex is not limited to these examples in the present invention. Moreover, although the concrete examples mentioned herein are only compounds with a heterocyclic skeleton as a ligand, the above-mentioned substituents can be provided in a ligand.

$[ML_nX_{(6-n)}]^z$ $M = Mg^{2+}, Mn^{2+}, Fe^{2+}, Ru^{2+}, Co^{2+}, Ni^{2+}, Cu^{2+}, Zn^{2+}, Cd^{2+}$ $X = Cl^-, Br^-, F^-, I^-, OH^-, H_2O, NH_3, CH_3COO^-, PO_4^{3-}, SO_4^{2-}, CO_3^{2-}, NO_2^-, SO_3^{2-}, N_3^-, N_2, SCN^-, CN^-$ $n = 4, 5, 6$ $z = -6 \sim +2$

L =

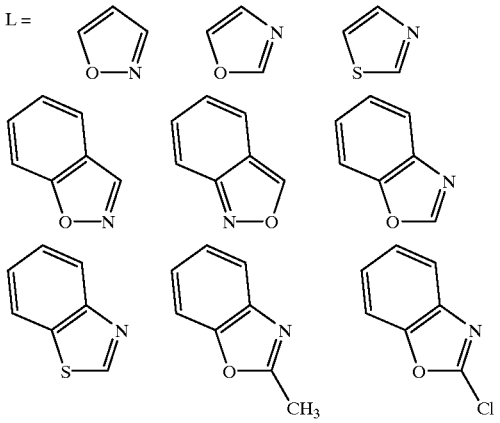

-continued
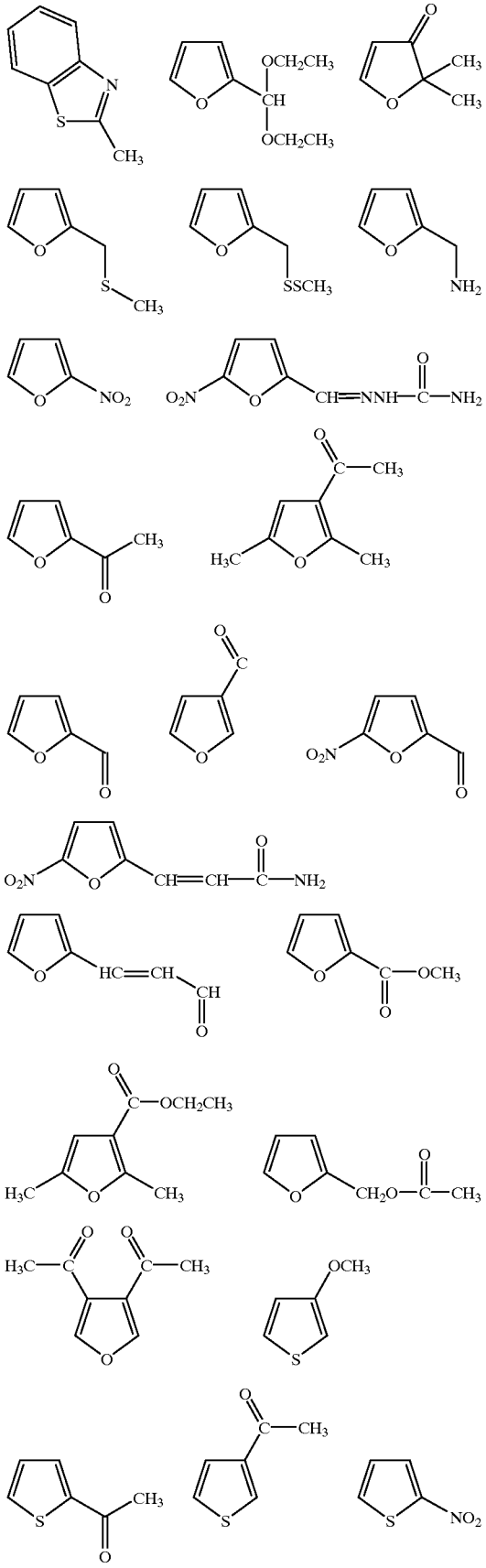
-continued
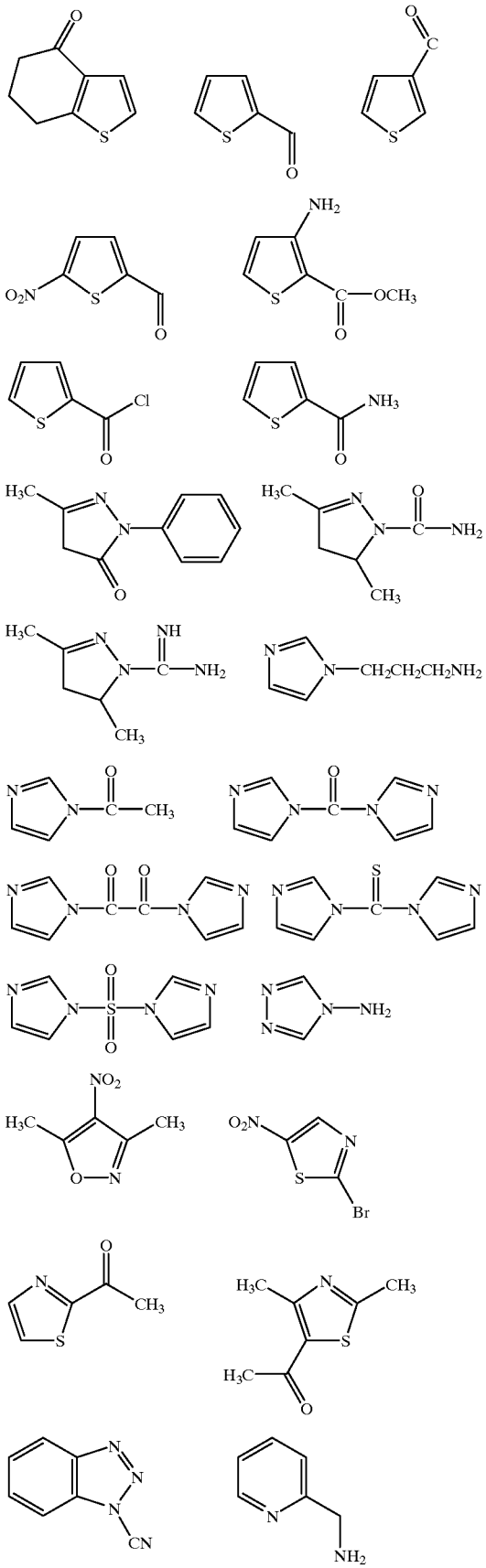

-continued
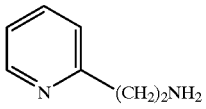
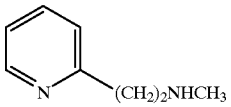
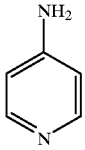
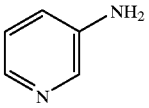
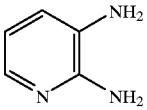
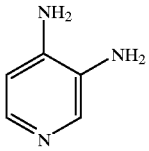
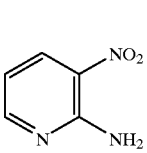
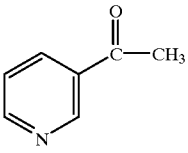
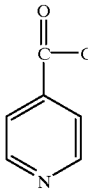
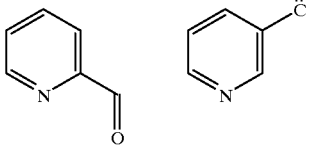
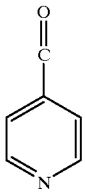
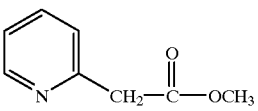
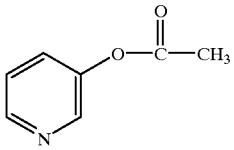
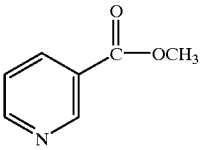
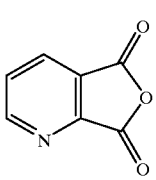
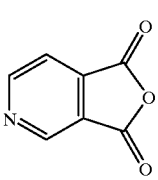
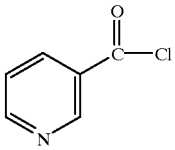
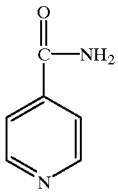
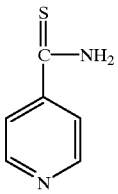
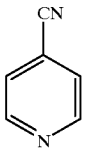
$[ML'_mX_{(6-2m)}]^z$
M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$
X= $Cl^-$, $Br^-$, $F^-$, $I^-$, $OH^-$, $H_2O$, $NH_3$, $CH_3COO^-$, $PO_4^{3-}$, $SO_4^{2-}$, $CO_3^{2-}$, $NO_2^-$, $SO_3^{2-}$, $N_3^-$, $N_2$, $SCN^-$, $CN^-$
*m* = 2, 3
*z* = -6~ +2
L′ = 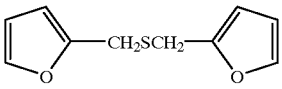
-continued
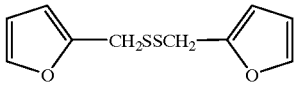
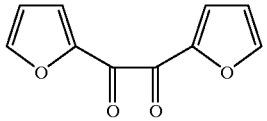
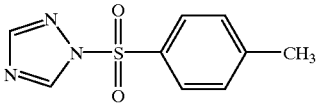
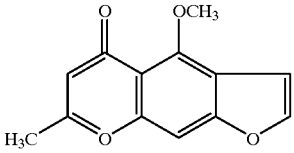
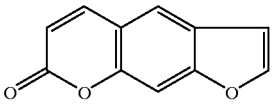
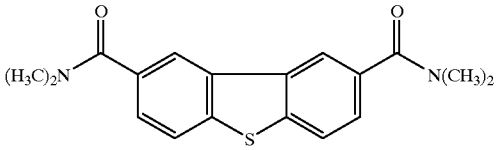
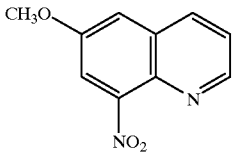
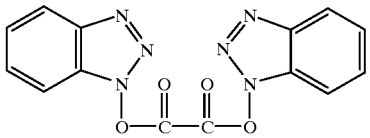
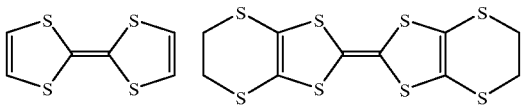
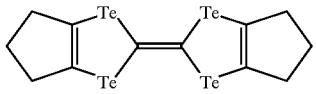
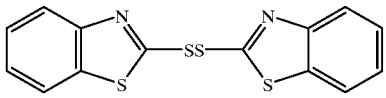
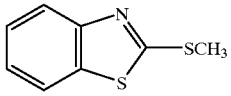
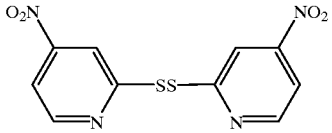
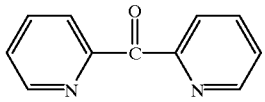

-continued

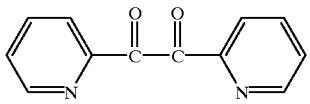

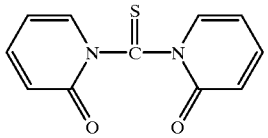

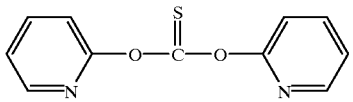

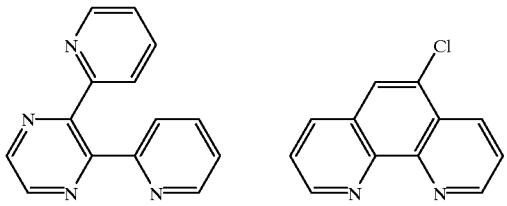

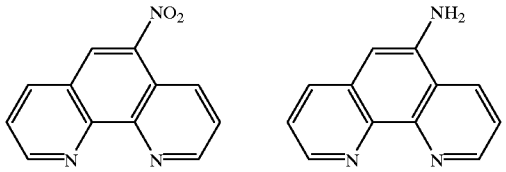

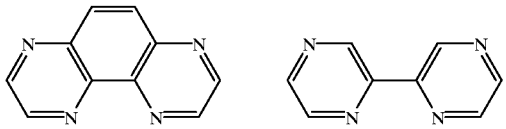

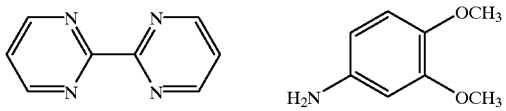

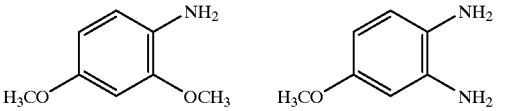

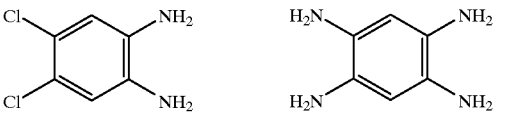

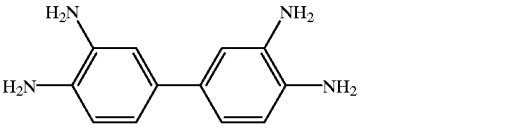

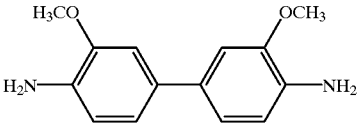

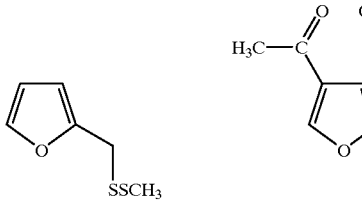

-continued

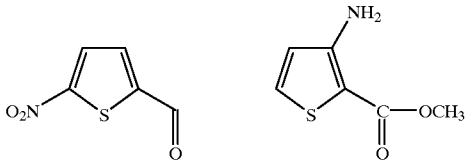

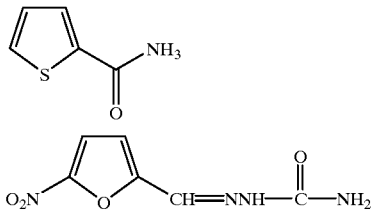

$[ML''_2]^z$

M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$ $z$ = -6~ +2

L'' =

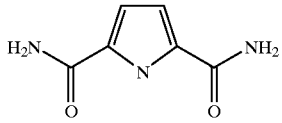

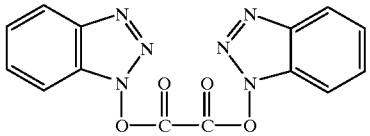

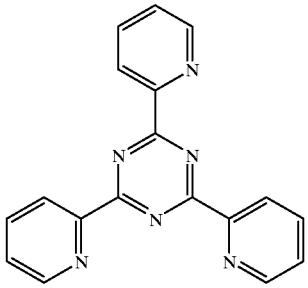

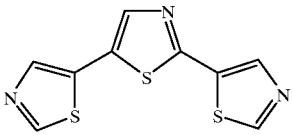

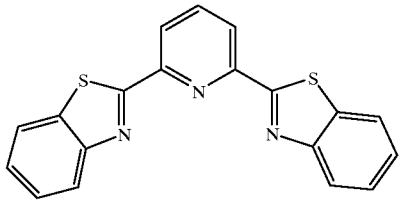

In the case the above-mentioned complex molecule become a cation so as to form a salt with an anion, as the paired anion, it is preferable to use halogen ion, nitric acid ion, perchloric acid ion, tetrafluoroboric acid ion, hexafluorophosphoric acid ion, tetraphenylboric acid ion, hexafluorosilicic acid ion, and trifluoromethane sulfonic acid ion, each of which is easily soluble in water and suited for a precipitation operation of a silver halide emulsion. Since the ligand exchange reaction with the ligand of the complex is generated if an anion with a strong coordination, such as cyano ion, thiocyano ion, nitrous acid ion, oxalic acid ion, or the like, is used as the paired anion so that the composition and the structure of the complex according to the present invention may not be sustained, it is not preferable to use these anions.

In contrast, in the case the complex molecule becomes an anion so as to form a salt with a cation, as the paired cation, it is preferable to use alkaline metal ions, such as sodium ion, potassium ion, rubidium ion, and cesium ion, ammonium ion, or quaternary alkyl ammonium ion each of which is easily soluble in water and suited for a precipitation operation of a silver halide emulsion. As the alkyl group of the quaternary alkyl ammonium, methyl group, ethyl group, propyl group, iso-propyl group, and n-butyl group are preferable. In particular, tetramethylammonium ion, tetraethylammonium ion, tetrapropylammonium ion and tetra(n-butyl)ammonium ion, in which all the four substituents are same, are preferable. Moreover, it is also preferable to add an $H^+$ ion to a compound used as the ligand so as to be a cation as the paired cation.

Furthermore, in the present invention, it is also preferable to use a metal complex having, as a ligand, an organic compound having a moiety capable of having a negative charge, in a number more than half of the coordination number of the metal atom. The "moiety capable of having a negative charge" here denotes an atom or a group of atoms coordinated as an anion.

When a hexacoordinate octahedral complex is incorporated as a dopant into a silver halide grain, the dopant is believed to replace part of the grain making $[AgX_6]^{5-}$ ($X^-$=a halogen ion) in the silver halide grain as a unit, as described in many of literature and patents including J. Phys.: Condens. Matter 9 (1997) 3227–3240. Therefore, if a molecule size of the complex to be doped is too large, it is expected to be unsuitable for the dopant, further, as the charges of the complex to be doped get away from minus pentavalent, it is considered to be disadvantageous for the replacement. From the discussion from a molecule model, in the case the complex to be doped has a 5-membered or 6-membered ring compound as the ligand, the complex molecule is considered to be taken into the grains because the grain structure in the vicinity of the taken-in complex molecule is distorted, or $Ag^+$ adjacent to $[AgBr_6]^{5-}$ is further replaced.

In contrast, as to the complex used for the dopant, in order to assemble the complex molecule into the silver halide grains in the state as close as possible to the NaCl type crystal structure in the silver halide grains, it is preferable to have a negative charge in a ligand in the complex. It is preferable to use, as a ligand, a compound at least having a moiety with a possibility of having a negative charge in a molecule. From this, as a ligand, a 5-membered or 6-membered heterocyclic compound having a small molecule size and capable of having a negative charge can be used preferably. Furthermore, in order to provide the state as close as possible to the $[AgX_6]^{5-}$ unit to be substituted in the complex to be doped, it is more preferable that the ligand has minus monovalent charge or at least a moiety with a possibility of having minus monovalent charge in the molecule. Moreover, since the energy gap between the maximum occupied orbit and the minimum empty orbit becomes largest when all the coordination sites of a metal each are occupied with a heterocyclic compound, as the complex, a complex having only a heterocyclic compound as the ligand is most preferable. The ligand in the complex needs not be the same compound, but from the advantages of synthesis and molecular design, a complex having the same compounds at all the coordination sites as the ligand is preferable. Therefore, it can be believed the above complexes for use in the present invention are more preferable than $[Fe(EDTA)]^{2-}$ or $[Ir(C_2O_4)_3]^{3-}$ conventionally used.

As a ligand, concretely, a compound capable of having a negative charge by deprotonation, such as, pyrrol, pyrazole, imidazole, triazole, and tetrazole is preferable. It is also preferable to have a derivative thereof as the ligand. Preferred examples of the substituent in the derivatives include a hydrogen atom, a substituted or unsubstituted alkyl group (e.g., methyl group, ethyl group, n-propyl group, isopropyl group, n-butyl group, t-butyl group, hexyl group, octyl group, 2-ethylhexyl group, dodecyl group, hexadecyl group, t-octyl group, isodecyl group, isostearyl group, dodecyloxypropyl group, trifluoromethyl group, and methanesulfonylaminomethyl group), an alkenyl group, an alkynyl group, an aralkyl group, a cycloalkyl group (e.g., cyclohexyl group and 4-t-butylcyclohexyl group), a substituted or unsubstituted aryl group (e.g., phenyl group, p-tolyl group, p-anisyl group, p-chlorophenyl group, 4-t-butylphenyl group, and 2,4-di-t-aminophenyl group), a halogen atom (e.g., fluorine, chlorine, bromine, and iodine), a cyano group, a nitro group, a mercapto group, a hydroxyl group, an alkoxy group (e.g., methoxy group, butoxy group, methoxyethoxy group, dodecyloxy group, and 2-ethylhexyloxy group), an aryloxy group (e.g., phenoxy group, p-tolyloxy group, p-chlorophenoxy group, and 4-t-butylphenoxy group), an alkylthio group, an arylthio group, an acyloxy group, a sulfonyloxy group, a substituted or unsubstituted amino group (e.g., amino group, methylamino group, dimethylamino group, anilino group, and N-methylanilino group), an ammonio group, a carbonamide group, a sulfonamide group, an oxycarbonylamino group, an oxysulfonylamino group, a substituted ureido group (e.g., 3-methylureido group, 3-phenylureido group, and 3,3-dibutylureido group), a thioureido group, an acyl group (e.g., formyl group and acetyl group), an oxycarbonyl group, a substituted or unsubstituted carbamoly group (e.g., ethylcarbamoyl group, dibutylcarbamoyl group, dodecyloxypropylcarbamoyl group, 3-(2,4-di-t-aminophenoxy) propylcarbamoyl group, piperidinocarbonyl group, and morpholinocarbonyl group), a thiocarbonyl group, a thiocarbamoly group, a sulfonyl group, a sulfinyl group, an oxysulfonyl group, a sulfamoyl group, a sulfino group, a sulfano group, a carboxylic acid or a salt thereof, a sulfonic acid or a salt thereof, and a phosphonic acid or a salt thereof. A compound provided by ring closure of these adjacent substituents so as to form a saturated carbon ring, an aromatic carbon ring or a heteroaromatic ring can also be used preferably. Moreover, a compound provided by bonding of some of the pyrrol, pyrazole, imidazole, triazole, and tetrazole comprising the skeleton so as to be a bidentate or tridentate compound to be coordinated to a metal ion is also preferable. In particular, 2,2"-biimidazole and a derivative thereof are most preferable. Furthermore, as a ligand, even if it is a compound not having negative charges in a part of the ring comprising the basic skeleton, if a moiety having a negative charge exists in the substituent, it is also a preferable compound. Also in this case, as mentioned above, in consideration of the ligand field effect, it is preferable that the vicinity of the ligand atom has the aromatic characteristics. A compound having furan, thiophene, pyran, pyridine, 2,2'-bithiophene, and 2,2':6'2"-tarpyridine as the skeleton is preferable. As the substituent thereof, a substituent selected from the group consisting of alcohol, carboxylic acid, peroxy acid, sulfonic acid, sulfinic acid, sulphenic acid, nitro group, isocyanide, hydroperoxide, amido carboxylic acid, azoxy group, azohydroxide, hydroxylamine, and oxime is preferable.

Although the central metal of that kind of complex is not particularly limited, one having a quadridentate structure or a sexidentate structure as the coordination structure around the metal is preferable. More preferably, one without an unpaired electron in a metal or a metal ion, or one having all the stabilized orbits filled with electrons in the case of the ligand field cleavage of the d orbit of the metal is more preferable. The use of such a metal having a valency of +2 is particularly preferable. (Plus divalent metal ion is further preferable.) Particularly preferable examples include metal ions of alkaline earth metals, iron (II), ruthenium (II), osmium (II), zinc, cadmium, and mercury is preferable. Among these ions, the use of metal ions of magnesium, iron (II), ruthenium (II), and zinc are most preferable.

The following will describe specific examples of the complex that can be used in the present invention (the metal complex which falls under the metal complex defined in the above item (10)). The complex is not limited to these examples in the present invention.

The compounds listed up below include compounds which fall under the metal complex defined in the above items other than item (10). (Compounds that have a furan ring, a thiophene ring, a pyridine ring and/or a benzene ring and have, as a substituent, a group mentioned as a site that interacts with a silver ion also fall under the metal complex defined in the above item (9).)

$[ML_nX_{(6-n)}]^z$

M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$

X = Cl——, Br——, F——, I——, OH——, $H_2O$, $NH_3$, $CH_3COO$——, $PO_4^{3-}$, $SO_4^{2}$, $CO_3^{2-}$ $NO_2$——, $SO_3^{2-}$, $N_3$——, $N_2$, SCN——, CN——, $n$ = 4, 5, 6

$z$ = -6 ~ +2

L =

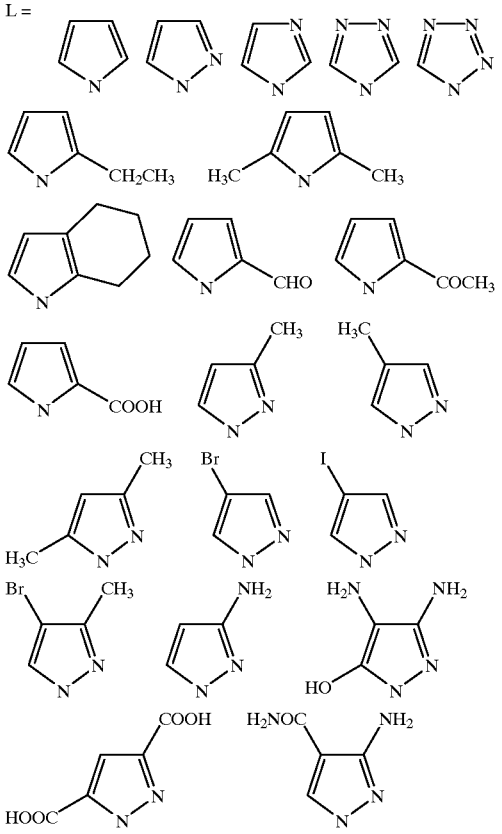

-continued

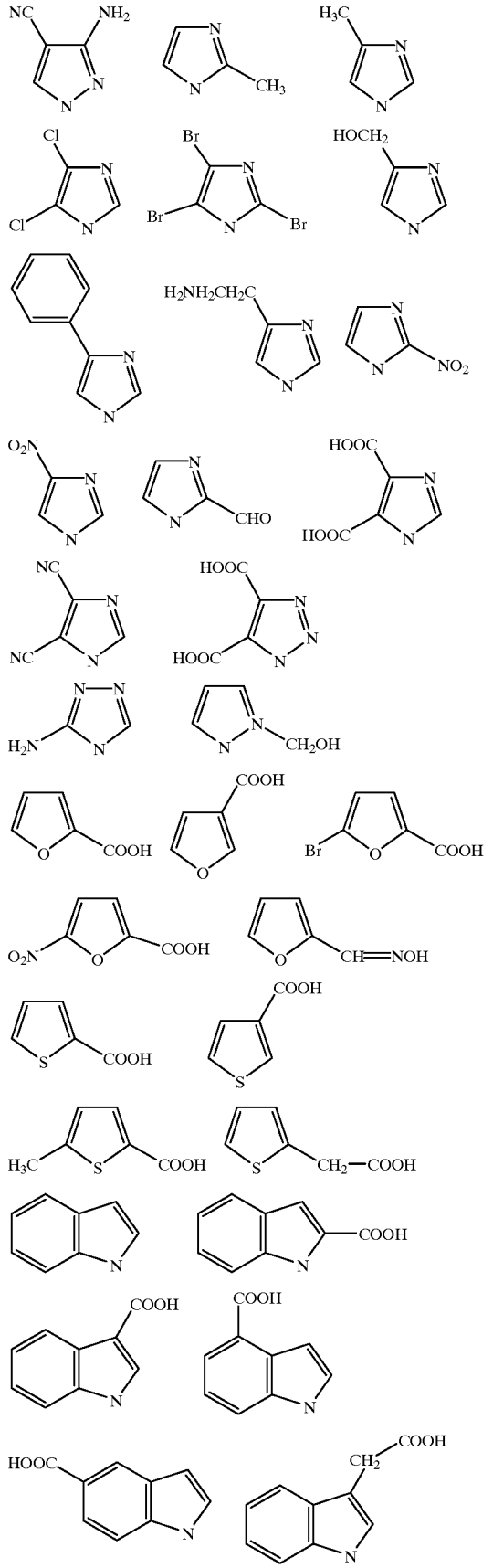

-continued
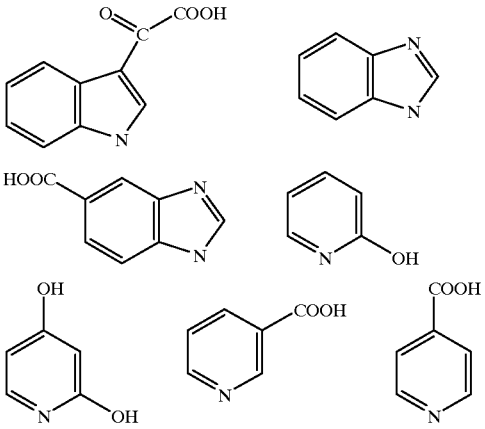
$[ML'_mX_{(6-m)}]^z$
M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$
X = Cl——, Br——, F——, I——, OH——, $H_2O$, $NH_3$, $CH_3COO$——, $PO_4^{3-}$, $SO_4^{2}$, $CO_3^{2-}$ $NO_2$——, $SO_3^{2-}$, $N_3$——, $N_2$, SCN——, CN——,
*m* = 2, 3
*z* = -6 ~ +2
L =
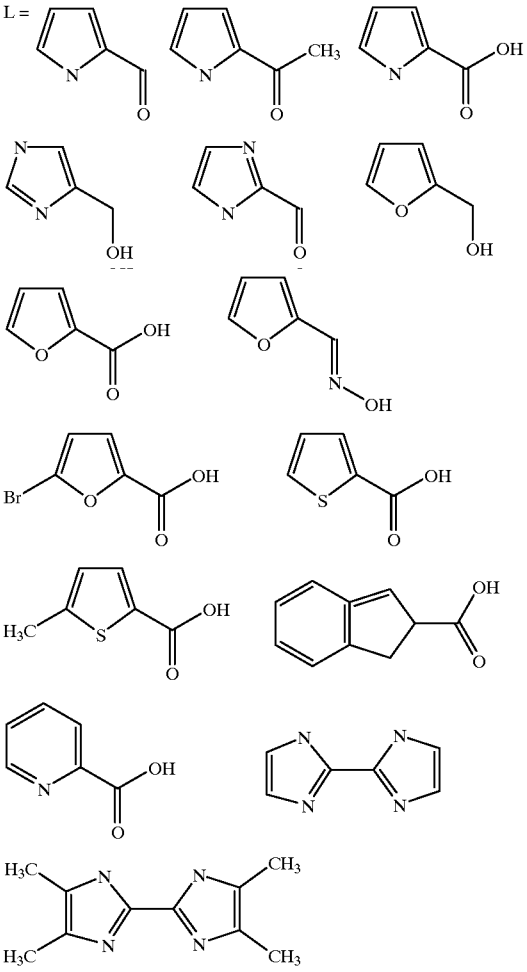
-continued
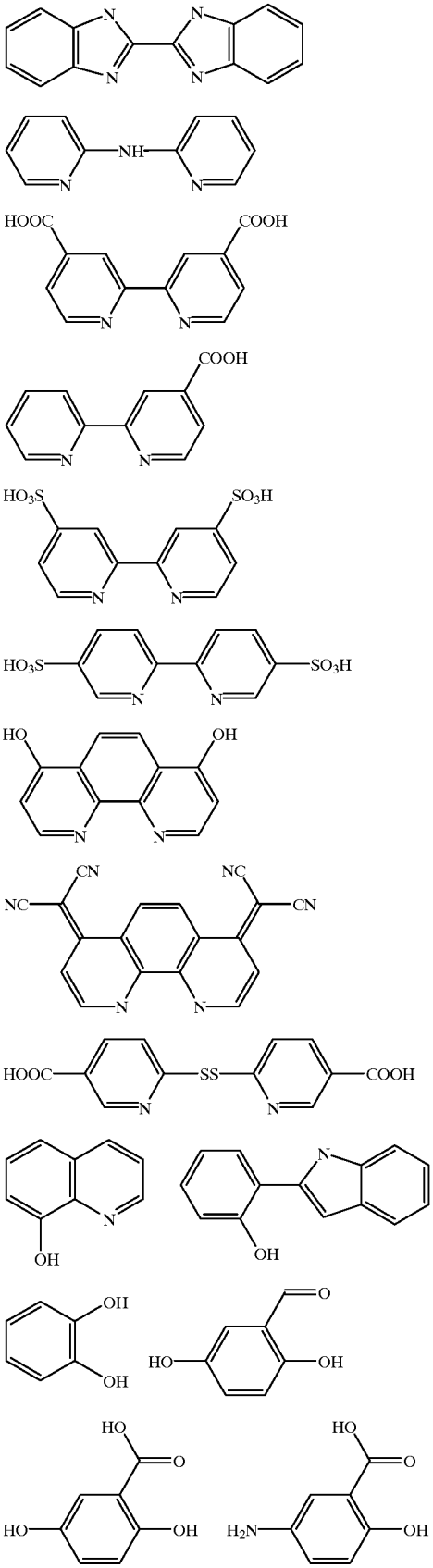

-continued

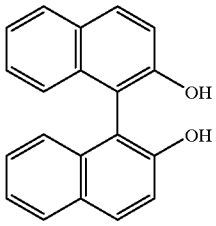

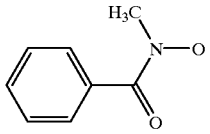

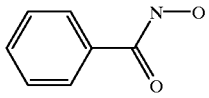

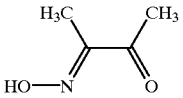

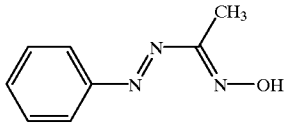

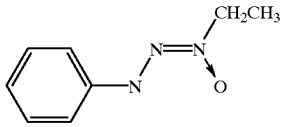

$[ML''_2]^z$

M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$ $z$ = -6 ~ +2

L =

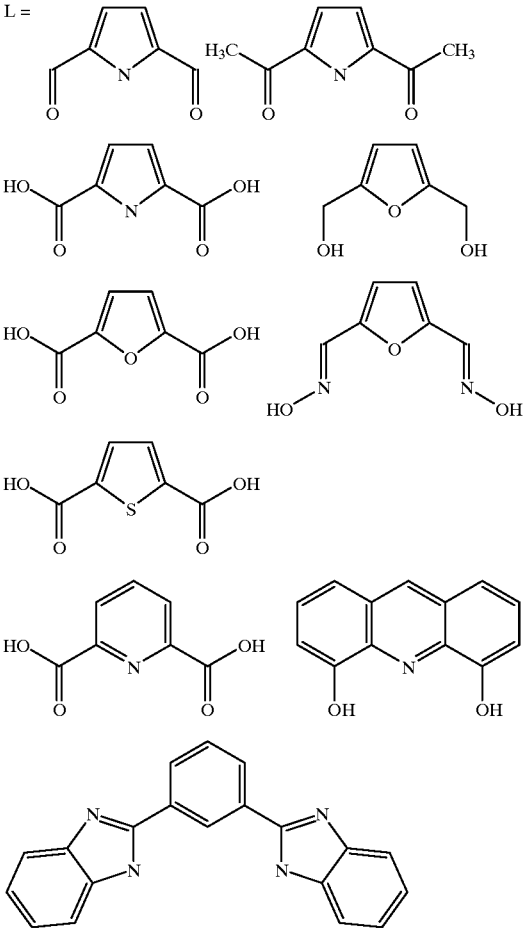

-continued

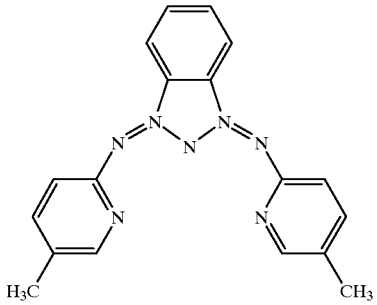

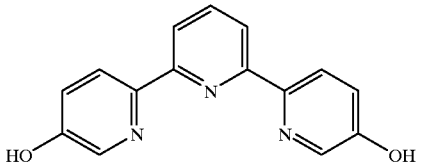

In the present invention, the ligands to be used preferably can either be in the state with $H^+$ added or deprotonated state.

Since this kind of complex molecules are completely dissociated from the paired ion in an aqueous solution so as to exist as an anion or a cation, the paired ion is not important in terms of the photographic performance. As a paired cation after the complex molecules become an anion so as to form a salt with the cation, alkaline metal ions, such as sodium ion, potassium ion, rubidium ion, and cesium ion, ammonium ion, or quaternary alkyl ammonium ion, which are easily soluble in water and suited for the precipitation operation of the silver halide emulsion, can be used preferably. As the alkyl group of the quaternary alkyl ammonium, methyl group, ethyl group, propyl group, iso-propyl group, and n-butyl group are preferable. In particular, tetramethylammonium ion, tetraethylammonium ion, tetrapropylammonium ion and tetra(n-butyl)ammonium ion, in which all the four substituents are same, are preferable. Moreover, it is also preferable to add an $H^+$ ion to a compound used as the ligand so as to be a cation as the paired cation.

When the complex molecules become a cation so as to form a salt with an anion, as the paired anion, it is preferable to use halogen ion, nitric acid ion, perchloric acid ion, tetrafluoroboric acid ion, hexafluorophosphoric acid ion, tetraphenylboric acid ion, hexafluorosilicic acid ion, and trifluoromethane sulfonic acid ion, each of which is easily soluble in water and suitable in precipitation operation of a silver halide emulsion. Since the ligand exchange reaction with a halogen ion that is used as the ligand of the complex is generated if an anion with a strong coordination, such as cyano ion, thiocyano ion, nitrous acid ion, oxalic acid ion, or the like, is used as the paired anion so that the composition and the structure of the complex according to the present invention will not be sustained probably, it is not preferable to use these anions.

Techniques of using tabular grains having a high aspect ratio which are preferably used in the present invention and the characteristics of the tabulars are disclosed, for example, in U.S. Pat. Nos. 4,433,048, 4,434,226 and 4,439,520. Moreover, techniques with respect to tabular grains having a grain thickness lower than 0.07 $\mu$m and hence super high aspect ratio are disclosed, for example, in U.S. Pat. Nos. 5,494,789, 5,503,970, 5,503,971 and 5,536,632 and European Patent Nos. 0,699,945, 0,699,950, 0,699,948, 0,699,944, 0,701,165 and 0,699,946. In order to prepare tabular grains having a low grain thickness and hence a high aspect ratio, it is important to control the concentration of a binder, temperature, pH, the type of excess halogen ion, the ion concentration of the excess halogen ion and further the supply speed of a reaction solution when the nuclei is formed. In order to grow the tabular nuclei, to be formed, selectively not in the direction of the thickness but in the direction of the periphery of the tabular, it is also important to control the addition speed of the reaction solution for the growth of a grain, as well as to select an optimum one as a binder in the course of the growth from when a grain is formed. For this, gelatins with low methionine content or gelatins whose amino groups are modified by phthalic acid, trimellitic acid or pyromellitic acid are advantageous.

As silver halide which can be used in the present invention, any one of silver iodobromide, silver chloroiodobromide, silver bromide and silver chlorobromide may be used as far as it has a phase having 10% or more of silver bromide in a grain. These compositions are selected corresponding to the characteristics which must be imparted to the light-sensitive silver halide.

In the present invention, though silver halide grains having various forms may be used, the distribution of grain size of these grains is preferably a monodispersion. Silver halide emulsions preferably used in the present invention are preferably 40% or less in terms of coefficient of variation in the distribution of grain size. The coefficient of variation is more preferably 30% or less and most preferably 20% or less.

Also, in the case where the silver halide grains have a tabular form, the coefficient of variation in grain thickness distribution is preferably small. In this case, the coefficient of variation is also preferably 40% or less. Further it is more preferably 30% or less and most preferably 20% or less.

In addition to the above contrivances regarding shape, the silver halide grains are prepared to have a variety of structures in the grains. A generally used method is one in which grains are formed to have layers different in silver halide composition. In the case of silver iodobromide grains used for photographing materials, it is preferable to provide layers different in iodine content. There are known so-called inside-high-iodine-type core/shell grains, wherein the nuclei in the form of layers high in iodine content are covered with shells low in iodine content, for the purpose of controlling developability. Reversely thereto, there are known outside-high-iodine-type core/shell grains, wherein nuclei are covered with shells high in iodine content, which are effective in increasing the stability of the shape when the thickness of tabular grains is decreased. In the present invention, an epitaxial projecting portion may be deposited onto the surface of various host grains and used.

The second embodiment of the present invention is described below, and in the following description thereof, the present invention means the above-mentioned second embodiment, unless other wise specified.

In a preferred mode of the present invention, a light-sensitive material, which comprises at least three photographic light-sensitive silver halide emulsion layers containing a blue-sensitive silver halide emulsion, a green-sensitive silver halide emulsion, a red-sensitive silver halide emulsion, a color developing agent, and a coupler and a non-light-sensitive layer formed on a support, and a processing material, which has a processing layer comprising at least a base and/or a base precursor on a support, are put together, so that the light-sensitive layer side of the light-sensitive material and the processing layer side of the processing material face each other, in the presence side of water in an amount ranging from 1/10 to the equivalent of an amount which is required for the maximum swelling of the total coating layers of these light-sensitive material and processing material except for respective backing layers, and the light-sensitive material and the processing material are heated at a temperature not below 60° C. and not above 100° C. for a period not less than 5 seconds and not more than 60 seconds. In this way, an image, based on at least three colors of non-diffusive dyes, is formed on the light-sensitive material and, based on this image information, a color image is formed on a separate recording material.

Firstly, the silver halide emulsion for use in the second embodiment of the present invention is explained below.

It is preferable that the silver halide emulsion of the present invention has a high content of tabular grains. In the present invention, a tabular grain means a tabular silver halide grain having two parallel (111) planes, which face each other, as principal faces and having an aspect ratio of 2 or more. In the present invention, although the tabular grain has one twin plane or two or more parallel twin planes, the tabular grain preferably has two parallel twin planes.

When viewed from above, the tabular grain for use in the present invention is in a triangular or hexagonal shape, or in a more round shape in which each corner of triangle or hexagon is made round off. In the case of a hexagonal shape, the sides facing each other constitute outer faces parallel to each other.

The interval between twin planes of tabular grains for use in the invention can be made 0.012 μm or less, as described in U.S. Pat. No. 5,219,720. Further, as described in JP-A-5-249585, a value obtained by (the distance between (111) principle planes)/(the interval between twin planes) can be made 15 or more. These can be selected according to the purpose.

In the emulsion of the present invention, the percentage of the projected area taken up by the tabular grains in the total projected area of all the grains is preferably 100 to 80%, more preferably 100 to 90%, and even more preferably 100 to 95%. If the percentage of the projected area taken up by the tabular grains in the total projected area of all the grains is less than 80%, the merits of the tabular grains (sensitivity/granularity ratios, enhancement of sharpness) cannot be fully utilized.

In the emulsion of the present invention, the percentage of the projected area taken up by hexagonal tabular grains, which have a ratio between neighboring sides (i.e., the ratio of the length of the longest side to the length of the shortest side) of 1.5 to 1, of the total projected area of all the grains is preferably 100 to 50%, more preferably 100 to 70%, and even more preferably 100 to 80%. Preferably, in the emulsion of the present invention, the percentage of the projected area taken up by hexagonal tabular grains, which have a ratio between neighboring sides (i.e., the ratio of the length of the longest side to the length of the shortest side) of 1.2 to 1, of the total projected area of all the grains is preferably 100 to 50%, more preferably 100 to 70%, and particularly preferably 100 to 80%. The presence of too much amount of tabular grains other than the above-mentioned hexagonal grains is not desirable from the standpoint of inter-grain uniformity.

The average grain thickness of the tabular grains for use in the present invention, is preferably 0.05 to 0.3 μm, more preferably 0.10 to 0.25 μm, and further preferably 0.10 to 0.20 μm. In this connection, the above average grain thickness means an arithmetic mean of the thickness of all tabular grains in the emulsion. It is difficult to prepare an emulsion whose average grain thickness is less than 0.5 μm. The average grain thickness more than 0.3 μm is not desirable because the advantages of tabular grains are obscured.

The average equivalent-circle diameter of the tabular grains for use in the present invention is preferably 2.0 to 4.0 μm, more preferably 2.5 to 4.0 μm, and particularly preferably 3.0 to 4.0 μm. The average equivalent-circle diameter of the tabular grains is an arithmetical mean of equivalent-circle diameters of all the tabular grains in the emulsion. The average equivalent-circle diameter less than 2.0 μm is not desirable because the effects of the invention may be obscured. On the other hand, the average equivalent-circle diameter more than 4.0 μm is not desirable because pressure resistance is degraded.

The ratio of the equivalent-circle diameter to the thickness of the silver halide grain is called the aspect ratio. That is, the aspect ratio is a value obtained by dividing the equivalent-circle diameter of the projected area of a silver halide grain by the thickness of the grain. According to a method for measuring the aspect ratio, the photographs of the grains are taken under a transmission electron microscope using a replica method and the diameter of a circle whose area is equivalent to the projected area of a grain (i.e., equivalent-circle diameter) and the thickness are sought. In this case, the thickness is calculated from the length of the shadow of the replica.

In the emulsion of the present invention, preferably, the percentage of the projected area taken up by the tabular grains having an aspect ratio of 4 to 50 of the total projected area of all the silver halide grains is 100 to 80%. More preferably, the percentage of the projected area taken up by the tabular grains having an aspect ratio of 6 to 50 of the total projected area of all the silver halide grains is 100 to 80%. Even more preferably, the percentage of the projected area taken up by the tabular grains having an aspect ratio of 8 to 50 of the total projected area of all the silver halide grains is 100 to 80%.

The average aspect ratio of the total tabular grains in the emulsion of the present invention is preferably 8 to 40, more preferably 12 to 40, and even more preferably 15 to 30. The average aspect ratio is an arithmetical mean of aspect ratios of all the tabular grains in the emulsion. An aspect ratio outside the above-mentioned ranges is not desirable because the effects of the present invention are difficult to obtain.

It is preferable that the emulsion of the present invention is made up of monodispersed grains.

The variation coefficient of the grain size (equivalent-sphere diameter) distribution of the total silver halide grains for use in the present invention is preferably 30 to 3%, more preferably 25 to 3%, and even more preferably 20 to 3%. Herein, the equivalent-sphere diameter means a diameter of a sphere whose volume is equivalent to that of an individual grain. The variation coefficient of the equivalent-sphere diameter distribution means a value obtained by dividing the deviation (standard deviation) of equivalent-sphere diameters of individual tabular grains by an average equivalent-sphere diameter. If a variation coefficient of the equivalent-sphere diameter distribution of the total tabular grains is too much, it may be adversely affect the inter-grain uniformity. On the other hand, an emulsion having a variation coefficient of the equivalent-sphere diameter distribution of less than 3% is difficult to prepare.

The variation coefficient of the equivalent-circle diameter distribution of the total tabular grains of the emulsion of the present invention is preferably 30 to 3%, more preferably 25 to 3%, and even more preferably 20 to 3%. The variation coefficient of the equivalent-circle diameter distribution means a value obtained by dividing the deviation (standard deviation) of equivalent-circle diameters of individual tabular grains by an average equivalent-circle diameter. If a variation coefficient of the equivalent-circle diameter distribution of the total tabular grains is too much, it may adversely affect the inter-grain uniformity. On the other hand, an emulsion having a variation coefficient of the equivalent-circle diameter distribution of less than 3% is difficult to prepare.

The variation coefficient of the grain thickness distribution of the total tabular grains of the emulsion of the present invention is preferably 30 to 3%, more preferably 25 to 3%, and even more preferably 20 to 3%. The variation coefficient of the grain thickness distribution means a value obtained by dividing the deviation (standard deviation) of grain thicknesses of individual tabular grains by an average the grain thickness. If a variation coefficient of the grain thickness distribution of the total tabular grains is too much, it may adversely affect the inter-grain uniformity. On the other hand, an emulsion having a variation coefficient of the grain thickness distribution of less than 3% is difficult to prepare.

In the present invention, the grain thickness, aspect ratio, and degree of monodispersity of the above ranges may be selected according to purposes, and tabular grains, which have small grain thicknesses and high aspect ratios and are monodispersed, are preferably used.

In the present invention, in order to prepare tabular grains having high aspect ratios, various methods can be used and examples of the grain forming methods that can be used are described in, for example, U.S. Pat. Nos. 5,496,694; 5,498,516, and the like. In addition, in order to prepare tabular grains having very high aspect ratios, the grain forming methods described in U.S. Pat. Nos. 5,494,789 and 5,503,970 can also be used.

In order to prepare monodispersed tabular grains having high aspect ratios, it is important to grow small twin nuclei within a short time period. For this purpose, it is desirable to perform the nucleation at a low temperature, high pBr, low pH, and in the presence of a smaller amount of gelatin within a short time period. Examples of preferred gelatin include gelatin having a low molecular weight, gelatin having a small methionine content, and gelatin whose amino group is modified with phthalic acid, trimellitic acid, pyromellitic acid, or the like.

After the nucleation, physical ripening is carried out to selectively grow nuclei of crystals having parallel twin planes by eliminating nuclei of regularly-structured crystals, nuclei of crystals having a single twin plane, and nuclei of crystals having non-parallel multiple twin planes. Further ripening of the remaining nuclei having parallel twin planes is preferable from the standpoint of upgrading the monodispersity.

Besides, carrying out the physical ripening in the presence of PAO (polyalkylene oxide), as described in, for example, U.S. Pat. Nos. 700,220 and 5,147,771, is also preferable from the standpoint of upgrading the monodispersity.

Then, additional gelatin is combined with the nucleation product obtained above and thereafter a soluble silver salt and a soluble halide are added so as to grow grains. Gelatin whose amino group is modified with phthalic acid, trimellitic acid, pyromellitic acid, or the like is preferable also as the additional gelatin.

Alternatively, it is also preferable to grow grains by supplying silver and halide through the addition of silver halide fine grains which are prepared in advance separately or concurrently in a separate reaction vessel.

At the time of grain growth, it is also important to control and optimize the temperature of the reactant solutions, pH, amount of binder, pBr, supply rates of silver and halogen ions, and others.

The silver halide emulsion grains used in the present invention are made of silver bromide, silver chlorobromide, silver iodobromide, silver chloroiodide, silver chloride, or silver chloroiodobromide, and preference is given to silver iodobromide, and silver chloroiodobromide. If the silver halide emulsion grains have a phase containing iodide or chloride, these phases can be distributed uniformly inside the grains, or they can be localized in the grains. Other silver salts, such as silver rhodanate, silver sulfide, silver selenide, silver carbonate, silver phosphate, or a silver salt of an organic acid, may be contained in the form of independent grains or as part of silver halide grains.

In the present invention, the range of silver bromide content of the grains of the emulsion is preferably 80 mol % or more and more preferably 90 mol % or more.

In the present invention, the range of silver iodide content of the grains of the emulsion is preferably 1 to 20 mol %, more preferably 2 to 15 mol %, and even more preferably 3 to 10 mol %. The too small content is not desirable because it is difficult to obtain effects such as fortification of dye adsorption, enhancement of characteristic sensitivity, and the like. On the other hand, the too large content is not desirable because the development speed is generally reduced.

The variation coefficient of inter-grain silver iodide content distribution of the grains of the emulsion in the present invention is preferably 30% or less, more preferably 25 to 3%, and even more preferably 20 to 3%. A too large variation coefficient may adversely affect the inter-grain uniformity. The variation coefficient of inter-grain silver iodide content distribution means a value obtained by dividing the standard deviation of silver iodide contents of individual emulsion grains by an average silver iodide content. The silver iodide contents of individual grains of the emulsion can be measured by analyzing the composition of each grain using an X-ray microanalyzer. The method for the measurement is described in, for example, European Patent No. 147,868. When measuring the distribution of the silver iodide contents of individual grains of the emulsion of the present invention, the number of the grains to be measured is preferably at least 100 or more, more preferably 200 or more, and particularly preferably 300 or more.

The emulsion grain of the present invention is composed mainly of {111} planes and {100} planes. The proportion of the {111} planes to the total surfaces of the emulsion grains of the present invention is preferably at least 70%.

Meanwhile, in the emulsion grains of the present invention, the portions where the {100} planes appear are the lateral faces of the tabular grains. The {100} plane proportion is generally at least 2%, preferably 4% or more, of the area made up of the {111} planes on the surface of the emulsion grains. The {100} plane proportion is preferably high and the {100} plane proportion may be selected according to purposes. The control of the {100} plane proportion can be carried out referring to JP-A-2-298935 and others. The {100} plane proportion can be obtained by a method utilizing the difference in adsorption dependence between the {111} plane and {100} plane in the adsorption of spectral sensitizing dyes, described in, for example, T. Tani, J. Imaging Sci., 29, 165 (1985).

In the emulsion grains of the present invention, the area proportion of the {100} plane on edges of the tabular grains is preferably 15% or more, more preferably 25% or more, and even preferably 35% or more. The area proportion of the {100} plane on edge portions of tabular grains can be obtained by, for example, the method described in JP-A-8-334850.

The tabular grains to be used in the present invention preferably are tabular grains having a dislocation line inside the grain. The introduction of the dislocation line into the tabular grain is explained below.

The dislocation line is a linear lattice defect present on the boundary between a slipped region and an unslipped region on crystal sliding surfaces. Descriptions of the dislocation lines of the silver halide crystals are found in, e.g., (1) C. R. Berry, J. Appl. Phys., 27, 636 (1956), (2) C. R. Berry, D. C. Skilman, J. Appl. Phys., 35, 2165 (1964), (3) J. F. Hamilton, Phot. Sci. Eng., 11, 57 (1967), (4) T. Shiozawa, J. Soc. Phot. Sci. Jap., 34, 16 (1971), and (5) T. Shiozawa, J. Soc. Phot. Sci. Jap., 35, 213 (1972). The dislocation lines can be observed directly by X-ray diffractometry or a low-temperature transmission electron microscope. When directly observing the dislocation line by a transmission electron microscope, the silver halide grains are taken out from the emulsion with care so as not to apply a pressure to cause the generation of dislocation lines in the grains. The grains are then placed on a mesh for observation under the electron microscope. Then, observation is carried out by the transmission method, while the sample grains are kept in a cooled state in order to prevent any damage (e.g., printout) from being caused by the electron beam.

In this case, the use of high-voltage (200 kV or more per 0.25 $\mu$m of thickness) provides clearer results, because transmission of the electron beams become difficult as the thickness of the grain increases.

Meanwhile, the influence of the dislocation line on photographic properties is described in G. C. Farnell, R. B. Flint, J. B. Chanter, J. Phot. Sci., 13, 25 (1965). According to this description, in large tabular silver halide grains having a high aspect ratio, a close relationship is found between the place where latent image nuclei are formed and the defect inside the grain. For example, U.S. Pat. Nos. 4,806,461; 498,516; 5,496,694; 5,476,760; and 5,567,580, and JP-A-4-149541 and JP-A-4-149737 disclose technologies for controlled introduction of dislocation lines into silver halide grains. According to these patent publications, the tabular grains having dislocation lines introduced therein are described to exhibit better photographic properties, such as sensitivity and pressure resistance, relative to the tabular grains having no dislocation lines. It is preferable to use the emulsions described in these patents, in the present invention.

In the present invention, it is preferable that the dislocation lines are introduced into the tabular grains in the following way. That is the epitaxial growth of a silver halide phase containing silver iodide on a tabular grain serving as a base (substrate, this grain is also called a host grain), followed by the introduction of dislocation lines by the formation of a silver halide shell.

In the present invention, the silver iodide content of the host grains is preferably 0 to 15 mol %, more preferably 0 to 12 mol %, and particularly preferably 0 to 10 mol %. The content may be selected according to purposes. The too large content is not desirable because development speed is generally reduced.

It is preferable that the silver iodide content of composition of the silver halide phase to be grown epitaxially on a host grain is high. Although the silver halide phase to be grown epitaxially may be any one of silver iodide, silver iodobromide, silver chloroiodobromide, and silver chloroiodide, silver iodide or silver iodobromide is preferable, and silver iodide is even preferable. If the silver halide phase is silver iodobromide, the silver iodide (iodide ion) content is preferably 1 to 45 mol %, more preferably 5 to 45 mol %, and particularly preferably 10 to 45 mol %. Although a higher silver iodide content is preferable from the standpoint of the formation of misfit necessary for the introduction of dislocation lines, 45 mol % is the limit of the solid solubility of silver iodobromide.

The amount of halogen to be added for the formation of the high silver iodide content phase to be grown epitaxially on a host grain is preferably 2 to 15 mol %, more preferably 2 to 10 mol %, and particularly preferably 2 to 5 mol %, based on the amount of silver of the host grain. Th e too small content is not desirable because the introduction of the dislocation lines is difficult. on the other hand, the too large content is not desirable because the development speed is reduced.

In this case, the proportion of the high silver iodide content phase is preferably in the range of 5 to 6 mol %, more preferably 10 to 50 mol %, and particularly preferably 20 to 40 mol %, based on the amount of silver of the total grains after grain formation. The proportion of too small or otherwise too large is not desirable because the upgrading of sensitization by the introduction of the dislocation lines is difficult.

The position where the high silver iodide content phase is formed on the host grain is not limited. Although the high silver iodide content phase may cover the host grain or may be formed on a specific portion alone, it is preferable to control the position of the dislocation line inside the grain by performing epitaxial growth on a specifically selected portion.

In the present invention, it is particularly preferable to form the high silver iodide content phase on the edges or apexes of the tabular grain. When forming the high silver iodide content phase, the composition of a halide to be added and method of adding the halide, temperatures of the reactant solutions, pAg, solvent concentration, gelatin concentration, ionic strength, and others may be freely selected. The high silver iodide content phase inside the grain can be measured by an analytical electron microscope described in, for example, JP-A-7-219102.

When the high silver iodide content phase is formed on a host grain in the present invention, preferred methods are, for example, a method in which an aqueous solution of a water-soluble iodide such as potassium iodide is added alone or together with an aqueous solution of a water-soluble silver salt such as silver nitrate, a method in which silver halide containing silver iodide is added in the form of fine particles, and a method in which iodide ions are released from an iodide ion-releasing agent by the reaction with an alkali or a nucleophile as described, for example, in U.S. Pat. Nos. 5,498,516 and 5,527, 664.

After the high silver iodide content phase is epitaxially grown on a host grain, dislocation lines are introduced by forming a silver halide shell on the exterior of the host tabular grain. Although the silver halide shell may be composed of any one of silver bromide, silver iodobromide, and silver chloroiodobromide, silver bromide or silver iodobromide is preferable.

If the silver halide shell is composed of silver iodobromide, the silver iodide content is preferably 0.1 to 12 mol %, more preferably 0.1 to 10 mol %, and most preferably 0.1 to 3 mol %.

The too small content is not desirable because it is difficult to obtain effects such as fortification of dye adsorption, acceleration of development, and the like. On the other hand, the too large content is not desirable because the development speed is reduced.

The amount of silver to be used for growing the silver halide shell is preferably 10 to 50 mol %, more preferably 20 to 40 mol %, based on the amount of silver of total grains.

The temperature in the dislocation line introducing process is preferably 30 to 80° C., more preferably 35 to 75° C., and particularly preferably 35 to 60° C. For controlling temperatures at low temperatures below 30° C. or at high temperatures above 80° C., a high-performance apparatus for production is needed and therefore these temperatures are not desirable from the standpoint of practical production. The pAg in the dislocation line introducing process is preferably 6.4 to 10.5.

In the case of a tabular grain, the position and number of the dislocation lines when viewed from a direction perpendicular to the main plane of each grain can be obtained from the photograph of the grains taken using an electron microscope as described previously. If the tabular grain for use in the present invention has a dislocation line, the position of the dislocation line may be limited to, for example, an apex and fringe of the grain, or alternatively, to the entire principal plane. However, it is preferable that the position is limited to the fringe. In the present invention, the fringe means the outer periphery of the tabular grain. More specifically, the fringe means the outside of the spot at which the silver iodide content exceeds or drops below the average silver iodide content of the whole grain for the first time when viewed from the side of a tabular grain, in the silver iodide distribution ranging from the side to the center of the tabular grain.

In the present invention, it is preferable to introduce dislocation lines at a high density into the fringe of a tabular grain. The number of dislocation lines in the fringe of the tabular grain is preferably 10 or more, more preferably 30 or more, and even more preferably 50 or more. In the case where the dislocation lines are present densely or found to be crossed with each other, the number of the dislocation lines per grain may not be clearly counted. However, even in such a case, the dislocation lines can be roughly counted in tens, twenties, or thirties.

It is desirable that the inter-grain distribution of the amounts of the dislocation lines is uniform in the tabular grains for use in the present invention. In the present invention, the proportion of the silver halide tabular grains containing 10 or more dislocation lines per grain is preferably 100 to 50%, more preferably 100 to 80%, (in number) of the total grains. The too low proportion is not desirable because high sensitivity cannot be obtained. In the present invention, the proportion of the silver halide tabular grains containing 30 or more dislocation lines per grain is preferably 100 to 50%, more preferably 100 to 80%, (in number) of the total grains.

Further, it is desirable that the intra-grain positions where the dislocation lines are introduced are uniform in the silver halide grains for use in the present invention. In the present invention, it is preferable that the proportion of the silver halide tabular grains having dislocation lines localized substantially in grain fringe alone is high from the standpoint of the uniformity of the grains. The proportion of the silver halide tabular grains having 10 or more dislocation lines substantially in grain fringe alone per grain is preferably 100 to 50%, more preferably 100 to 70%, and further preferably 100 to 80% (in number) of the total grains in the emulsion.

In the present invention, the proportion of the silver halide tabular grains having 30 or more dislocation lines substantially in grain fringe alone per grain is preferably 100 to 50%, more preferably 100 to 70%, and further preferably 100 to 80% (in number) of the total grains in the emulsion.

In the present invention, the region of fringe in an individual tabular grain is preferably 0.05 to 0.25$\mu$m and more preferably 0.10 to 0.20$\mu$m. The range outsides this range is not desirable because it is difficult to upgrade the characteristic sensitivity.

When the proportion of the grains containing the dislocation lines or the number of the dislocation is sought in the present invention, the dislocation lines are directly observed preferably with at least 100 grains, more preferably 200 or more grains, and even more preferably 300 or more grains.

In the present invention, when the silver iodide content at grain fringe or apex is observed using an analytical electron microscope according to the method described in JP-A-7-219102, the formation of a tabular grain having 2 mol % or more of silver iodide content is preferable from the standpoint of upgrading the characteristic sensitivity. The silver iodide content is more preferably 4 mol % or more and even more preferably 5 mol % or more. In the present invention, when the silver iodide content distribution inside a tabular grain is observed using the same analytical electron microscope as described above, although any grain may be selected from a grain whose silver iodide content in grain fringe or apex is higher and a grain whose silver iodide content in grain fringe or apex is lower, relative to the average silver iodide content in the grain central region, the former is preferable.

Next, a metal complex dopant to be used in the present invention is described.

The silver halide grain for use in the present invention contains one or more metal complexe(s) having, as a ligand, a heterocyclic compound in a number more than half of the coordination number of the metal atom.

The metal complex to be used in the present invention is preferably a complex having as a ligand a heterocyclic compound in a number more than half of the coordination number of the metal atom. A metal complex having a 5- or 6-membered nitrogen-containing heterocyclic compound as a ligand is particularly preferable.

When a hexacoordinate octahedral complex is incorporated as a dopant into a silver halide grain, the dopant is believed to replace part of the grain making $[AgX_6]^{5-}$ ($X^-$=a halogen ion) in the silver halide grain as a unit, as described in many of literature and patents including J. Phys.: Condens. Matter 9 (1997) 3227–3240. Accordingly, it is believed that the greater the deviation of the charge of the complex for doping from −5, the more disadvantageous the replacement becomes. In this regard, it is preferable that the ligand of the complex dopant for use in the present invention is anionic and the charge of the total complex is a minus charge. In this case, it is also preferable that the solubility of the complex ion silver salt is small from the standpoint of upgrading the doping rate.

More specifically, the ligands are preferably pyrrole, pyrazole, imidazole, triazole, and tetrazole. Derivatives of these compounds are also preferable as the ligands. Preferred examples of the substituent in the derivatives include a substituted or unsubstituted alkyl group (e.g., methyl group, ethyl group, n-propyl group, isopropyl group, n-butyl group, t-butyl group, hexyl group, octyl group, 2-ethylhexyl group, dodecyl group, hexadecyl group, t-octyl group, isodecyl group, isostearyl group, dodecyloxypropyl group, trifluoromethyl group, and methanesulfonylaminomethyl group), an alkenyl group, an alkynyl group, an aralkyl group, a cycloalkyl group (e.g., cyclohexyl group and 4-t-butylcyclohexyl group), a substituted or unsubstituted aryl group (e.g., phenyl group, p-tolyl group, p-anisyl group, p-chlorophenyl group, 4-t-butylphenyl group, and 2,4-di-t-aminophenyl group), a halogen atom (e.g., fluorine, chlorine, bromine, and iodine), a cyano group, a nitro group, a mercapto group, a hydroxyl group, an alkoxy group (e.g., methoxy group, butoxy group, methoxyethoxy group, dodecyloxy group, and 2-ethylhexyloxy group), an aryloxy group (e.g., phenoxy group, p-tolyloxy group, p-chlorophenoxy group, and 4-t-butylphenoxy group), an alkylthio group, an arylthio group, an acyloxy group, a sulfonyloxy group, a substituted or unsubstituted amino group (e.g., amino group, methylamino group, dimethylamino group, anilino group, and N-methylanilino group), an ammonio group, a carbonamide group, a sulfonamide group, an oxycarbonylamino group, an oxysulfonylamino group, a substituted ureido group (e.g., 3-methylureido group, 3-phenylureido group, and 3,3-dibutylureido group), a thioureido group, an acyl group (e.g., formyl group and acetyl group), an oxycarbonyl group, a substituted or unsubstituted carbamoly group (e.g., ethylcarbamoyl group, dibutylcarbamoyl group, dodecyloxypropylcarbamoyl group, 3-(2,4-di-t-aminophenoxy) propylcarbamoyl group, piperidinocarbonyl group, and morpholinocarbonyl group), a thiocarbonyl group, a thiocarbamoly group, a sulfonyl group, a sulfinyl group, an oxysulfonyl group, a sulfamoyl group, a sulfino group, a sulfano group, a carboxylic acid or a salt thereof, a sulfonic acid or a salt thereof, and a phosphonic acid or a salt thereof.

Although the central metal for use in the present invention is not particularly limited, the central metal is preferably a metal which can take a tetracoordinate structure around the metal or a metal which can take a hexacoordinate structure around the metal. The use of such a metal having a valency of +2 is particularly preferable. Furthermore, the use of a metal ion having a closed-shell structure is preferable. Further, the use of ions of alkaline earth metals (e.g. magnesium, calcium, strontium, barium), titanium, chromium, manganese, iron, cobalt, nickel, ruthenium, rhodium, palladium, osmium, iridium, platinum, gold, copper, zinc, cadmium or mercury, is preferable. Among these, the use of ions of alkaline earth metals, iron (II), ruthenium (II), osmium (II), zinc, cadmium, and mercury is more preferable. Among these ions, the use of ions of magnesium, iron (II), ruthenium (II), and zinc is particularly preferable.

These compounds act as temporary or permanent traps for electrons or positive holes in silver halide crystals and are believed to bring about effects such as high sensitivity, high contrast, improvement of reciprocity law characteristics, and improvement of pressure resistance.

It is preferable that the metal complex to be used in the present invention is incorporated into a silver halide grain, by adding directly to the reaction solution at the time of silver halide grain formation, or by adding to a grain forming reaction solution through the addition to an aqueous halide solution or other solution intended for silver halide grain formation. Furthermore, the metal complex may be doped into a silver halide grain by a combination of these methods.

When the metal complex for use in the present invention is doped into a silver halide grain, the metal complex may be disposed uniformly inside the grain, or the metal complex may be doped at a higher concentration in the grain surface layer, as described in JP-A-4-208936, JP-A-2-125245, and JP-A-3-188437. Further, the grain surface phase may be modified by carrying out physical ripening with doped fine particles, as described in U.S. Pat. Nos. 5,252,451 and 5,256,530. Furthermore, it is also preferable to employ a method in which the metal complex is doped into a silver halide grain by preparing fine particles doped with the metal complex and adding the particles for carrying out physical ripening. In addition, a combination of these doping methods may be used.

The doping amount of the metal complex (dopant) for use in the present invention is preferably $1\times10^{-8}$ mol to $1\times10^{-3}$ mol and more preferably $1\times10^{-7}$ mol to $1\times10^{-4}$ mol per mol of silver halide. Dopant means an impurity to be added into a silver halide crystal.

In the description hereinbelow, the present invention means to include both of the above first and second embodiments, unless otherwise specified.

Next, compounds, methods, and the like, which can be used in the first and second embodiments of the present invention are explained.

Next, a dopant to be used in combination with the metal complex dopant to be used in the first and second embodiments of the present invention described above is explained.

It is preferable to dope various multivalent metal ions such as transition metal atoms, in combination with the metal complex dopant for use in the present invention into a silver halide grain emulsion of the present invention. Although these multivalent metal ions can be introduced in the form of halides, nitrates or the like during grain formation, preferably these multivalent metal ions are introduced in the form of a metal complex (e.g., halogeno complex, amine complex, cyano complex, and nitrosyl complex) having the multivalent metal ion as the central metal.

The metal complex, preferably used in combination with the metal complex dopant in the present invention, is a complex comprising a metal ion belonging to the first, second or third transition series, and a ligand, such as a cyanide ion, capable of largely cleaving the d orbit in spectrochemical series. The coordination geometry of these complexes is a six coordinate complex, in which 6 ligands are coordinated to form an octahedron shape, and preferably the number of cyano ligand among the ligands is 4 or more.

Examples of preferred central metal include iron, cobalt, ruthenium, rhenium, osmium, and iridium.

In the case where not all of the 6 ligands of the metal ion are cyano ligands, the rest of the ligands may be selected from halide ions, such as a fluoride ion, a chloride ion, and a bromide ion; inorganic ligands, such as SCN, NCS, and $H_2O$, and organic ligands, such as pyridine, phenanthroline, imidazole and pyrazole.

Besides the above-described metal complexes, a complex composed of ruthenium, rhodium, palladium, or iridium, having halide ions or thiocyanate ions as ligands, a complex composed of ruthenium having one or more nitrosyl ligands, and a complex composed of chromium having cyanide ion ligands, may be preferably used in combination with the metal complex dopant, in the emulsion of the present invention.

It is preferable that these complexes to be used in combination, are also used according to the above-described addition methods, and the range of the addition amounts.

When the metal ion of a cyano complex is doped into an emulsion grain, gold-sensitization may be hindered by the cyanide generated by a reaction between gelatin and the cyano complex. In such a case, it is preferable to use a compound, which has a function to inhibit the reaction between gelatin and the cyano complex, together, as described in, for example, JP-A-6-308653. More specifically, the step in which the metal ion of a cyano complex is doped and other steps that follow are carried out, preferably in the presence of a metal ion such as zinc ion or the like, capable of forming a coordinate bond with gelatin.

It is also preferable to dope the silver halide grain with a divalent anion of a so-called chalcogen element, such as sulfur, selenium, tellurium, or the like, besides the metal complexes described previously. These dopants are also effective in obtaining high sensitivity and in improving exposure condition dependence.

The silver halide emulsion of the present invention and other silver halide emulsions to be used in combination therewith are described below.

As a method employed to prepare silver halide grains for use in the present invention, known method described, for example, by P. Glafkides in "Chemie et Phisique Photographique," Paul Montel, 1967; by G. F. Duffin in "Photographic Emulsion Chemistry," Focal Press, 1966; or by V. L. Zelikman et al. in "Making and Coating Photographic Emulsion," Focal Press, 1964, can be referred to. That is, any of pH regions among the acid process, the neutral process, the ammonia process, and the like can be used to prepare silver halide grains. Further, to supply a soluble silver salt solution and a soluble halogen salt solution that are reaction solutions, any of the single-jet method, the double-jet method, a combination thereof, and the like can be used. The controlled double-jet method, can also be used preferably, wherein the addition of reaction solutions are controlled, to keep the pAg in the reaction constant. A method in which the pH of the reaction liquid during the reaction is kept constant can also be used. In the step for forming grains, a method in which the solubility of the silver halide is controlled by changing the temperature, pH, or pAg of the system can be used, and a thioether, a thiourea, and a rhodanate, can be used as a silver halide solvent, examples of these are described in JP-B-47-11386 ("JP-B" means examined Japanese patent publication), and JP-A-53-144319.

Generally, the preparation of the silver halide grains for use in the present invention is carried out by feeding a solution of a water-soluble silver salt, such as silver nitrate, and a solution of a water-soluble halogen salt, such as an alkali halide, into a solution containing a water-soluble binder dissolved therein, such as gelatin, under controlled conditions. After the formation of the silver halide grains, the excess water-soluble salts are preferably removed. For example, the noodle water-washing method, in which a gelatin solution containing silver halide grains are made into a gel, and the gel is cut into a string-shape, then the water-soluble salts are washed away using a cold water, and the sedimentation method, in which inorganic salts comprising polyvalent anions (e.g. sodium sulfate), an anionic surfactant, an anionic polymer (e.g. sodium polystyrenesulfonate), or a gelatin derivative (e.g. an aliphatic-acylated gelatin, an aromatic-acylated gelatin, and an aromatic-carbamoylated gelatin) is added, to allow the gelatin to aggregate, thereby removing the excess salts, can be used. In particular, the sedimentation method is preferably used because removal of the excess salts can be carried out rapidly.

In the present invention, generally it is preferable to use a chemically sensitized silver halide emulsion, to which the chemical sensitization is performed using a known method singly or in combination. The chemical sensitization contributes to giving high sensitivity to the prepared silver halide grains, and to giving exposure condition stability and storage stability.

Preferably use is made of, as the chemical sensitization method, the chalcogen sensitization method, wherein a sulfur, selenium, or tellurium compound is used. As the sensitizer used therein, a compound is used that, when added to the silver halide emulsion, releases the above chalcogen element, to form a silver chalcogenide. The use of such sensitizers in combination is preferable to obtain high sensitivity and to keep fogging low.

The noble metal sensitization method, wherein gold, platinum, iridium, or the like is used, is also preferable.

Particularly the gold sensitization method, wherein chloroauric acid is used alone or in combination with thiocyanate ions or the like that act as ligands of gold, can give high sensitivity. The use of a combination of gold sensitization with chalcogen sensitization can give higher sensitivity.

The so-called reduction sensitization method is also preferably used, wherein a compound having a suitable reducing ability is used during the grain formation to introduce reducing silver nuclei, to obtain high sensitivity. The reduction sensitization method, wherein an alkynylamine compound having an aromatic ring is added at the time of chemical sensitization, is also preferred.

In carrying out the chemical sensitization, it is also preferable to use various compounds adsorbable to silver halide grains, to control reactivity. Particularly the method wherein sensitizing dyes, such as cyanines and melocyanines, mercapto compounds, or nitrogen-containing heterocyclic compounds, are added prior to chalcogen sensitization or gold sensitization, is particularly preferable.

The reaction conditions under which the chemical sensitization is conducted vary in accordance with the purpose: the temperature is generally 30 to 95° C., and preferably 40 to 75° C.; the pH is generally 5.0 to 11.0, and preferably 5.5 to 8.5; and the pAg is generally 6.0 to 10.5, and preferably 6.5 to 9.8.

Chemical sensitization techniques are described, for example, in JP-A-3-110555, JP-A-5-24126, JP-A-62-253159, JP-A-5-45833, and JP-A-62-40446. It is also preferable to form epitaxial protrusions during the chemical sensitization process.

In the present invention, preferably the so-called spectral sensitization, for sensitizing the light-sensitive silver halide emulsion to a desired light wavelength range, is carried out. Particularly, in a color photographic light sensitive material, for color reproduction faithful to the original, light-sensitive layers having light sensitivities to blue, green, and red are incorporated. These sensitivities are provided by spectrally sensitizing the silver halide, with a so-called spectrally sensitizing dye.

Examples of such dyes include cyanine dyes, merocyanine dyes, composite cyanin dyes, composite merocyanine dyes, halopolar dyes, hemicyanine dyes, styryl dyes, and hemioxonol dyes. These examples are described, for example, in U.S. Pat. No. 4,617,257, JP-A-59-180550, JP-A-64-13546, JP-A-5-45828, and JP-A-5-45834.

These spectral sensitizing dyes can be used singly or in combination, and a single use or a combination use of these sensitizing dyes is selected for the purpose of adjusting the wavelength distribution of the spectral sensitivity, and for the purpose of supersensitization. When using a combination of the dyes having supersensitizing effect, it is possible to attain sensitivity much larger than the sum of sensitivities which can be attained by each single dye.

Further, together with the sensitizing dye, it is also preferable to use a dye having no spectral sensitizing action itself, or a compound that does not substantially absorb visible light and that exhibits supersensitization. As an example of the supersensitizer, a diaminostilbene compound and the like can be mentioned. These examples are described, for example, in U.S. Pat. No. 3,615,641 and JP-A-63-23145.

The addition of these spectrally sensitizing dyes and supersensitizers to the silver halide emulsion may be carried out at any time during the preparation of the emulsion. Different methods, such as addition when a coating solution is prepared from the chemically sensitized emulsion, addition after the completion of the chemical sensitization, addition during the chemical sensitization, addition prior to the chemical sensitization, addition after the formation of the grains and before the desalting, addition during the formation of the grains, and addition prior to the formation of the grains, can be used alone or in combination. The addition is preferably carried out in a step before the chemical sensitization, to obtain high sensitivity.

The amount of the spectrally sensitizing dye or the supersensitizer to be added may vary depending on the shape of the grains, the size of the grains, and the desired photographic properties, and it is generally in the range of 10–8 to 10–1 mol, and preferably $10^{-5}$ to $10^{-2}$ mol, per mol of the silver halide. These compounds can be added with them dissolved in an organic solvent, such as methanol and a fluoroalcohol, or with them dispersed together with a surfactant or gelatin in water.

In the silver halide emulsion used in the present invention, various stabilizers can be incorporated for the purpose of preventing fogging, or for the purpose of improving stability at storage. As a preferable stabilizer, nitrogen-containing heterocyclic compounds, such as azaindenes, triazoles, tetrazoles, and purines; mercapto compounds, such as mercaptotetrazoles, mercaptotriazoles, mercaptoimidazoles, and mercaptothiadiazoles, can be mentioned. Details of these compounds are described, for example, by T. H. James in "The Theory of the Photographic Process," Macmillan, 1997, pages 396 to 399, and references cited therein.

In the present invention, among those antifogging agents, mercaptoazoles that have an alkyl group having 4 or more carbon atoms, or having plural aromatic groups, as substituent(s) is particularly preferably used.

The timing when the antifoggant or the stabilizer is added to the silver halide emulsion, may be at any stage in the preparation of the emulsion. The addition to the emulsion can be carried out at any time, singly or in combination, of after the completion of the chemical sensitization and during the preparation of a coating solution, at the time of the completion of the chemical sensitization, during the chemical sensitization, prior to the chemical sensitization, after the completion of the grain formation and before desalting, during the grain formation, or prior to the grain formation.

The amount of these antifogging agents or stabilizers to be added varies in accordance with the halogen composition of the silver halide emulsion and the purpose, and it is generally in the range of $10^{-6}$ to $10^{-1}$ mol, and preferably $10^{-5}$ to $10^{-2}$ mol, per mol of the silver halide.

Such additives for photography that can be used in the light-sensitive material of the present invention are described in more detail in Research Disclosures (hereinafter abbreviated to as RD) No. 17643 (December 1978), RD No. 18716 (November 1979), and RD No. 307105 (November 1989), and the particular parts are shown below.

| Kind of Additive | RD 17643 | RD 18716 | RD 307105 |
|---|---|---|---|
| Chemical sensitizers | p.23 | p.648 (right column) | p.866 |
| Sensitivity-enhancing agents | — | p.648 (right column) | — |
| Spectral sensitizers and Supersensitizers | pp.23–24 | pp.648 (right column)-649 (right column) | pp.866–868 |
| Brightening agents | p.24 | pp.648 (right column) | p.868 |
| Antifogging agents and Stabilizers | pp.24–26 | p.649 (right column) | pp.868–870 |
| Light absorbers, Filter dyes, and UV Absorbers | pp.25–26 | pp.649 (right column)-650 (left column) | p.873 |
| Dye image stabilizers | p.25 | p.650 (left column) | p.872 |

-continued

| Kind of Additive | RD 17643 | RD 18716 | RD 307105 |
|---|---|---|---|
| Hardeners | p.26 | p.651 (left column) | pp.874–875 |
| Binders | p.26 | p.651 (left column) | pp.873–874 |
| Plasticizers and Lubricants | p.27 | p.650 (right column) | p.876 |
| Coating aids and Surfactants | pp.26–27 | p.650 (right column) | pp.875–876 |
| Antistatic agents | p.27 | p.650 (right column) | pp.876–877 |
| Matting agents | — | — | pp.878–879 |

In the present invention, the light-sensitive silver halide may be used together with an organic metal salt as an oxidizing agent. Among such organic metal salts, organosilver salt is particularly preferably used.

As the organic compound that can be used to form the above organosilver salt oxidizing agent, benzotriazoles, aliphatic acids, and other compounds, as described in U.S. Pat. No. 4,500,626, columns 52 to 53, can be mentioned. Also useful is acetylene silver described in U.S. Pat. No. 4,775,613. Organosiliver salts may be used in the form of a combination of two or more.

The above organosilver salts may be used additionally in an amount of generally 0.01 to 10 mol, and preferably 0.01 to 1 mol, per mol of the light-sensitive silver halide.

As the binder of the constitutional layer of the light-sensitive material, a hydrophilic binder is preferably used. Examples thereof include those described in the above-mentioned Research Disclosures and JP-A-64-13546, pages (71) to (75). Specifically, a transparent or semitransparent hydrophilic binder is preferable, and examples include natural compounds, such as proteins including gelatin, gelatin derivatives, and the like, or polysaccharides including cellulose derivatives, starches, gum-arabic, dextrans, pullulan, and the like; and synthetic polymer compounds such as polyvinyl alcohols, modified polyvinyl alcohols (e.g. terminal-alkyl-modified POVAL MP103, MP203, and the like, trade name, manufactured by Kuraray Co., Ltd.), polyvinyl pyrrolidones, and acrylamide polymers. Further, highly water-absorptive polymers described, for example, in U.S. Pat. No. 4,960,681, and JP-A-62-245260; that is, homopolymers of vinyl monomers having —COOM or —$SO_3M$ (M represents a hydrogen atom or an alkali metal), or copolymers of these vinyl monomers, or copolymers of the vinyl monomer(s) with another vinyl monomer (e.g., those comprising sodium methacrylate or ammonium methacrylate, including Sumika Gel L-5H, trade name, manufactured by Sumitomo Chemical Co., Ltd.) can also be used. Two or more of these binders can be used in combination. Particularly, combinations of gelatin with the above binders are preferable. Further, the gelatin can be selected from lime-processed gelatin, acid-processed gelatin; so-called de-ashed gelatin from which the calcium content, etc., have been reduced, in accordance with various purposes, and combinations thereof are also preferable.

In the present invention, the amount of a binder to be applied is generally 1 to 20 g/$m^2$, preferably 2 to 15 g/$m^2$, and further preferably 3 to 12 g/$m^2$. In the binder, gelatin is used generally in the ratio of 50 to 100%, and preferably 70 to 100%.

It is preferable to incorporate a developing agent to the light-sensitive material of the present invention. The effect of the present invention can further be improved by incorporating a developing agent to the light-sensitive material of the present invention. As a developing agent to be incorporated, at least one developing agent selected from those represented by the above mentioned formulas (I) to (IV) are preferably used.

The compound represented by formula (I) is a compound so-called sulfonamidephenol.

In the formula, $R_1$ to $R_4$ each represent, a hydrogen atom, a halogen atom (e.g. chloro and bromo), an alkyl group (e.g., methyl, ethyl, isopropyl, n-butyl, and t-butyl), an aryl group (e.g., phenyl, tolyl, and xylyl), an alkylcarbonamide group (e.g., acetylamino, propionylamino, and butyroylamino), an arylcarbonamido group (e.g. benzoylamino), an alkylsulfonamido group (e.g. methanesulfonylamino and ethanesulfonylamino), an arylsulfonamido group (e.g. benzenesulfonylamino and toluenesulfonylamino), an alkoxy group (e.g. methoxy, ethoxy, and buthoxy), an aryloxy group (e.g. phenoxy), an alkylthio group (e.g. methylthio, ethylthio, and butylthio), an arylthio group (e.g. phenylthio and tolylthio), an alkylcarbamoyl group (e.g. methylcarbamoyl, dimethylcarbamoyl, ethylcarbamoyl, diethylcarbamoyl, dibutylcarbamoyl, piperidylcarbamoyl, and morpholylcarbamoyl), an arylcarbamoyl group (e.g. phenylcarbamoyl, methylphenylcarbamoyl, ethylphenylcarbamoyl, and benzylphenylcarbamoyl), a carbamoyl group, an alkylsulfamoyl group (e.g. methylsulfamoyl, dimethylsulfamoyl, ethylsulfamoyl, diethylsulfamoyl, dibutylsulfamoyl, piperidylsulfamoyl, and morpholylsulfamoyl), an arylsulfamoyl group (e.g. phenylsulfamoyl, methylphenylsulfamoyl, ethylphenylsulfamoyl, and benzylphenylsulfamoyl), a sulfamoyl group, a cyano group, an alkylsulfonyl group (e.g. methanesulfonyl and ethanesulfonyl), an arylsulfonyl group (e.g. phenylsulfonyl, 4-chlorophenylsulfonyl, and p-toluenesulfonyl), an alkoxycarbonyl group (e.g. methoxycarbonyl, ethoxycarbonyl, and butoxycarbonyl), an aryloxycarbonyl group (e.g. phenoxycarbonyl), an alkylcarbonyl group (e.g. acetyl, propionyl, and butyloyl), an arylcarbonyl group (e.g. benzoyl and alkylbenzoyl), or an acyloxy group (e.g. acetyloxy, propionyloxy, and butyloyloxy). Among $R_1$ to $R_4$, $R_2$ and/or $R_4$ is (are) preferably a hydrogen atom. Further, the total of Hammett's constant $\sigma p$ values of $R_1$ to $R_4$ is preferably 0 or more.

$R_5$ represents an alkyl group (e.g., methyl group, ethyl group, butyl group, octyl group, lauryl group, cetyl group, and stearyl group), an aryl group (e.g., phenyl group, tolyl group, xylyl group, 4-methoxyphenyl group, dodecylphenyl group, chlorophenyl group, trichlorophenyl group, nitrochlorophenyl group, triisopropylphenyl group, 4-dodecyloxyphenyl group, and 3,5-di-(methoxycarbonyl) phenyl group), or a heterocyclic group (e.g., pyridyl group).

The compound represented by formula (II) is a compound so-called carbamoylhydrazine. The compound represented by formula (IV) is a compound so-called sulfonylhydrazine.

In the formula, Z represents a group of atoms forming an aromatic ring (including a heterocycle). The aromatic group formed by Z should be sufficiently electron-attractive, to impart silver development activity to the compound. From this standpoint, a nitrogen-containing aromatic ring or an aromatic ring such as a benzene ring to which an electron-attractive group is introduced, is preferably used. Preferred examples of such aromatic rings include a pyridine ring, a pyrazine ring, a pyrimidine ring, a quinoline ring, and a quinoxaline ring.

In the case of a benzene ring, examples of its substituents include an alkylsulfonyl group (e.g., methanesulfonyl group and ethanesulfonyl group), a halogen atom (e.g., chlorine atom and bromine atom), an alkylcarbamoly group (e.g., methylcarbamoyl group, dimethylcarbamoyl group, ethylcarbamoyl group, diethylcarbamoyl group, dibutylcarbamoyl group, piperidylcarbamoyl group, and morpholinylcarbamoyl group), an arylcarbamoly group (e.g., phenylcarbamoyl group, methylphenylcarbamoyl group, ethylphenylcarbamoyl group, and benzylphenylcarbamoyl group), a carbamoyl group, an alkylsulfamoyl group (e.g., methylsulfamoyl group, dimethylsulfamoyl group, ethylsulfamoyl group, diethylsulfamoyl group, dibutylsulfamoyl group, piperidylsulfamoyl group, and morpholinylsulfamoyl group), an arylsulfamoyl group (e.g., phenylsulfamoyl group, methylphenylsulfamoyl group, ethylphenylsulfamoyl group, and benzylphenylsulfamoyl group), a sulfamoyl group, a cyano group, an alkylsulfonyl group (e.g., methanesulfonyl group and ethanesulfonyl group), an arylsulfonyl group (e.g., phenylsulfonyl group, 4-chlorophenylsulfonyl group, and p-toluenesulfonyl group), an alkoxycarbonyl group (e.g., methoxycarbonyl group, ethoxycarbonyl group, and butoxycarbonyl group), an aryloxycarbonyl group (e.g., phenoxycarbonyl group), an alkylcarbonyl group (e.g., acetyl group, propionyl group, and butyloyl group), and an arylcarbonyl group (e.g., benzoyl group and alkylbenzoyl group). The total of Hammett's constant σ values of the above-mentioned substituents is preferably 1 or greater.

The compound represented by formula (III) is a compound so-called carbamoylhydrazone.

In the formula, $R_6$ represents a substituted or unsubstituted alkyl group (e.g., methyl group and ethyl group). X represents an oxygen atom, a sulfur atom, a selenium atom, or an alkyl- or aryl-substituted tertiary nitrogen atom, and X is preferably an alkyl-substituted tertiary nitrogen atom. $R_7$ and $R_8$ each represent a hydrogen atom or a substituent, and $R_7$ and $R_8$ may bond together to form a double bond or a ring (e.g. a substituted or unsubstituted benzene ring, and the like).

Specific examples of the compounds represented by formulas (I) to (IV) are shown below, which of course are not meant to limit the present invention.

D-1

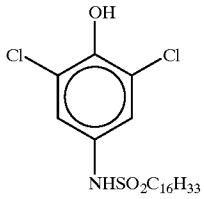

D-2

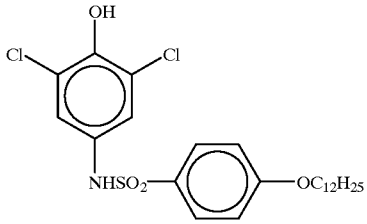

D-3

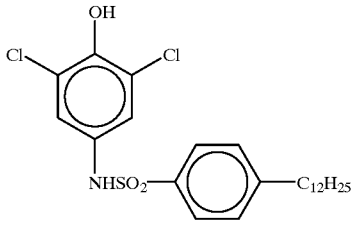

-continued

D-4

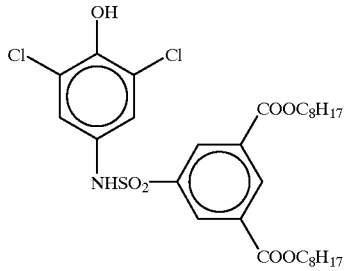

D-5

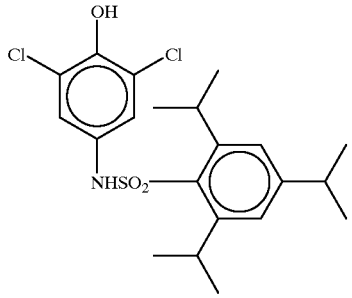

D-6

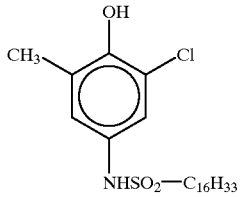

D-7

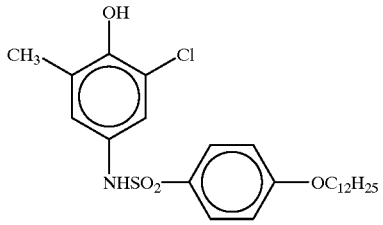

D-8

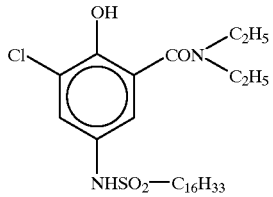

D-9

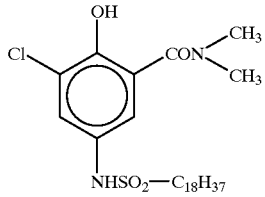

-continued
D-10
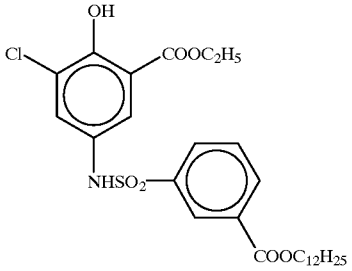
D-11
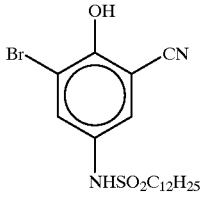
D-12
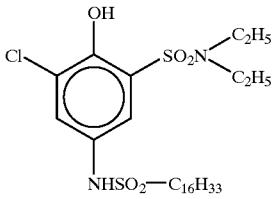
D-13
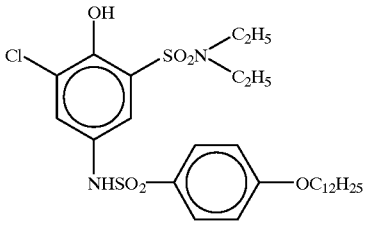
D-14
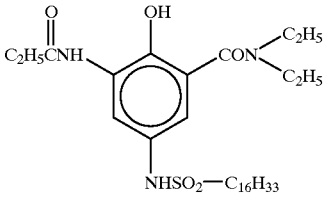
D-15
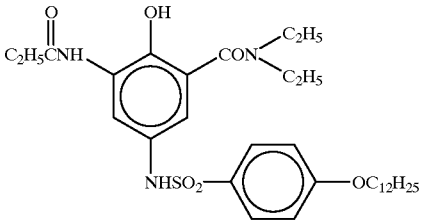
-continued
D-16
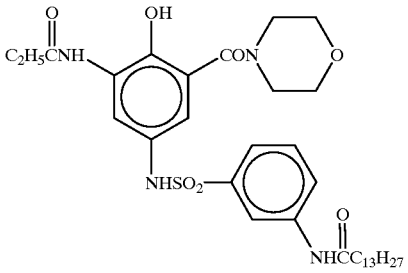
D-17
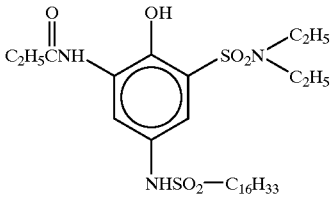
D-18
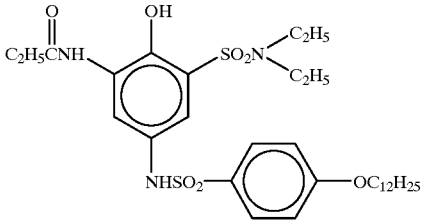
D-19
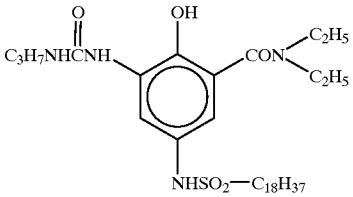
D-20
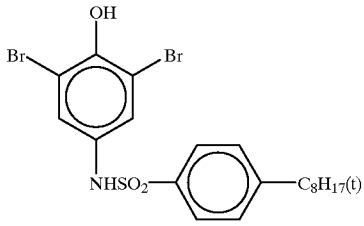
D-21
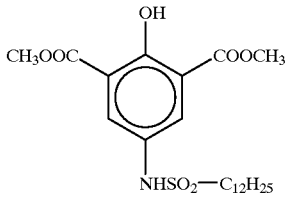

-continued
D-22
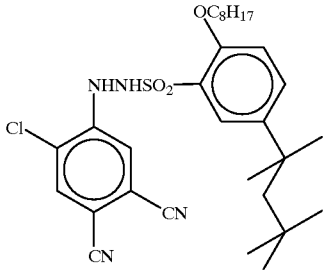
D-23
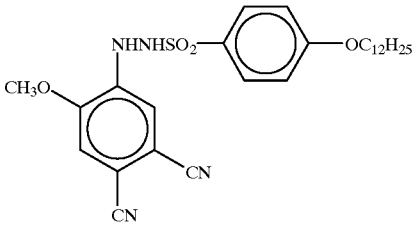
D-24
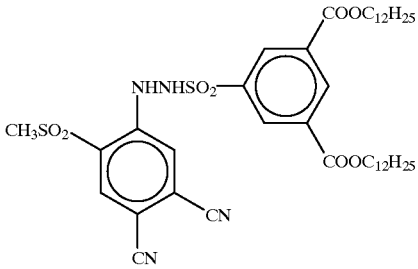
D-25
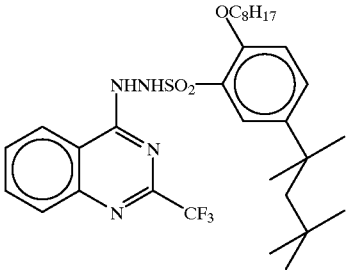
D-26
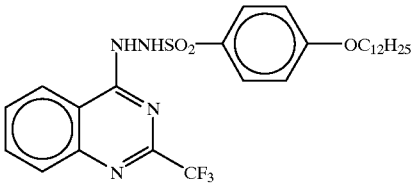
D-27
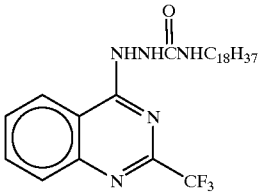
-continued
D-28
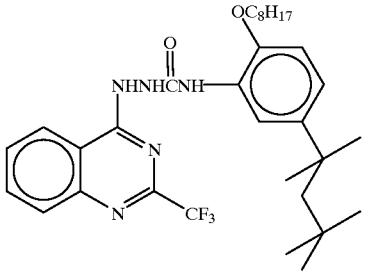
D-29
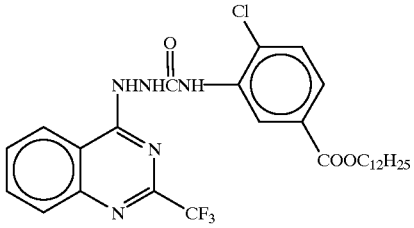
D-30
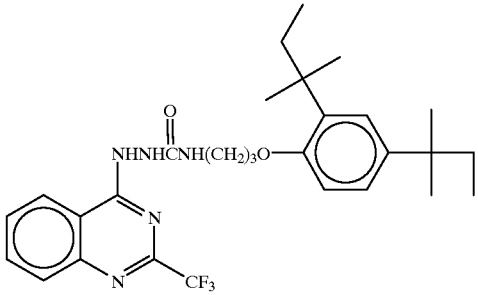
D-31
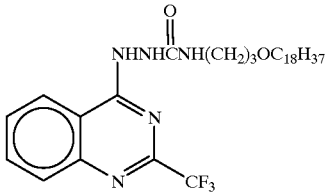
D-32
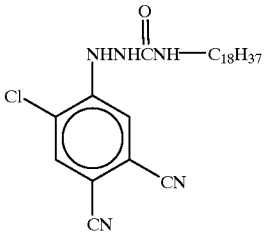
D-33
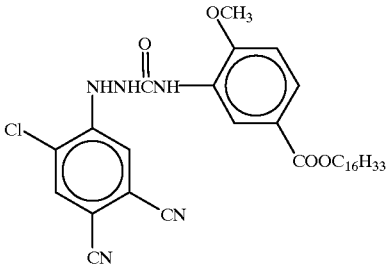

-continued
D-34
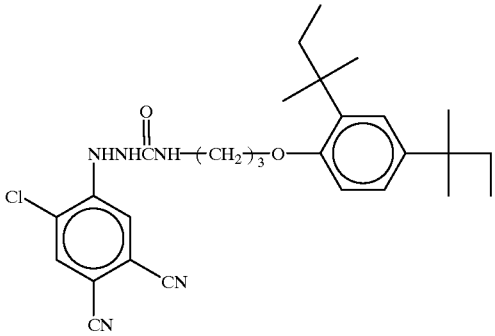
D-35
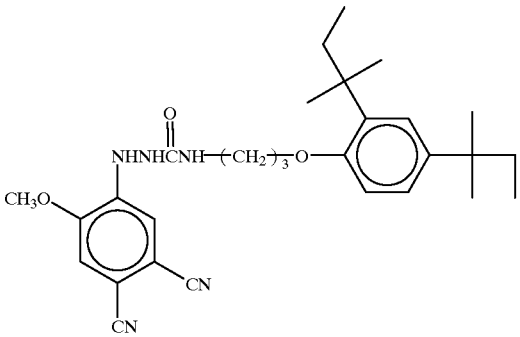
D-36
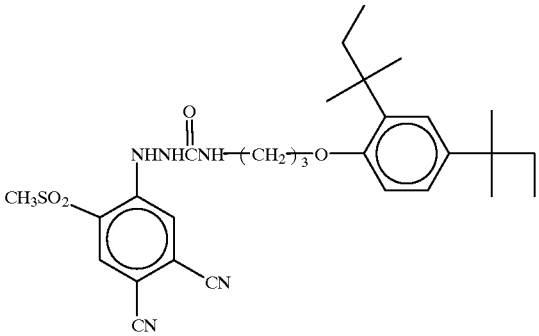
D-37
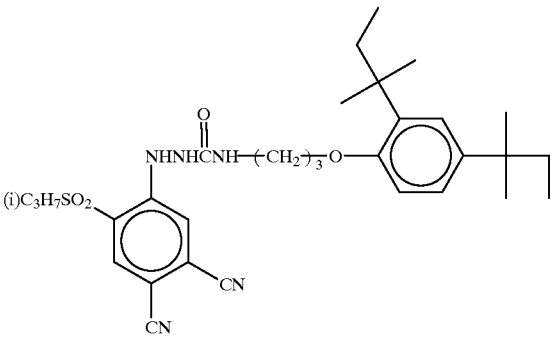
-continued
D-38
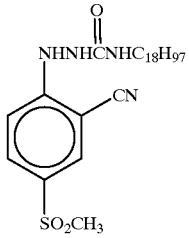
D-39
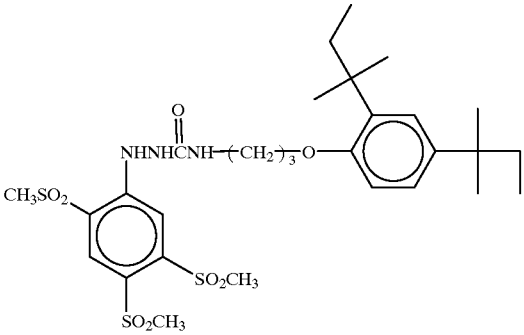
D-40
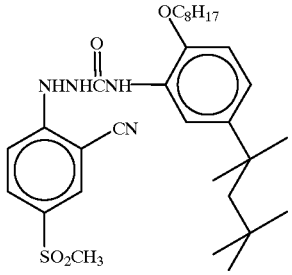
D-41
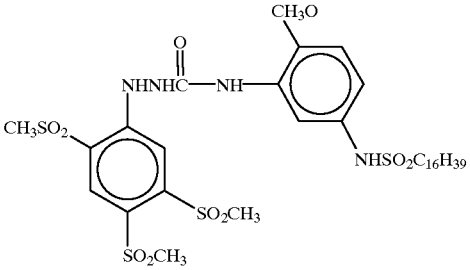
D-42
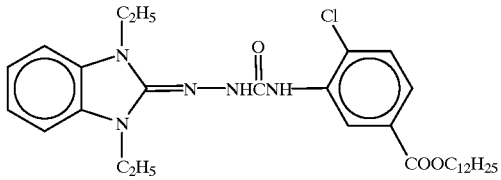
D-43
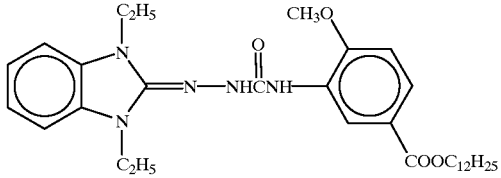

-continued
D-44
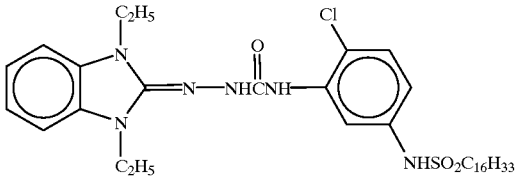
D-45
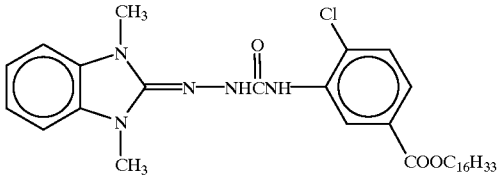
D-46
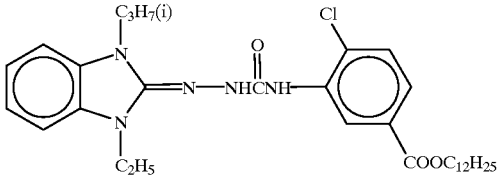
D-47
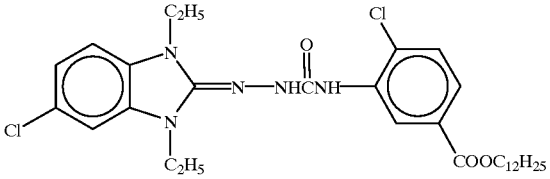
D-48
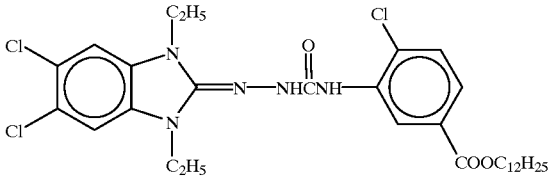
D-49
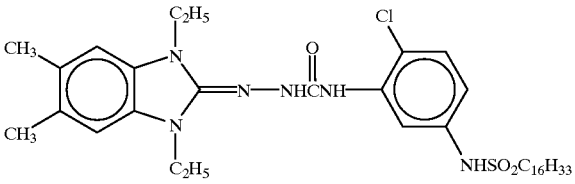
D-50
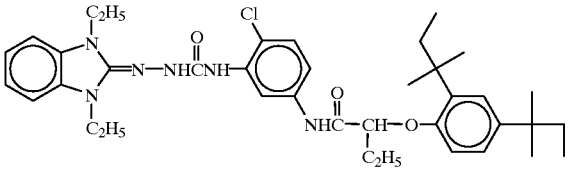
-continued
D-51
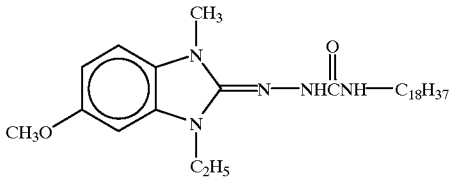
D-52
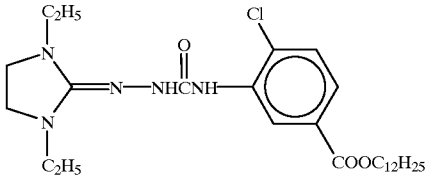
D-53
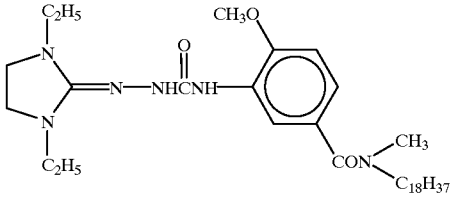
D-54
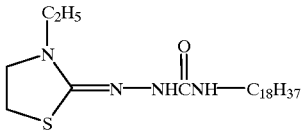
D-55
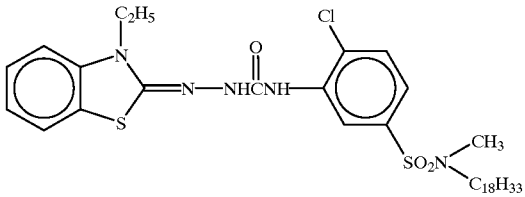
D-56
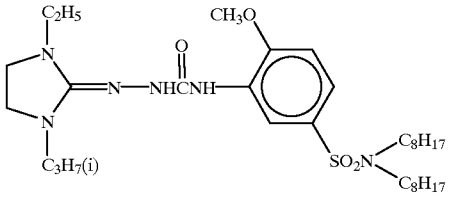
D-57
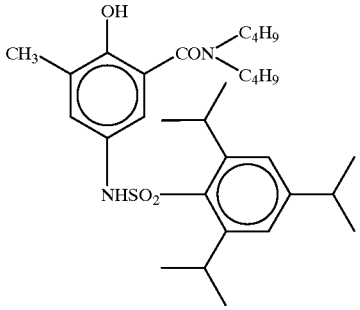

-continued

D-58

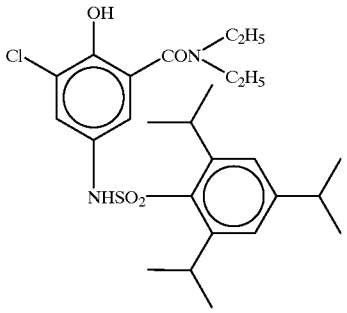

D-59

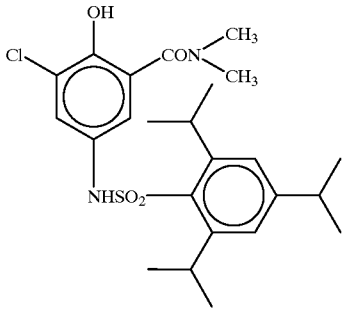

D-60

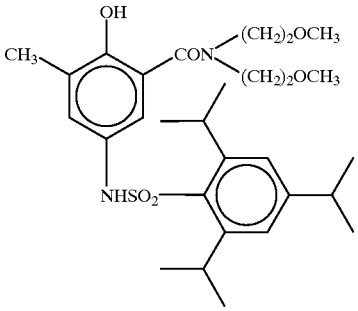

D-61

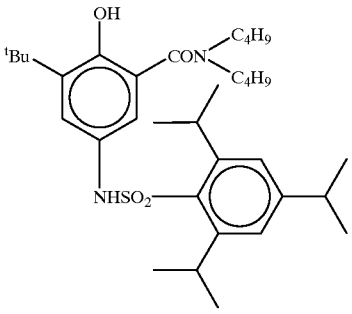

D-62

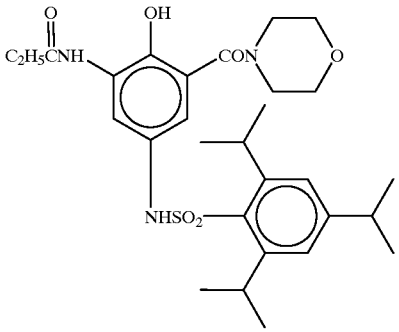

-continued

D-63

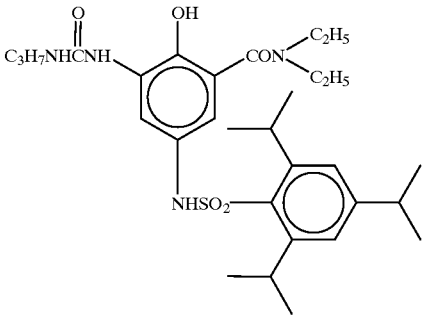

D-64

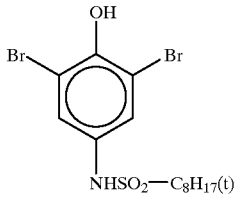

D-65

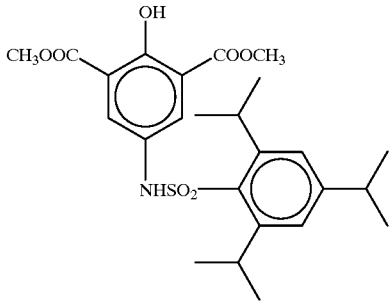

As a color developing agent(s), the above compound can be used singly or in a combination of two or more. The developing agent can be differed in each layer. The total amount of those developing agents to be used is generally 0.05 to 20 mmol/$m^2$ and preferably 0.1 to 10 mmol/$m^2$.

In the color photographic light-sensitive material of the present invention, known compounds can be used as a color image-forming agent, and a coupler can be mentioned as a representative example of such known compounds. The coupler, which can be used in the present invention, means a compound that forms a dye by a coupling reaction with the oxidization product of a color developing agent.

In the present invention, preferable couplers include compounds that are collectively referred to as active methylenes, 5-pyrazolones, pyrazoloazoles, phenols, naphthols, and pyrrolotriazoles. For example, compounds referred to in Research Disclosure (hereinafter abbreviated to as RD) No. 38957 (September 1996), pages 616 to 624, "x. Dye image formers and modifiers" can be used preferably.

These couplers can be classified into so-called two-equivalent couplers and four-equivalent couplers. As groups that serve as anionic releasing groups of two-equivalent couplers, can be mentioned, for example, a halogen atom (e.g. chlorine and bromine), an alkoxy group (e.g., methoxy and ethoxy), an aryloxy group (e.g., phenoxy, 4-cyanophenoxy, and 4-alkoxycarbonylphenyl), an alkylthio group (e.g., methylthio, ethylthio, and butylthio), an arylthio group (e.g., phenylthio and tolylthio), an alkylcarbamoyl group (e.g., methylcarbamoyl, dimethylcarbamoyl, ethylcarbamoyl, diethylcarbamoyl, dibutylcarbamoyl, piperidylcarbamoyl, and morpholylcarbamoyl), an arylcarbamoyl group (e.g., phenylcarbamoyl, methylphenylcarbamoyl, ethylphenylcarbamoyl, and benzylphenylcarbamoyl), a carbamoyl group, an alkylsulfamoyl group (e.g., methylsulfamoyl, dimethylsulfamoyl, ethylsulfamoyl, diethylsulfamoyl, dibutylsufamoyl, piperidylsulfamoyl, and morpholylsulfamoyl), an arylsulfamoyl group (e.g., phenylsulfamoyl, methylphenylsulfamoyl, ethylphenylsulfamoyl, and benzylphenylsulfamoyl), a sulfamoyl group, a cyano group, an alkylsulfonyl group (e.g., methanesulfonyl and ethanesulfonyl), an arylsufonyl group (e.g., phenylsulfonyl, 4-chlorophenylsulfonyl, and p-toluenesulfonyl), an alkylcarbonyloxy group (e.g. acetyloxy, propionyloxy, and butyloyloxy), an arylcarbonyloxy group (e.g., benzoyloxy, toluyloxy, and anisyloxy), and a nitrogen-containing heterocyclic group (e.g., imidazolyl and benzotriazolyl).

Further, as groups that serve as cationic releasing groups of four-equivalent couplers, can be mentioned, for example, a hydrogen atom, a formyl group, a carbamoyl group, a substituted methylene group (the substituent of which includes, for example, an aryl group, a sulfamoyl group, a carbamoyl group, an alkoxy group, an amino group, and a hydroxyl group), an acyl group, and a sulfonyl group.

In addition to the compounds described in the above RD No. 38957, couplers described below can be preferably used.

As active-methylene-series couplers, use can be made of couplers represented by formula (I) or (II) of EP-A-502,424; couplers represented by formula (1) or (2) of EP-A-513,496; couplers represented by formula (I) in claim 1 of EP-A-568,037A; couplers represented by formula (I) of U.S. Pat. No. 5,066,576, column 1, lines 45 to 55; couplers represented by formula (I) of JP-A-4-274425, paragraph number 0008; couplers described in claim 1 of EP-A-498,381(A1), page 40; couplers represented by formula (Y) of EP-A-447,969 (A1), page 4; and couplers represented by any of formulae (II) to (IV) of U.S. Pat. No. 4 476 219, column 7, lines 36 to 58.

As 5-pyrazorone-series magenta couplers, compounds described in JP-A-57-35858 and JP-A-51-20826 are preferable.

Preferable pyrazoloazole-series couplers are imidazo[1,2-b] pyrazoles described in U.S. Pat. No. 4,500,630, pyrazolo [1,5-b][1,2,4] triazoles described in U.S. Pat. No. 4,540,654, and pyrazolo[5,1-c][1,2,4] triazoles described in U.S. Pat. No. A-3,725,067. Among these couplers, pyrazolo[1,5-b][1,2,4] triazoles are preferable in view of light fastness.

Preferable examples of the phenol-series couplers include 2-alkylamino-5-alkylphenol couplers described, for example, in U.S. Pat. Nos. 2,369,929, 2,801,171, 2,772,162, 2,895,826, and 3,772,002; 2,5-diacylaminophenol couplers described, for example, in U.S. Pat. Nos. 2,772,162, 3,758,308, 4,126,396, 4,334,011, and 4,327,173, West Germany Patent Publication No. 3,329,729, and JP-A-59-166956; and 2-phenylureido-5-acylaminophenol couplers described, for example, in U.S. Pat. Nos. 3,446,622, 4,333,999, 4,451,559, and 4,427,767.

Preferable examples of the naphthol-series couplers include 2-carbamoyl-1-naphthol couplers described, for example, in U.S. Pat. Nos. 2,474,293, 4,052,212, 4,146,396, 4,228,233, and 4,296,200; and 2-carbamoyl-5-amido-1-naphthol couplers described, for example, in U.S. Pat. No. 4,690,889.

Preferable examples of the pyrrolotriazole-series couplers include those described in European Patent Nos. 488,248A1, 491,197A1, and 545,300.

Further, a fused-ring phenol, imidazole, pyrrole, 3-hydroxypyridine, active methine, 5,5-ring-fused heterocyclic, and 5,6-ring-fused heterocyclic coupler, can be used.

As the fused-ring phenol-series couplers, those described, for example, in U.S. Pat. Nos. 4,327,173, 4,564,586, and 4,904,575, can be used.

As the imidazole-series couplers, those described, for example, in U.S. Pat. Nos. 4,818,672 and 5,051,347, can be used.

As the pyrrole-series couplers, those described, for example, in JP-A-4-188137 and JP-A-4-190347 can be used.

As the 3-hydroxypyridine-series couplers, those described, for example, in JP-A-1-315736, can be used.

As the active methine-series couplers, those described, for example, in U.S. Pat. Nos. 5,104,783 and 5,162,196, can be used.

As the 5,5-ring-fused heterocyclic couplers, for example, pyrrolopyrazole couplers described in U.S. Pat. No. 5,164,289, and pyrroloimidazole couplers described in JP-A-4-174429, can be used.

As the 5,6-ring-fused heterocyclic couplers, for example, pyrazolopyrimidine couplers described in U.S. Pat. No. 4,950,585, pyrrolotriazine couplers described in JP-A-4-204730, and couplers described in European Patent No. 556,700, can be used.

In the present invention, in addition to the above couplers, use can be made of couplers described, for example, in West Germany Patent Nos. 3,819,051A and 3,823,049, U.S. Pat. Nos. 4,840,883, 5,024,930, 5,051,347, and 4,481,268, European Patent Nos. 304,856A2, 329,036, 354,549A2, 374,781A2, 379,110A2, and 386,930A1, and JP-A Nos. 63-141055, 64-32260, 64-32261, 2-297547, 2-44340, 2-110555, 3-7938, 3-160440, 3-172839, 4-172447, 4-179949, 4-182645, 4-184437, 4-188138, 4-188139, 4-194847, 4-204532, 4-204731, and 4-204732.

The amount of these couplers to be used is generally 0.05 to 10 mmol/$m^2$, and preferably 0.1 to 5 mmol/$m^2$.

Further, functional couplers as shown below may be included.

As couplers whose color-formed dyes have suitable diffusibility, those described in U.S. Pat. No. 4,366,237, GB 2 125 570, EP-B-96,873, and DE 3,234,533 are preferable.

Couplers for correcting undesired absorption of color-formed dyes are preferably, yellow-colored cyan couplers described in EP-A-456,257(A1); yellow-colored magenta couplers described in EP-A-456,257(A1); magenta-colored cyan couplers described in U.S. Pat. No. 4 833 069; (2) of U.S. Pat. No. 4 837 136; and colorless masking couplers represented by formula (A) in claim 1 of WO 92/11575 (particularly, exemplified compounds on pages 36 to 45).

As a compound (including a coupler) that reacts with the oxidized product of a developing agent to release a residue of a photographically useful compound, the following can be listed:

Development-inhibitor-releasing compounds: compounds represented by formula (I), (II), (III), or (IV) described in EP-A-378,236(Al), page 11; compounds represented by formula (I) described in EP-A-436,938(A2), page 7, compounds represented by formula (1) described in EP-A-568,037, and compounds represented by formula (I), (II), or (III) described in EP-A-440,195(A2), pages 5 to 6;

Bleaching-accelerator-releasing compounds: compounds represented by formula (I) or (I') described in page 5 of EP-A-310,125(A2), and compounds represented by formula (I) in claim 1 of JP-A-6-59411;

Ligand-releasing compounds: compounds represented by LIG-X recited in claim 1 in U.S. Pat. No. 4,555,478;

Leuco-dye-releasing compounds: compounds 1 to 6 in columns 3 to 8 in U.S. Pat. No. 4,749,641;

Fluorescent-dye-releasing compounds: compounds represented by COUP-DYE in claim 1 in U.S. Pat. No. 4,774,181;

Development-accelerator- or fogging-agent-releasing compounds: compounds represented by formula (1), (2), or (3) in column 3 of U.S. Pat. No. 4,656,123, and ExZK-2 in EP-A-450, 637(A2), page 75, lines 36 to 38; and Compounds that do not release groups capable of forming dyes until they are split off: compounds represented by formula (I) of claim 1 of U.S. Pat. No. 4,857,447; compound represented by formula (I) in JP-A-5-307248; compounds represented by formula (I), (II), or (III) described in EP-A-440,195(A2), pages 5 to 6; compounds represented by formula (I) in claim 1 of JP-A-6-59411; ligand-releasing compounds: compounds represented by LIG-X recited in claim 1 in U.S. Pat. No. 4,555,478.

Such functional couplers may be used in an amount of generally 0.05 to 10 times, and preferably 0.1 to 5 times, per mol of the above mentioned couplers that contribute to color formation.

The hydrophobic additives, such as a coupler and a color developing agent, can be introduced into layers of a light-sensitive material by a known method, such as the one described in U.S. Pat. No. 2,322,027. In this case, use is made of a high-boiling organic solvent as described, for example, in U.S. Pat. Nos. 4,555,470, 4,536,466, 4,536,467, 4,587,206, 4,555,476, and 4,599,296, and JP-B-3-62256 ("JP-B" means examined Japanese patent publication), if necessary, in combination with a low-boiling organic solvent having a boiling point of 50 to 160° C. Simultaneous use of two or more kinds of these dye-providing couplers and high-boiling oils is possible.

The high-boiling organic solvent is used in an amount of generally 10 g or less, preferably 5 g or less, and more preferably 1 to 0.1 g per g of the hydrophobic additives to be used. The amount is also preferably 1 ml or less, more preferably 0.5 ml or less, and particularly preferably 0.3 ml or less, per g of the binder.

A dispersion method that uses a polymer, as described in JP-B-51-39853 and JP-A-51-59943, and a method wherein the addition is made with them in the form of a dispersion of fine particles, as described, for example, in JP-A-62-30242 can also be used.

If the hydrophobic additives are compounds substantially insoluble in water, besides the above methods, a method can be used wherein the compounds may be made into fine particles to be dispersed and contained in a binder.

In dispersing the hydrophobic compound in a hydrophilic colloid, various surface-active agents can be used. Examples of the surface-active agents that can be used include those described in JP-A-59-157636, pages (37) to (38), and in the RD publication shown above. Further, phosphate-series surface-active agents described in Japanese Patent Applications No. 5-204325, No. 6-19247, and West Germany Patent Publication No. 1,932,299 A, can be used.

To the light-sensitive material of the present invention, it is necessary to provide at least three photosensitive layers photosensitive to respectively different spectral regions. A typical example is a silver halide photographic light-sensitive material having on a support at least three photosensitive layers, each of which comprises a plurality of silver halide emulsion layers whose color sensitivities are substantially identical but whose sensitivities are different. The photosensitive layer is a unit photosensitive layer having color sensitivity to any of blue light, green light, and red light, and in a multilayer silver halide color photographic light-sensitive material, the arrangement of the unit photosensitive layers is generally such that a red-sensitive layer, a green-sensitive layer, and a blue-sensitive layer in the order stated from the support side are placed. However, the above order may be reversed according to the purpose, and such an order is possible that layers having the same color sensitivity have a layer different in color sensitivity therefrom between them. Nonphotosensitive layers may be placed between, on top of, or under the above-mentioned silver halide photosensitive layers. These layer may contain, for example, the above-described couplers, developing agents, DIR compounds, color-mixing inhibitor, and dyes. Each of the silver halide emulsion layers constituting unit photosensitive layers respectively can preferably take a two-layer constitution comprising a high-sensitive emulsion layer and a low-sensitive emulsion layer, as described in DE 1 121 470 or GB-923 045. Generally, they are preferably arranged such that the sensitivities are decreased toward the support. As described, for example, in JP-A-57-112751, JP-A-62-200350, JP-A-62-206541, and JP-A-62-206543, a low-sensitive emulsion layer may be placed away from the support, and a high-sensitive emulsion layer may be placed nearer to the support.

A specific example of the order includes an order of a low-sensitive blue-sensitive layer (BL)/high-sensitive blue-sensitive layer (BH)/high-sensitive green-sensitive layer (GH)/low-sensitive green-sensitive layer (GL)/high-sensitive red-sensitive layer (RH)/low-sensitive red-sensitive layer (RL), or an order of BH/BL/GL/GH/RH/RL, or an order of BH/BL/GH/GL/RL/RH stated from the side away from the support.

As described in JP-B-55-34932, an order of a blue-sensitive layer/GH/RH/GL/RL stated from the side away from the support is also possible. Further as described in JP-A-56-25738 and 62-63936, an order of a blue-sensitive layer/GL/RL/GH/RH stated from the side away from the support is also possible.

Further as described in JP-B-49-15495, an arrangement is possible wherein the upper layer is a silver halide emulsion layer highest in sensitivity, the intermediate layer is a silver halide emulsion layer lower in sensitivity than that of the upper layer, the lower layer is a silver halide emulsion layer further lower in sensitivity than that of the intermediate layer, so that the three layers different in sensitivity may be arranged with the sensitivities successively lowered toward the support. Even in such a constitution comprising three layers different in sensitivity, an order of a medium-sensitive emulsion layer/high-sensitive emulsion layer/low-sensitive emulsion layer stated from the side away from the support may be taken in layers identical in color sensitivity as described in JP-A-59-202464.

Further, for example, an order of a high-sensitive emulsion layer/low-sensitive emulsion layer/medium-sensitive emulsion layer, or an order of a low-sensitive emulsion layer/medium-sensitive emulsion layer/high-sensitive emulsion layer can be taken. In the case of four layers or more layers, the arrangement can be varied as above.

In the present invention, it is preferable to contain at least two types of silver halide emulsions that have sensitivity at the same wavelength region but that are different from each other in average projected area of grains. The term "has light-sensitivity at the same wavelength region" expressed in the present invention means that the silver halide emulsions have photographic sensitivity at the substantially same wavelength region. Accordingly, even emulsions that slightly differ in the distribution of spectral sensitivity are deemed to be emulsions having sensitivity in the same wavelength region, as long as their primary sensitive regions overlap each other.

In the above case, preferably the difference of the values of the average projected area of grains between the emulsions is at least 1.25 times. The difference is more preferably 1.4 times or more, and most preferably 1.6 times or more. When the emulsions to be used are three or more types, preferably the aforementioned relation is fulfilled between an emulsion having the smallest average projected area of grains and an emulsion having the largest average projected area of grains.

In order to contain such plural emulsions that have light-sensitivity in the same wavelength region and differ from each other in the average grain-projected area, either each emulsion can be coated to form a separate light-sensitive layer, respectively, or the above plural emulsions may be mixed and contained in one light-sensitive layer.

When these emulsions are contained in separate respective layers it is preferable to arrange an emulsion having a large average grain-projected area on a upper layer (at the position close to the direction of incident light).

When these emulsions are contained in separate respective light-sensitive layers, as a color coupler to be used in combination, those having the same hue are preferably used. However, a coupler that develops a different hue may be mixed, to make the developed color hue of every light-sensitive layer different, or a coupler having a different absorption profile of a developed color hue may be used in each light-sensitive layer.

In the present invention, when these emulsions having light-sensitivity in the same wavelength region are applied, it is preferable to have constitution, wherein the ratio of the number of silver halide grains of an emulsion per unit area of a light-sensitive material is larger than the ratio of the value calculated by dividing the coated amount of silver of the emulsion, by the three-second (3/2) power of the average grain-projected area of the silver halide grains contained in the emulsion, and larger the average projected area of grains an emulsion has, larger the difference of the two ratios becomes. With such a constitution, an image having better granulation can be obtained, even in such a developing condition as heating to high temperatures. Also, high developing ability and wide exposure latitude can be satisfied at the same time.

The total coating amount of silver in the light-sensitive material, which is defined to obtain the effect of the present invention, is the total amount of silver (in terms of metal silver) utilized, in addition to silver halide contained in these silver halide emulsions, for example, in nonphotosensitive silver halide emulsion contained in light-sensitive layers and non-light-sensitive layers, and organometal salts additionally used as an oxidizing agent, and further, colloidal silver used in an antihalation layer or a yellow filter layer.

In the conventional color negative films for photographing, in order to attain a target granularity, a technology, for example, one using a so-called DIR coupler, which releases a development-inhibiting compound, at the time of coupling reaction with an oxidized product of a developing agent, has been employed, in addition to the improvement of the silver halide emulsion. In the present light-sensitive material, excellent granularity is obtained without the use of a DIR coupler. If a DIR compound is also used in combination, the granularity becomes even better.

In order to improve color reproduction, as described in U.S. Pat. Nos. 4,663,271; 4,705,744; and 4,704,436, and JP-A-62-160448 and JP-A-63-89850, it is preferable to form a donor layer (CL), which has a spectral sensitivity distribution different from those of a principal light-sensitive layer, such as BL, GL and RL, and which has an inter-layer effect, in a position adjacent or in close proximity to the principal light-sensitive layer.

In the present invention, although a silver halide, a dye-providing coupler, and a color developing agent may be contained in a same layer, these substances may be contained in different layers if these substances are present in a reactive state. For example, if the layer containing a color developing agent and the layer containing a silver halide are different, the raw stock storability of light-sensitive materials is improved.

In the present invention, color reproduction according to a subtractive color process can be basically used for the preparation of a light-sensitive material to be used for recording an original scene and reproducing the original scene as a color image. That is, the color information of the original scene can be recorded by providing at least three light-sensitive layers, each having sensitivity to the blue, green, and red wavelength region of light, respectively, and by incorporating, respectively, a color coupler capable of producing a yellow, magenta, or cyan dye as a complementary color to the sensitive wavelength region of the sensitive layer. Through the thus obtained color image, color photographic paper, which has a relationship between sensitive wavelength and developed color hue identical to that of the light-sensitive material, is exposed to light to thereby reproduce the original scene. Alternatively, it is also possible to read out by means of a scanner the information of the color dye image obtained by taking a photograph of an original scene, and to reproduce an image for enjoyment based on the information read out.

The light-sensitive material of the present invention can comprise light-sensitive layers sensitive to three kinds or more wavelength regions.

In addition, the relationship between the sensitive wavelength region and developed color hue may be different from the complementary color relationship described above. In this case, it is possible to reproduce the original color information by conducting image processing, e.g., color hue conversion, after the image information is read out as described above.

Although the relationship between the spectral sensitivity and the hue of the coupler is arbitrary in each layer, direct projection exposure onto conventional color paper is possible if a cyan coupler is used in the red-sensitive layer, a magenta coupler is used in the green-sensitive layer, and a yellow coupler is used in the blue-sensitive layer.

In the light-sensitive material, various non-light-sensitive layers can be provided, such as a protective layer, an underlayer, an intermediate layer, a yellow filter layer, and an antihalation layer, between the above silver halide emulsion layers, or as an uppermost layer or a lowermost layer; and on the opposite side of the photographic support, various auxiliary layers can be provided, such as a backing layer. Specifically, for example, layer constitutions as described in the above-mentioned patents, undercoat layers as described in U.S. Pat. No. 5,051,335, intermediate layers containing a solid pigment, as described in JP-A-1-167,838 and JP-A-61-20,943, intermediate layers containing a reducing agent or a DIR compound, as described in JP-A-1-120,553, JP-A-5-34,884, and JP-A-2-64,634, intermediate layers containing an electron transfer agent, as described in U.S. Pat. Nos. 5,017,454 and 5,139,919, and JP-A-2-235,044, protective layers containing a reducing agent, as described in JP-A-4-249,245, or combinations of these layers, can be provided.

In the present invention, the dye, which can be used in a yellow filter layer, a magenta filter layer, or in an antihalation layer, is preferably a dye whose component is transferred from the light-sensitive material to a processing material at the time of development or reacts to be converted into a colorless compound at the time of development, so that the amount of the dye remaining after the developing process is less than one third, preferably less than one tenth, of the amount of the dye present immediately before the coating, thus making no contribution to the photographic density after the process.

Specifically, dyes described in European Patent Application EP No. 549,489A, and dyes ExF 2 to 6 described in JP-A-7-152129, can be mentioned. A solid-dispersed dye as described in JP-A-8-101487 can also be used.

The dye may also be mordanted with a mordant and a binder. In this case, as the mordant and the dye, those known in the field of photography can be used, and examples include mordants described, for example, in U.S. Pat. No. 4,500,626, columns 58 to 59, and JP-A-61-88256, pages 32 to 41, JP-A-62-244043, and JP-A-62-244036.

Further, a reducing agent and a compound that can react with the reducing agent to release a diffusible dye can be used to cause a movable dye to be released with an alkali at the time of development, to be dissolved into the processing solution or to be transferred to the processing sheet, to thereby be removed. Specifically, examples are described in U.S. Pat. No. 4,559,290 and 4,783,396, European Patent No. 220,746 A2, and Kokai-Giho No. 87-6119, as well as JP-A-8-101487, section Nos. 0080 to 0081.

Leuco dyes or the like that lose their color can be used, and specifically, a silver halide light-sensitive material containing a leuco dye that has been color-formed previously with a developer of an organic acid metal salt, is disclosed in JP-A-1-150132.

As the base (support) of the light-sensitive material in the present invention, those that are transparent and can withstand the processing temperature, are used. Generally, photographic bases, such as papers and synthetic polymers (films) described in "Shashin Kogaku no Kiso—Ginen Shashin-hen—," edited by Nihon Shashin-gakkai and published by Korona-sha, 1979, pages (223) to (240), can be mentioned. Specifically, use is made of polyethylene terephthalates, polyethylene naphthalates, polycarbonates, polyvinyl chlorides, polystyrenes, polypropylenes, polyimides, celluloses (e.g., triacetylcellulose, and the like.

Among the supports, a polyester composed mainly of polyethylene naphthalate is particularly preferable. The term "a polyester composed mainly of polyethylene naphthalate" as used herein means a polyester whose naphthalenedicarboxylic acid content in total dicarboxylic acid residues is preferably 50 mol % or more, more preferably 60 mol % or more, and even more preferably 70 mol % or more. This may be a copolymer or a polymer blend.

In the case of a copolymer, a copolymer, which has a unit, such as terephthalic acid, bisphenol A, cyclohexanedimethanol or the like, copolymerized therein, besides naphthalenedicarboxylic acid units and ethylene glycol units, is also preferable. Among these copolymers, a copolymer, in which terephthalic acid units are copolymerized, is most preferable from the standpoint of mechanical strength and costs.

Preferred examples of the counterpart for forming the polymer blend are polyesters, such as polyethylene terephthalate (PET), polyarylate (PAr), polycarbonate (PC), and polycyclohexanedimethanolterephthalate (PCT), from the standpoint of compatibility. Among these polymer blends, a polymer blend with PET is preferable, from the standpoint of mechanical strength and costs.

Particularly when heat resistance and curling properties are severely demanded, bases that are described as bases for light-sensitive materials in JP-A-6-41281, 6-43581, 6-51426, 6-51437, and 6-51442, Japanese Patent Application Nos. 4-251845, 4-231825, 4-253545, 4-258828, 4-240122, 4-221538, 5-21625, 5-15926, 4-331928, 5-199704, 6-13455, and 6-14666, can be preferably used.

Further, a base of a styrene-series polymer having mainly a syndiotactic structure can be preferably used. The thickness of the base is preferably 5 to 200 $\mu$m, more preferably 40 to 120 $\mu$m.

These supports may be subjected to a surface treatment, in order to achieve strong adhesion between the support and a photographic constituting layer. For the above-mentioned surface treatment, various surface-activation treatments can be used, such as a chemical treatment, a mechanical treatment, a corona discharge treatment, a flame treatment, an ultraviolet ray treatment, a high-frequency treatment, a glow discharge treatment, an active plasma treatment, a laser treatment, a mixed acid treatment, and an ozone oxidation treatment. Among the surface treatments, an ultraviolet irradiation treatment, a flame treatment, a corona treatment, and a grow treatment are preferable.

Next, with respect to the undercoating technique, a single layer or two or more layers may be used. As the binder for the undercoat layer, for example, copolymers produced by using, as a starting material, a monomer selected from among vinyl chloride, vinylidene chloride, butadiene, methacrylic acid, acrylic acid, itaconic acid, maleic anhydride, and the like, as well as polyethylene imines, epoxy resins, grafted gelatins, nitrocelluloses, gelatin, polyvinyl alcohol, and modified polymer thereof can be mentioned. As compounds that can swell the base, resorcin and p-chlorophenol can be mentioned. As gelatin hardening agents in the undercoat layer, chrome salts (e.g. chrome alum), aldehydes (e.g. formaldehyde and glutaraldehyde), isocyanates, active halogen compounds (e.g. 2,4-dichloro-6-hydroxy-s-triazine), epichlorohydrin resins, active vinyl sulfone compounds, and the like can be mentioned. $SiO_2$, $TiO_2$, inorganic fine particles, or polymethyl methacrylate copolymer fine particles (0.01 to 10 $\mu$m) may be included as a matting agent.

As for the color hue of the dye to be used for dyeing films, dyeing in gray is preferable in view of general characteristics of light-sensitive materials. A dye, which has excellent resistance to heat within the film forming temperature range, and excellent compatibility with polyester, is preferable. In this regard, the purpose can be achieved by blending dyes, such as Diaresin (trade name) manufactured by Mitsubishi Chemicals Industries Ltd. or Kayaset (trade name) manufactured by Nippon Kayaku Co., Ltd., which are commercially available as dyes for polyesters. From the standpoint of heat resistance in particular, an anthraquinone-series dye can be mentioned. For example, the dye described in JP-A-8-122970 is preferable for use.

Further, as the base, bases having a magnetic recording layer, as described in JP-A-4-124645, 5-40321, and 6-35092, and JP-A-6-317875, can be used to record photographing information or the like.

The magnetic recording layer refers to a layer formed by coating a base with an aqueous or organic solvent coating solution containing magnetic particles dispersed in a binder.

To prepare the magnetic particles, use can be made of a ferromagnetic iron oxide, such as $\gamma Fe_2O_3$, Co-coated $\gamma Fe_2O_3$, Co-coated magnetite, Co-containing magnetite, ferromagnetic chromium dioxide, a ferromagnetic metal, a ferromagnetic alloy, hexagonal Ba ferrite, Sr ferrite, Pb ferrite, and Ca ferrite. A Co-coated ferromagnetic iron oxide, such as Co-coated $\gamma Fe_2O_3$, is preferable. The shape may be any of a needle shape, a rice grain shape, a spherical shape, a cubic shape, a plate-like shape, and the like. The specific surface area is preferably 20 $m^2/g$ or more, and particularly preferably 30 $m^2/g$ or more, in terms of $S_{BET}$. The saturation magnetization (σs) of the ferromagnetic material is preferably $3.0\times10^4$ to $3.0\times10^5$ A/m, and particularly preferably $4.0\times10^4$ to $2.5\times10^5$ A/m. The ferromagnetic particles may be surface-treated with silica and/or alumina or an organic material. The surface of the magnetic particles may be treated with a silane coupling agent or a titanium coupling agent, as described in JP-A-6-161032. Further, magnetic particles whose surface is coated with an inorganic or an organic material, as described in JP-A-4-259911 and 5-81652, can be used.

Next, the polyester base is explained. The polyester base is heat-treated at a heat treatment temperature of generally 40° C. or over, but less than the Tg, and preferably at a heat treatment temperature of the Tg −20° C. or more, but less than the Tg, so that it will hardly have core set curl. The heat treatment may be carried out at a constant temperature in the above temperature range, or it may be carried out with cooling. The heat treatment time is generally 0.1 hours or more, but 1,500 hours or less, and preferably 0.5 hours or more, but 200 hours or less. The heat treatment of the base may be carried out with the base rolled, or it may be carried out with it being conveyed in the form of web. The surface of the base may be made rough (unevenness, for example, by applying electroconductive inorganic fine particles, such as $SnO_2$ and $Sb_2O_5$), so that the surface state may be improved. Further, it is desirable to provide, for example, a rollette (knurling) at the both ends for the width of the base (both right and left ends towards the direction of rolling) to increase the thickness only at the ends, so that a trouble of deformation of the base will be prevented. These heat treatments may be carried out at any stage after the production of the base film, after the surface treatment, after the coating of a backing layer (e.g. with an antistatic agent and a slipping agent), and after coating of an undercoat, with preference given to after coating of an antistatic agent.

Into the polyester may be blended (kneaded) an ultraviolet absorber. Further, prevention of light piping can be attained by blending dyes or pigments commercially available for polyesters, such as Diaresin (trade name, manufactured by Mitsubishi Chemical Industries Ltd.), and Kayaset (trade name, manufactured by Nippon Kayaku Co., Ltd.).

Now, film patrones, into which the light-sensitive material can be housed, are described. The major material of the patrone to be used in the present invention may be metal or synthetic plastic.

Further, the patrone may be one in which a spool is rotated to deliver a film. Also the structure may be such that the forward end of film is housed in the patrone body, and by rotating a spool shaft in the delivering direction, the forward end of the film is delivered out from a port of the patrone. These patrones are disclosed in U.S. Pat. No. 4,834,306, and U.S. Pat. No. 5,226,613.

The light-sensitive material as shown above is also useful for a film unit with a lens, as described in, for example, JP-B-2-32615 and JU-B-3-39784 (the term "JU-B" used herein means an "examined Japanese utility model publication).

The film unit with a lens is one obtained by pre-loading, in a light-proofing manner, an unexposed color or monochrome photographic light-sensitive material, in a production process of a unit main body having, for example, an injection-molded plastic body, equipped with a photographing lens and shutter. The unit after photographing by a user, is transported as such to a developing laboratory for development. In the laboratory, the photographed film is taken out of this unit, and development processing and photographic printing are carried out.

In the present invention, a processing material preferably contains at least a base and/or a base precursor in a layer of the processing material.

As the base, an inorganic or organic base can be used. Examples of the inorganic base include the hydroxide, the phosphate, the carbonate, the borate, and an organic acid salt of an alkali metal or an alkali earth metal described in JP-A-62-209448, and the acetylide of an alkali metal or an alkali earth metal described, for example, in JP-A-63-25208.

Further, examples of the organic base include ammonia, aliphatic or aromatic amines (e.g. primary amines, secondary amines, tertiary amines, polyamines, hydroxylamines, and heterocyclic amines), amidines; bis-,tris-, or tetra-amidines; guanidines; water-insoluble mono-, bis-, tris-, or tetra-guanidines; and quaternary ammonium hydroxides.

Examples of the base precursors that can be used include those of the decarboxylation type, the decomposition type, the reaction type, the complex salt formation type, and the like. In the present invention, as is described in EP-A-210,660 and U.S. Pat. No. 4,740,445, a method is effectively employed wherein a base is produced by means of a combination of a basic metal compound that is hardly soluble in water, as a base precursor, with a compound (referred to as a complex-forming compound) capable of a complex-forming reaction with the metal ion constituting that basic metal compound, using water as a medium. In this case, although it is desirable to add the basic metal compound that is hardly soluble in water to the light-sensitive material, and to add the complex-forming compound to the processing material, the procedure may be reversed.

The amount to be added of the base or the base precursor is generally 0.1 to 20 $g/m^2$, and preferably 1 to 10 $g/m^2$.

The same hydrophilic polymer as the one for use in the light-sensitive material may be used as the binder in a processing layer.

It is preferable that the processing material is hardened by the same hardener as the one for use in the light-sensitive material.

The processing material may contain a mordant for the purpose of removing by transfer the dyes used in the yellow filter layer or antihalation layer of the light-sensitive material, as described previously, or for other purposes. A polymeric mordant is preferable as the mordant. Examples of the polymeric mordant include a polymer containing a secondary or tertiary amino group, a polymer having a nitrogen-containing heterocyclic moiety, a polymer containing a quaternary cationic group made from such amino group or nitrogen-containing heterocyclic moiety, and the like. The molecular weight of the polymeric mordant is generally 5,000 to 200,000 and particularly 10,000 to 50,000.

The amount to be added of the mordant is 0.1 to 10 $g/m^2$ and preferably 0.5 to 5 $g/m^2$.

In the present invention, the processing material may contain a development-stopping agent or a precursor of the development-stopping agent, so that the development-stopping agent functions simultaneously with the development or after a certain delay from the start of the development.

The development-stopping agent as written here refers to a compound that stops the development by rapidly neutralizing or reacting with the base, to decrease the base concentration in the layer, or a compound that inhibits the development by interacting with silver or a silver salt, after a proper stage of development is achieved. Specific examples include an acid precursor that releases an acid upon heating, an electrophilic compound that causes a substitution reaction with a base coexisting in the layer upon heating, and a nitrogen-containing heterocyclic compound, a mercapto compound, or a precursor thereof. Details of development-stopping agents are described in JP-A-62-190529, pp.(31)–(32).

Further, the processing material may contain a printout preventing agent for a silver halide, so that the printout preventing agent functions simultaneously with the development. Examples of the printout preventing agent include halogen compounds described in JP-B-54-164, JP-A-53-46020, JP-A-48-45228, and JP-B-57-8454, 1-phenyl-5-mercaptotetrazoles described in U. K. Patent No.1,005,144, and viologen compounds described in JP-A-8-184936.

The amount of the printout preventing agent to be used is $10^{-4}$ to 1 mol, preferably $10^{-3}$ to $10^{-2}$ mol, per mol of Ag.

Meanwhile, the processing material may contain physical development nuclei and a silver halide solvent, so that the silver halide in the light-sensitive material is solubilized and fixed to the processing layer simultaneously with the development.

A reducing agent necessary for the physical development may be any of the reducing agents known in the field of light-sensitive materials. Further, a reducing agent precursor, which itself has no reducing capability, but is given a reducing capability by a nucleophilic reagent or heat in the developing process, can also be used. The developing agent, which is not consumed in the development and diffuses from the light-sensitive material, can be used as a reducing agent, or otherwise a reducing agent may be incorporated in the processing material in advance. In the latter case, the reducing agent incorporated in the processing material may be the same as or different from the reducing agent incorporated in the light-sensitive material.

In the case where a diffusive developing agent is used, an electron transferring agent and/or a precursor of an electron transferring agent may be used in combination with the diffusive developing agent, if necessary. The electron transferring agent or a precursor thereof may be selected from the reducing agents or precursors thereof enumerated previously.

If the reducing agent is added to the processing material, the amount of the reducing agent to be added is generally 0.01 to 10 g/m$^2$, and preferably 0.1 to 5 times the moles of silver in the light-sensitive material.

Examples of the physical development nuclei include any known colloidal particles of a heavy metal, such as zinc, mercury, lead, cadmium, iron, chromium, nickel, tin, cobalt, copper, or ruthenium, a noble metal, such as palladium, platinum, gold, or silver, and a compound of any of these heavy metals and noble metals with chalcogen such as sulfur, selenium or tellurium.

The particle diameters of these physical development nuclei are preferably 2 to 200 nm.

The physical development nuclei are present in an amount ranging normally from $10^{-3}$ mg to 10 g/m$^2$ in the processing layer.

The silver halide solvent may be a known compound, preferred examples of which include thiosulfates, sulfites, thiocyanates, thioether compounds described in JP-B-47-11386, a compound having a 5- or 6-membered imido ring, such as urasil and hydantoin, described in JP-A-8-179459, a compound having a sulfur-carbon double bond described in JP-A-53-144319, and a mesoion thiolate compound such as trimethyltriazolium thiolate described in "Analytica Chemica Acta", vol. 248, pp.604 to 614 (1991). A compound described in JP-A-8-69097, which is capable of fixing a silver halide to stabilize it, can also be used as a silver halide solvent. It is also preferable to use a combination of a plurality of the above-described silver halide solvents.

The total amount of the silver halide solvent in the processing layer is generally 0.01 to 100 mmol/m$^2$, and preferably 0.1 to 50 mmol/m$^2$. This amount ranges from generally 1/20 to 20 times, preferably from 1/10 to 10 times, and more preferably from 1/4 to 4 times the molar amount of coated silver in a light-sensitive material.

A processing material may comprise auxiliary layers such as a protective layer, a subbing layer, a back layer, and the like.

The processing material is preferably composed of a continuous web and a processing layer coated thereon. The continuous web here refers to a mode, in which a processing material has a length sufficiently longer than the longer side of the light-sensitive material to be dealt with, and a plurality of light-sensitive materials can be processed without cutting a part of the processing material. Generally, the continuous web means that the processing material has a length 5 to 10,000 times greater than the width. Although the width of the processing material is not limited, it is preferably larger than the width of the light-sensitive material to be dealt with.

A mode, in which a plurality of light-sensitive materials are processed side by side, that is, a plurality of light-sensitive materials are arranged in rows and processed, is also preferable. In this case, the width of the processing material is preferably equal to or larger than the width of the light-sensitive material multiplied by the number of simultaneous processes.

In a process utilizing such a continuous web, the web is preferably fed from a feeding roll and wound on a windup roll so that the web can be disposed. Particularly, this disposal is easier when the processing material has a large size.

As explained above, the handling of the processing material in the form of a continuous web is much easier in comparison with the handling of a conventional processing material in the form of a sheet.

The thickness of the support for the processing material is not limited, but a smaller thickness is preferable, and particularly preferably the thickness is 4 $\mu$m or more but 120 $\mu$m or less. The thickness of the support of a processing material to be used is preferably 100 $\mu$m or less, more preferably 60 $\mu$m or less, and particularly preferably 4 $\mu$m or less. This is because the amount of the processing material per unit volume increases, and therefore the roll for the processing material can be rendered compact.

The material for the support is not particularly limited, but it must withstand the processing temperature. Generally, photographic bases, such as papers and synthetic polymers (films) described in "Shashin Kogaku no Kiso—Ginen Shashin-hen—," edited by Nihon Shashin-gakkai and published by Korona-sha, 1979, pages (223) to (240), can be mentioned.

The material for a support may be used singly, or may be used in the form of a base, one or both of whose surfaces are coated or laminated with a synthetic polymer, such as polyethylenes.

In addition to the above, bases described, for example, in JP-A-62-253159, pages (29) to (31), JP-A-1-161236, pages (14) to (17), JP-A-63-316848, JP-A-2-22651, JP-A-3-56955, and U.S. Pat. No. 5,001,033 can be used.

Further, a base of a styrene-series polymer having mainly a syndiotactic structure can be preferably used.

The backing surface of these bases may be coated with a hydrophilic binder plus a semiconductive metal oxide, such as tin oxide and alumina sol, carbon black, and another antistatic agent. A base to which aluminum is deposited may be preferably used as well.

In a preferable example of the present invention, a method for subjecting to development a light-sensitive material that has been used for photographing by means of a camera is used, wherein the light-sensitive material and the processing material are put together with the light-sensitive layer and the processing layer facing each other, in the presence of water in an amount of 0.1 to 1 times the amount required for the maximum swelling of all the coating films of the light-sensitive material and the processing material, except the backing layers, and they are heated at a temperature of 60 to 100° C. for 5 to 60 sec.

Herein water may be any water generally used. Specifically, distilled water, deionized water, tap water, well water, mineral water, and the like can be used. These waters may be used preferably by adding a small amount of an antiseptic agent, to prevent scale formation, decay, or the like, or by filtering them through an activated-carbon filter, an ion-exchange resin filter, or the like, to be circulated.

In the present invention, the light-sensitive material and/or the processing material, which are swollen with water, are put together face to face and thereafter heated. Since the conditions in the swollen layers are unstable, it is important to limit the amount of water to the above-mentioned range in order to prevent localized unevenness in color development.

The amount of water which is required for the maximum swelling can be obtained by a procedure comprising the steps of immersing a light-sensitive or processing material having a coating layer for the measuring of swell, measuring the layer thickness, and calculating the weight of the maximum swell, when the layer is found to be sufficiently swollen, and subtracting the weight of the original coated layer from the weight of the maximum swell. An example for measuring the degree of swell is described in "Photographic Science Engineering", vol. 16. pp. 449 (1972), too.

Water can be supplied to the light-sensitive material, to the processing material, or to both of them. The amount of the water to be used ranges from 1/10 to 1 time the amount which is required for the maximum swelling of the total coating layers of the light-sensitive material and processing material, excepting respective back layers.

As to the timing to supply water, the water may be supplied at any point after exposure and before heat development of the light-sensitive material. Preferably, the water is supplied immediately before the heat development.

The amount of water specified above in the present invention defines the amount of water required at the time when heat development is carried out by putting the light-sensitive material and the processing material together. Therefore, the scope of the present invention includes a method, in which water in an amount exceeding the amount specified in the present invention is supplied either to the light-sensitive material or to the processing material, and thereafter the excess water is removed by means of squeezing or the like, before these materials are put together so that heat development is carried out.

Normally, a required amount of water is supplied to the light-sensitive material or processing material, or to both of them, or otherwise the amount of water is adjusted to a required amount by means described above, and thereafter the light-sensitive material and the processing material are put together face to face so that heat development is carried out. Alternatively, the light-sensitive material and the processing material are put together face to face, and thereafter water is supplied to the gap between these two materials so that a required amount of water is present.

Various methods can be used for supplying water. Examples of the methods for supplying water include a method in which a light-sensitive material or processing material is immersed in water and thereafter the excess water is removed by means of a squeezing roller. However, a method, in which a predetermined amount of water is supplied to the light-sensitive material or processing material by one-step coating, is preferable. A particularly preferred method is the employment of a water spraying apparatus, which is similar to a recording head in an ink jet method, comprising a plurality of nozzles, which eject water and are arranged at certain intervals in a line or in a plurality of lines, in the direction perpendicular to the direction of the transfer of the light-sensitive material or processing material, and also comprising actuators which displace the nozzles in the direction of the light-sensitive material or processing material being transferred. Further, a method in which water is coated with a sponge or the like onto the light-sensitive material or processing material is also preferable, because the apparatus in this case is simple.

The suitable temperature of the water to be applied is generally 30 to 60° C.

As the method of placing the light-sensitive material and the processing material together, methods described in JP-A-62-253,159 and 61-147,244, can be applied.

Example heating methods in the development step include a method wherein the photographic material is brought in contact with a heated block or plate; a method wherein the photographic material is brought in contact with a hot plate, a hot presser, a hot roller, a hot drum, a halogen lamp heater, an infrared lamp heater, or a far-infrared lamp heater; and a method wherein the photographic material is passed through a high-temperature atmosphere.

To process the photographic element of the present invention, any of various heat development apparatuses can be used. For example, apparatuses described, for example, in JP-A-59-75247, JP-A-59-177547, JP-A-59-181353, and JP-A-60-18951, JU-A-62-25944 ("JU-A" means unexamined published Japanese utility model application), Japanese Patent Application Nos. 4-277,517, 4-243,072, 4-244,693, 6-164,421, and 6-164,422 can be preferably used.

As a commercially available apparatus, for example, PICTROSTAT 100, PICTROSTAT 200, PICTROSTAT 300, PICTROSTAT 330, PICTROSTAT 50, PICTROGRAPHY 3000, and PICTROGRAPHY 2000 (all trade names, manufactured by Fuji Photo Film Co., Ltd.), can be used.

The light-sensitive material and/or the processing element for use in the present invention may be in the form that has an electroconductive heat-generating material layer as a heating means for heat development. In this case, as the heat-generating element, one described, for example, in JP-A-61-145544 can be employed.

In the present invention, although the image information can be read out without removing the silver produced by development and undeveloped silver halide from the light-sensitive material, the image information can also be read out after removing the silver and undeveloped silver halide. In the latter case, a means, by which the silver and undeveloped silver halide are removed concurrently with or after the development, can be employed.

In order to remove the developed silver from the light-sensitive material concurrently with the development, or in order to complex or solubilize the silver halide, the processing material may contain a silver oxidizing or re-halogenating agent, which serves as a bleaching agent, or a silver halide solvent, which serves as a fixing agent, so that these reactions occur at the time of the heat development.

Further, after the developing process for image formation, a second processing material, which contains a silver oxidizing agent, a re-halogenating agent, or a silver halide solvent, and the light-sensitive material may be put together face to face in order that the removal of the developed silver or the complexing or solubilizing of the silver halide be carried out.

In the present invention, in so far as the above-mentioned process does not provide adverse effects on the reading out of image information after photographing and image forming development that follows, it is preferable that the light-sensitive material is subjected to the above-mentioned process. In particular, since undeveloped silver halide causes significant haze in a gelatin layer to an extent that the background density of images increases, it is preferable to diminish the haze by use of the above-mentioned complexing agent or to solubilize the silver halide so that all or part of the silver halide is removed from the layer.

The silver halide photographic emulsion of the first embodiment of the present invention, though it is highly sensitive, produces high contrast and imparts sufficient granulation. Therefore, the light-sensitive material of the first embodiment of the present invention, that uses the above mentioned silver halide photographic emulsion is a high quality photographic light-sensitive material by making use of its characteristics, and the material is suitable to use in a simple color image formation.

Further, according to the silver halide photographic emulsion of the second embodiment of the present invention, excellent photographic characteristics exhibiting little change of gradation upon exposure to high-intensity illumination, can be obtained despite high sensitivity of the emulsion. Therefore, the color photographic light-sensitive material using the silver halide photographic emulsion enables the realization of color image formation that is rapid and simple and places little load on the environment.

EXAMPLES

The present invention is further explained in detail with reference to the following examples, but the invention is not limited thereto.

Example 1

0.74 g of gelatin, having an average molecular weight of 15,000, and 930 ml of distilled water containing 0.7 g of potassium bromide, were placed in a reaction vessel, and the temperature was elevated to 40° C. 30 ml of an aqueous solution containing 0.34 g of silver nitrate, and 30 ml of an aqueous solution containing 0.24 g of potassium bromide, were added to the resulting solution, over 20 sec, with vigorous stirring. After the completion of the addition, the temperature was kept at 40° C. for 1 min, and then, the temperature was raised to 75° C. After 27.0 g of gelatin was added, together with 200 ml of distilled water, 100 ml of an aqueous solution containing 23.36 g of silver nitrate, and 80 ml of an aqueous solution containing 16.37 g of potassium bromide, were added, over 36 min, with the flow rate of the addition being accelerated. Then, 250 ml of an aqueous solution containing 83.2 g of silver nitrate, and an aqueous solution containing potassium iodide and potassium bromide in a molar ratio of 3:97 (the concentration of potassium bromide: 26%), were added, over 60 min, with the flow rate of the addition being accelerated, so that the silver electric potential of the reaction liquid would become −20 mV to a saturated calomel electrode. Further, 75 ml of an aqueous solution containing 18.7 g of silver nitrate, and a 21.9% aqueous solution of potassium bromide, were added, over 10 min, so that the silver electric potential of the reaction liquid would become 20 mV to the saturated calomel electrode. After the completion of the addition, the temperature was kept at 75° C. for 1 min; then the temperature of the reaction liquid was dropped to 40° C. Then, 100 ml of an aqueous solution containing 10.5 g of sodium p-iodoacetamidobenzene sulfonate (monohydrate) was added, and the pH of the reaction liquid was adjusted to 9.0. Further, 50 ml of an aqueous solution containing 4.3 g of sodium sulfite was added. After the completion of the addition, the temperature was kept 40° C. for 3 min, and the temperature of the reaction liquid was raised to 55° C. After adjusting the pH of the reaction liquid to 5.8, 0.8 mg of sodium benzenethiosulfinate and 5.5 g of potassium bromide were added, kept at 55° C. for 1 min, and further, 180 ml of an aqueous solution containing 44.3 g of silver nitrate, and 160 ml of an aqueous solution containing 34.0 g of potassium bromide were added over 30 min. The temperature was then dropped, and then desalting was carried out by the usual method. After the completion of the desalting, gelatin was added to be 7 wt %, and pH was adjusted to 6.2.

The resulting emulsion was an emulsion containing hexagonal tabular grains, wherein the average grain size (represented by a sphere-equivalent diameter) was 1.29 $\mu$m, the deviation coefficient of the grain size was 17%, the average grain thickness was 0.27 $\mu$m, and the average aspect ratio (a ratio obtained by dividing the projected grain diameter by grain thickness) was 8.5. This emulsion was designated as Emulsion A-1.

An emulsion was prepared in the same manner as emulsion A-1, except that 7.38 mg of potassium hexatriazoloruthenate (II) tetrahydride was added to the aqueous solution containing potassium bromide, which was added at the last of the completion of grain formation. The emulsion was designated as emulsion A-2.

Next, 0.37 g of gelatin, having an average molecular weight of 15,000, and 930 ml of distilled water containing 0.37 g of acid-processed gelatin and 0.7 g of potassium bromide, were placed in a reaction vessel, and the temperature was elevated to 40° C. 30 ml of an aqueous solution containing 0.34 g of silver nitrate, and 30 ml of an aqueous solution containing 0.24 g of potassium bromide, were added to the resulting solution, over 20 sec, with vigorous stirring. After the completion of the addition, the temperature was kept at 40° C. for 1 min, and then, the temperature was raised to 75° C. After 27.0 g of gelatin whose amino group was modified with trimellitic acid, was added, together with 200 ml of distilled water, 100 ml of an aqueous solution containing 23.36 g of silver nitrate, and 80 ml of an aqueous solution containing 16.37 g of potassium bromide, were added, over 36 min, with the flow rate of the addition being accelerated. Then, 250 ml of an aqueous solution containing 83.2 g of silver nitrate, and an aqueous solution containing potassium iodide and potassium bromide in a molar ratio of 3:97 (the concentration of potassium bromide: 26%), were added, over 60 min, with the flow rate of the addition being accelerated, so that the silver electric potential of the reaction liquid would become −50 mV to a saturated calomel electrode. Further, 75 ml of an aqueous solution containing 18.7 g of silver nitrate, and a 21.9% aqueous solution of potassium bromide, were added, over 10 min, so that the silver electric potential of the reaction liquid would become 0 mV to the saturated calomel electrode. After the completion of the addition, the temperature was kept at 75° C. for 1 min; then the temperature of the reaction liquid was dropped to 40° C. Then, 100 ml of an aqueous solution containing 10.5 g of sodium p-iodoacetamidobenzene sulfonate (monohydrate) was added, and the pH of the reaction liquid was adjusted to 9.0. Further, 50 ml of an aqueous solution containing 4.3 g of sodium sulfite was added. After the completion of the addition, the temperature was kept 40° C. for 3 min, and the temperature of the reaction liquid was raised to 55° C. After adjusting the pH of the reaction liquid to 5.8, 0.8 mg of sodium benzenethiosulfinate and 5.5 g of potassium bromide were added, kept at 55° C. for 1 min, and further, 180 ml of an aqueous solution containing 44.3 g of silver nitrate, and 160 ml of an aqueous solution containing 34.0 g of potassium bromide were added over 30 min. The temperature was then dropped, and then desalting was carried out by the usual method. After the completion of the desalting, gelatin was added to be 7 wt %, and pH was adjusted to 6.2.

The resulting emulsion was an emulsion containing hexagonal tabular grains, wherein the average grain size (represented by a sphere-equivalent diameter) was 1.29 $\mu$m, the deviation coefficient of the grain size was 19%, the average grain thickness was 0.13 $\mu$m, and the average aspect ratio was 25.4. This emulsion was designated as Emulsion A-3.

An emulsion was prepared in the same manner as emulsion A-3, except that 7.38 mg of potassium hexatriazoloruthenate (II) tetrahydride was added to the aqueous solution of potassium bromide, which was added at the last of the completion of grain formation. The emulsion was designated as emulsion A-4.

5.6 ml of an aqueous 1% potassium iodide solution was added to emulsion A-1, to which were then added $4.4\times10^{-4}$ mols of red-sensitive spectrally-sensitizing dyes shown below, Compound I, potassium thiocyanate, chloroauric acid, sodium thiosulfate, and mono(pentafluorophenyl) diphenylphosphineselenide, to provide spectral sensitization and chemical sensitization. After the chemical sensitization was completed, a stabilizer S was added. At this time, the amount of the chemical sensitizer was adjusted so as to make the level of chemical sensitization for the emulsion optimal. The resulting spectrally-sensitized and chemically-sensitized emulsion was designated as emulsion A-1r.

Red-sensitive sensitizing dye A mixture in 4:1:5 (molar ratio)

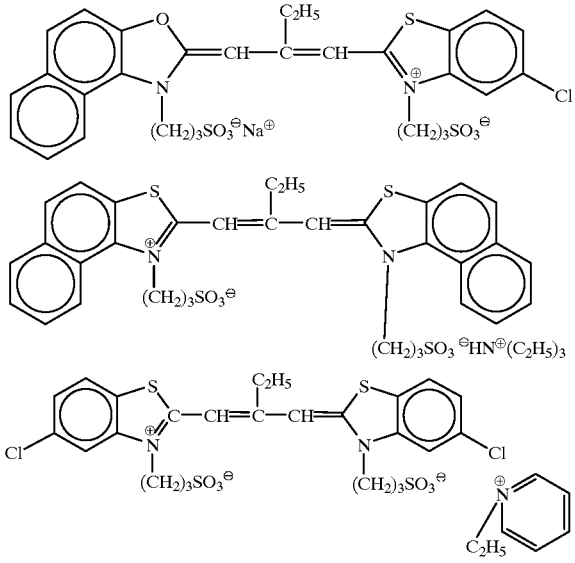

Compound I

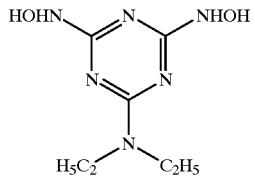

Compound I

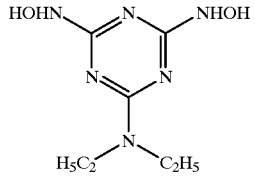

Stabilizer S (mixture described below)

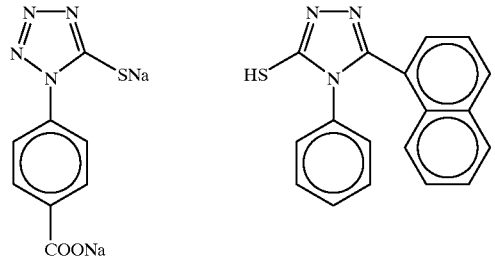

2 x $10^{-4}$mol/molAg to Emulsion A-1 8 X $10^{-5}$mol/molAg to Emulsion A-1

The emulsions A-2, A-3, and A-4 were also likewise provided with spectral sensitization and chemical sensitization and designated as emulsions A-2r, A-3r, and A-4r; however, the amount of spectral-sensitizing dye to be added was adjusted in proportion to the surface area of the emulsion grains.

Next, 2.9 g of gelatin, having an average molecular weight of 15,000, and 1670 ml of distilled water containing 2.78 g of sodium chloride, were placed in a reaction vessel, and the temperature was elevated to 35° C. 80 ml of an aqueous solution containing 6.12 g of silver nitrate, and 80 ml of an aqueous solution containing 2.28 g of sodium chloride, were added to the resulting solution, over 60 sec, with vigorous stirring. Then, 200 mg of compound A, and 4.17 g of sodium chloride were added to the reaction liquid, and the temperature of the reaction vessel was raised to 60° C. After keeping the vessel at 60° C. for 15 minutes, 40 g of phthalated gelatin dissolved in 400 ml of water was added, and 100 mg of compound A was added. Then, 800 ml of an aqueous solution containing 163.75 g of silver nitrate, and 800 ml of an aqueous solution containing 59.67 g of sodium chloride were added, respectively, with the initial flow rate of addition of 1.8 ml/min, over 60 min, with the flow rate being accelerated. After the completion of addition of these solutions, 32 ml of an aqueous solution of 1 N-potassium thiocyanate was added, and then $7.9\times10^{-4}$ mol of the spectral sensitizing dye used in Emulsion A-1 to A-4 was added. The temperature of the reaction vessel was kept 75° C. for 15 min, and the temperature was then dropped, and then desalting was carried out by the usual method. After the completion of the desalting, gelatin was added to be 7 wt %, and pH was adjusted to 6.2.

The resulting emulsion was an emulsion containing hexagonal tabular grains, wherein the average grain size (represented by a sphere-equivalent diameter) was 1.25 $\mu$m, the deviation coefficient of the grain size was 16%, the average grain thickness was 0.13 μm, and the aspect ratio (a ratio obtained by dividing the average-projected grain diameter by grain thickness) was 24.3. This emulsion was designated as Emulsion A-5.

Compound A

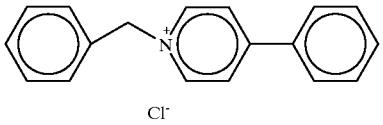

An emulsion was prepared in the same manner as emulsion A-5, except that an aqueous solution containing 7.38 mg of potassium hexatriazoloruthenate (II) tetrahydride was added over 7 minutes before the completion of the grain formation. The emulsion was designated as emulsion A-6.

An emulsion was prepared in the same manner as emulsion A-5, except that an aqueous 10% solution containing 4.73 g of potassium bromide was added 8 minutes before the formation of grains was completed. The emulsion was designated as emulsion A-7.

An emulsion was prepared in the same manner as emulsion A-7, except that an aqueous solution containing 7.38 mg of potassium hexatriazoloruthenate (II) tetrahydride was added over 7 minutes before the formation of grains was completed. The emulsion was designated as emulsion A-8.

An emulsion was prepared in the same manner as emulsion A-5, except that an aqueous 10% solution containing 2.86 g of potassium bromide was added 8 minutes before the formation of grains was completed. The emulsion was designated as emulsion A-9.

An emulsion was prepared in the same manner as emulsion A-9, except that an aqueous solution containing 7.38 mg of potassium hexatriazoloruthenate (II) tetrahydride was added over 7 minutes before the formation of grains was completed. The emulsion was designated as emulsion A-10.

To these emulsions, kept at 58° C., were added the compound I, potassium thiocyanate, chloroauric acid, sodium thiosulfate and mono(pentafluorophenyl) diphenylphosphineselenide to obtain an emulsion provided with spectral sensitization and chemical sensitization. The amount of the chemical sensitizer was adjusted so as to make the level of chemical sensitization for the emulsion optimal. The resulting emulsions were each expressed as A-5r, A-6r . . . A-10r.

Silver halide grains were taken out of these emulsions, to observe the dislocation lines using an electron microscope, under a cooled condition using liquid nitrogen, at an acceleration voltage of 400 KV, according to a transmission method. In each of emulsions A-2r, A-4r, A-8r and A-10r, which contains grains having a phase containing 10 mol % or more of silver bromide and containing the metal complex dopant for use in the present invention in the phase, a remarkable increase in the density of dislocation lines was observed.

Next, a dispersion of zinc hydroxide, which was used as a base precursor, was prepared.

31 g of zinc hydroxide powder, whose primary particles had a grain size of 0.2 μm, 1.6 g of carboxymethyl cellulose and 0.4 g of sodium polyacrylate, as a dispersant, 8.5 g of lime-processed ossein gelatin, and 158.5 ml of water were mixed together, and the mixture was dispersed by a mill containing glass beads for 1 hour. After the dispersion, the glass beads were filtered off, to obtain 188 g of a dispersion of zinc hydroxide.

Further, an emulsified dispersion containing a coupler and built-in type developing agent was prepared.

10.78 g of a cyan coupler (a), 8.14 g of developing agent (b), 1.05 g of developing agent (c), 0.15 g of antifogging agent, 8.27 g of high-boiling organic solvent (e), and 38.0 ml of ethyl acetate were dissolved at a temperature of 60° C. The resulting solution was mixed with 150 g of an aqueous solution comprising 12.2 g of lime-processed gelatin and 0.8 g of surfactant (f), and the mixture was emulsified and dispersed at 10,000 rpm for 20 minutes using a dissolver stirrer. After the dispersion, distilled water was added to bring the total weight to 300 g, and they were mixed at 2000 rpm for 10 minutes.

Cyan coupler (a)

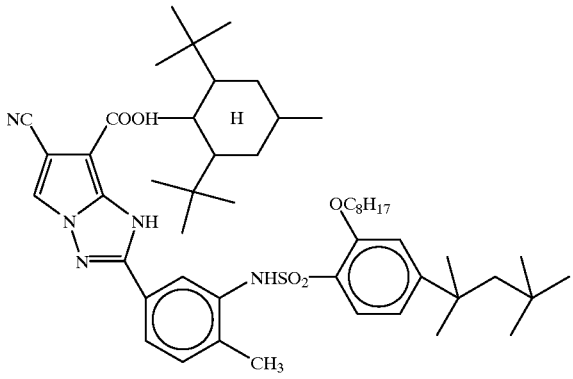

Developing agent (b)

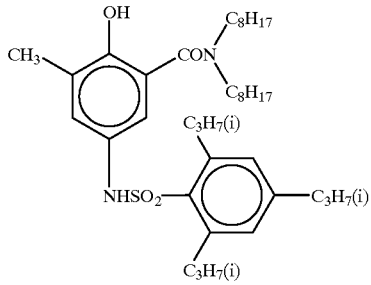

Developing agent (c)

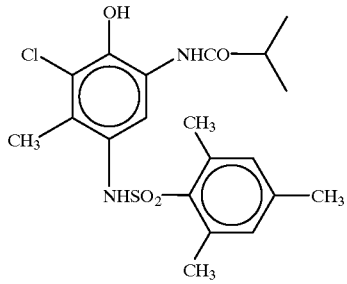

Antifoggant (d)

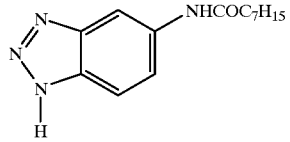

High-boiling organic solvent (e)

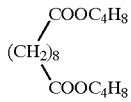

-continued

Surface-active agent (f)

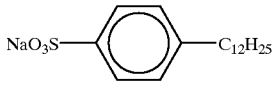

Further, a dispersion of cyan dye (g) to color an antihalation layer was prepared in the same manner.

The dye (g) and the high-boiling organic solvent (h) used to disperse the dye were shown below.

Samples 101 to 110 of a multi-layer color photographic light-sensitive material were prepared by coating, in combination, these dispersions and the silver halide emulsions prepared in the above, on the support, with the configuration shown in Table 1.

Cyan dye (g)

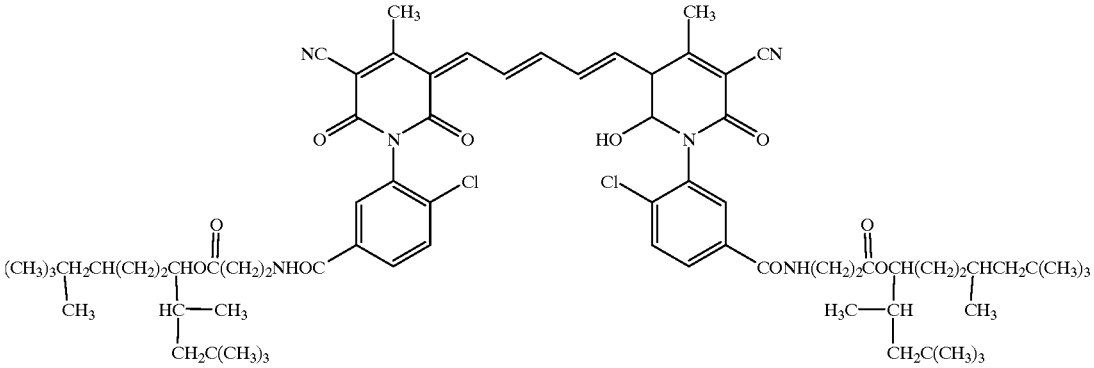

High-boiling organic solvent (h)

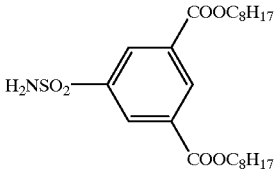

TABLE 1

| | Sample 101 | Sample 102 | Sample 103 | Sample 104 | Sample 105 | Sample 106 | Sample 107 | Sample 108 | Sample 109 | Sample 110 |
|---|---|---|---|---|---|---|---|---|---|---|
| Protective layer | | | | | | | | | | |
| Lime-processed gelatin | 1000 | 1000 | 1000 | 1000 | 1000 | 1000 | 1000 | 1000 | 1000 | 1000 |
| Matting agent(silica) | 50 | 50 | 50 | 50 | 50 | 50 | 50 | 50 | 50 | |
| Surfactant(i) | 100 | 100 | 100 | 100 | 100 | 100 | 100 | 100 | 100 | 100 |
| Surfactant(j) | 300 | 300 | 300 | 300 | 300 | 300 | 300 | 300 | 300 | 300 |
| Water soluble polymer(k) | 15 | 15 | 15 | 15 | 15 | 15 | 15 | 15 | 15 | 15 |
| Hardener(l) | 40 | 40 | 40 | 40 | 40 | 40 | 40 | 40 | 40 | 40 |
| Interlayer | | | | | | | | | | |
| Lime-processed gelatin | 375 | 375 | 375 | 375 | 375 | 375 | 375 | 375 | 375 | 375 |
| Surfactant(j) | 15 | 15 | 15 | 15 | 15 | 15 | 15 | 15 | 15 | 15 |
| Zinc hydroxide | 1100 | 1100 | 1100 | 1100 | 1100 | 1100 | 1100 | 1100 | 1100 | 1100 |
| Water soluble polymer k | 15 | 15 | 15 | 15 | 15 | 15 | 15 | 15 | 15 | 15 |
| Cyan color-developing layer | | | | | | | | | | |
| Lime-processed gelatin | 2000 | 2000 | 2000 | 2000 | 2000 | 2000 | 2000 | 2000 | 2000 | 2000 |
| Emulsion(in terms of coating amount of silver) | A-1r 1726 | A-2r 1726 | A-3r 1726 | A-4r 1726 | A-5r 1726 | A-6r 1726 | A-7r 1726 | A-8r 1726 | A-9r 1726 | A-10r 1726 |
| Cyan coupler(a) | 696 | 696 | 696 | 696 | 696 | 696 | 696 | 696 | 696 | 696 |
| Developing agent(b) | 526 | 526 | 526 | 526 | 526 | 526 | 526 | 526 | 526 | 526 |
| Developing agent(c) | 68 | 68 | 68 | 68 | 68 | 68 | 68 | 68 | 68 | 68 |

TABLE 1-continued

| | Sample 101 | Sample 102 | Sample 103 | Sample 104 | Sample 105 | Sample 106 | Sample 107 | Sample 108 | Sample 109 | Sample 110 |
|---|---|---|---|---|---|---|---|---|---|---|
| Antifogging agent(d) | 9.70 | 9.70 | 9.70 | 9.70 | 9.70 | 9.70 | 9.70 | 9.70 | 9.70 | 9.70 |
| High-boiling organic solvent(e) | 534 | 534 | 534 | 534 | 534 | 534 | 534 | 534 | 534 | 534 |
| Surfactant(f) | 52 | 52 | 52 | 52 | 52 | 52 | 52 | 52 | 52 | 52 |
| Water soluble polymer(k) | 14 | 14 | 14 | 14 | 14 | 14 | 14 | 14 | 14 | 14 |
| Antihalation layer | | | | | | | | | | |
| Lime-processed gelatin | 750 | 750 | 750 | 750 | 750 | 750 | 750 | 750 | 750 | 750 |
| Dye(g) | 133 | 133 | 133 | 133 | 133 | 133 | 133 | 133 | 133 | 133 |
| High-boiling organic solvent(h) | 123 | 123 | 123 | 123 | 123 | 123 | 123 | 123 | 123 | 123 |
| Surfactant(f) | 14 | 14 | 14 | 14 | 14 | 14 | 14 | 14 | 14 | 14 |
| Water soluble polymer(k) | 15 | 15 | 15 | 15 | 15 | 15 | 15 | 15 | 15 | 15 |
| Transparent PET Base(120 μm) | | | | | | | | | | |

*Figure represents the coating amount(mg/m$^2$)

Surface-active agent (i)

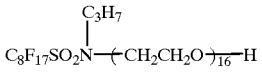

Surface-active agent (i)

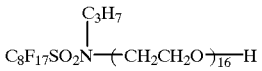

Surface-active agent (j)

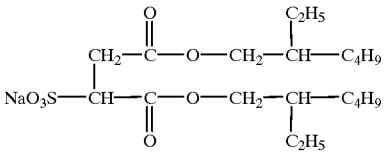

Water-soluble polymer (k)

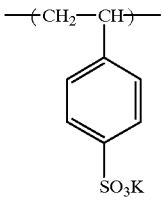

Hardener (1)

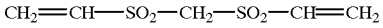

Further, processing materials P-1 and P-2 as sown in Tables 2 and 3 were prepared.

TABLE 2

Composition of Processing Material P-1

| Layer Composition | Added Material | Added amount (mg/m$^2$) |
|---|---|---|
| Forth layer Protective layer | Acid-processed gelatin | 220 |
| | Water-soluble polymer(y) | 60 |
| | Water-soluble polymer(w) | 200 |
| | Additive(x) | 80 |
| | Potassium nitrate | 16 |
| | Matting agent(Z) | 10 |
| | Surfactant(r) | 7 |
| | Surfactant(aa) | 7 |
| | Surfactant(ab) | 10 |

TABLE 2-continued

Composition of Processing Material P-1

| Layer Composition | Added Material | Added amount (mg/m$^2$) |
|---|---|---|
| Third layer Interlayer | Lime-processed gelatin | 240 |
| | Water-soluble polymer(w) | 24 |
| | Hardener(ac) | 180 |
| | Surfactant(f) | 9 |
| Second layer Bace generation layer | Lime-processed gelatin | 2100 |
| | Water-soluble polymer(w) | 360 |
| | Water-soluble polymer(ab) | 700 |
| | Water-soluble polymer(ae) | 600 |
| | High-boiling organic agent (af) | 2120 |
| | Additive(ag) | 20 |
| | Guanidine picolinate | 2613 |
| | Potassium quinolinate | 225 |
| | Sodium quinolinate | 192 |
| | Surfactant(f) | 24 |
| First layer Undercoat layer | Lime-processed gelatin | 247 |
| | Water-soluble polymer(y) | 12 |
| | Surfactant(r) | 14 |
| | Hardener(ac) | 178 |
| | Transparent base (63 μm) | |

TABLE 3

Composition of Processing Material P-2

| Layer Composition | Added Material | Added amount (mg/m$^2$) |
|---|---|---|
| Fifth layer Protective layer | Acid-processed gelatin | 490 |
| | Matting agent(Z) | 10 |
| Forth layer Interlayer | Lime-processed gelatin | 240 |
| | Hardener(ac) | 250 |
| Third layer Solvent layer | Lime-processed gelatin | 4890 |
| | Silver halide solvent(ah) | 5770 |
| Second layer Interlayer | Lime-processed gelatin | 370 |
| | Hardener(ac) | 500 |
| Firth layer Undercoat layer | Lime-processed gelatin | 247 |
| | Water-soluble polymer(y) | 12 |
| | Surfactant(r) | 14 |
| | Transparent base (63 μm) | 178 |

Additive (x)

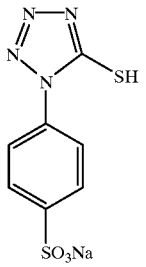

Water soluble polymer (y) K(kappa)-Carragaenan
Water soluble polymer (w) Sumikagel L5-H (trade name: manufactured by Sumitomo Kagaku CO.)

Additive (x)

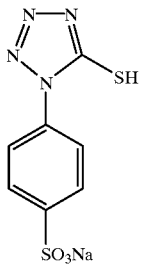

Matte agent (z)

SYLOID79
(trade name: manufactured by Fuji Davission Kagaku Co.)

Surface-active agent (aa)

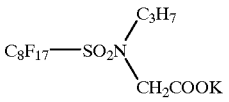

Surface-active agent (ab)

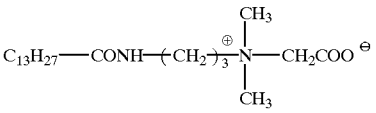

Hardener (ac)

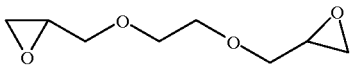

Water soluble polymer (ad) Dextran (molecular weight 70,000)
Water soluble polymer (ae) MP polymer MP102 (trade name: manufactured by Kuraray Co.)

Surfactant (r)

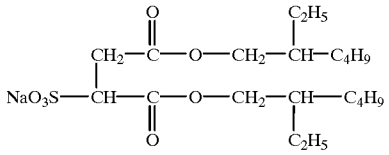

-continued

High-boiling solvent (af) EMPARA 40 (manufactured by Ajinomoto K.K.)

Additive (ag)

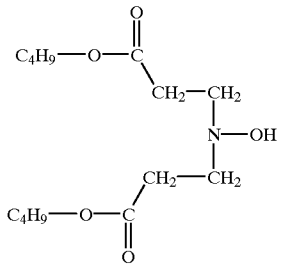

Silver halide solvent (ah)

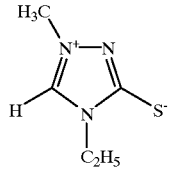

Test specimens were cut from these light-sensitive materials and exposed to light at an intensity of 200 lux for 1/100 seconds through an optical wedge, using a photographic daylight (color temperature: about 5500 K) as a light source.

10 ml/m$^2$ of 40° C. hot water was supplied to the surface of the light-sensitive material after the exposure. The film surfaces of the light-sensitive material and processing material P-1 were overlapped on each other, and thereafter heat developed at 83° C. for 17 seconds by using a heat drum. After P-1 was peeled off, 7 ml/m$^2$ of water was applied to the surface of the light-sensitive material, and a processing material P-2 was overlapped on the surface of the light-sensitive material, and further heated at 50° C. for 15 seconds.

On the test specimen of the light-sensitive material that was peeled from the processing materials, a cyan color-developed image corresponding to the exposure had been formed. The transmission density of the color-developed test specimen obtained after the heat development was measured, to make a so-called characteristic curve, from which minimum density (fog density), relative sensitivity, maximum color density, and contrast were calculated. As to the sensitivity, the reciprocal of exposure amount giving a density 0.15 higher than the minimum density after the treatment, in terms of optical density, was determined as the sensitivity, and the sensitivity found was shown in terms of relative value by assuming the sensitivity of the sample 101 to be 100. Contrast was expressed by an inclination (γ) between the point where the sensitivity was calculated and the point where the density was 2.0 on the characteristic curve.

The results are shown in Table 4.

TABLE 4

| | Sample 101 | Sample 102 | Sample 103 | Sample 104 | Sample 105 | Sample 106 | Sample 107 | Sample 108 | Sample 109 | Sample 110 |
|---|---|---|---|---|---|---|---|---|---|---|
| Minimum density (fogging density) | 0.29 | 0.27 | 0.24 | 0.23 | 0.21 | 0.20 | 0.19 | 0.18 | 0.18 | 0.17 |
| Relative sensitivity | 100 | 107 | 111 | 143 | 48 | 51 | 118 | 145 | 121 | 154 |
| Maximum color- developing density | 2.05 | 2.08 | 2.43 | 2.92 | 2.36 | 2.39 | 2.77 | 3.21 | 2.80 | 3.35 |
| Contrast | 0.61 | 0.62 | 0.83 | 1.15 | 0.87 | 0.88 | 1.13 | 1.39 | 1.15 | 1.42 |
| Remarks | Com-parative | Com-parative | Com-parative | This invention | Com-parative | Com-parative | Com-parative | This invention | Com-parative | This invention |

*Sensitivity was represented in terms of relative value assuming the sensitivity of Sample 101 to be 100.

From the results shown in Table 4, the effect of the present invention were apparent. Specifically, comparing samples 101 to 104 with each other, samples 101 and 102, respectively using the emulsions A-1r and A-2r, comprising tabular grains having a grain thickness as thick as 0.27 $\mu$m, obtained no high sensitivity and only low contrast. On the contrary, as to the emulsions having a grain thickness of 0.13 $\mu$m, the sample 103 using A-3r in which the metal complex dopant for use in the present invention was not used obtained low sensitivity and low contrast, whereas sample 104 using A-4r in which the metal complex dopant for use in the present invention was used, obtained high sensitivity and high contrast.

Also, among the samples 105 to 110 using tabular grains comprising high silver chloride, samples 105 and 106, respectively using emulsions A-5r and A-6r having no phase containing 10 mol % or more of silver bromide produced low sensitivity and low contrast, regardless of whether or not the metal complex dopant for use in the present invention was used. On the contrary, among the samples using an emulsion having a phase containing 10 mol % or more of silver bromide, samples 107 and 109, respectively using emulsions A-7r and A-9r, in which the metal complex dopant for use in the present invention was not used obtained low sensitivity and low contrast, whereas samples 108 and 110, respectively using emulsions A-8r and A-10r, in which the metal complex dopant for use in the present invention was used, obtained high sensitivity and high contrast.

The metal complex dopant used in emulsions A-4r, A-8r and A-10 r fall under substances defined in (9) and (10).

Complex α

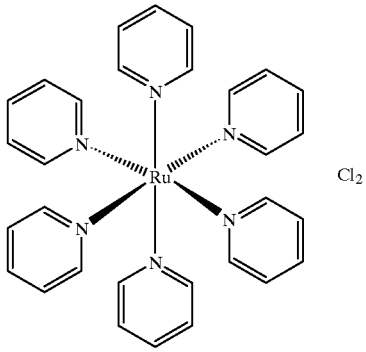

Complex β

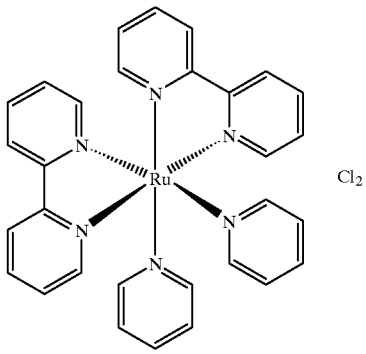

Complex γ

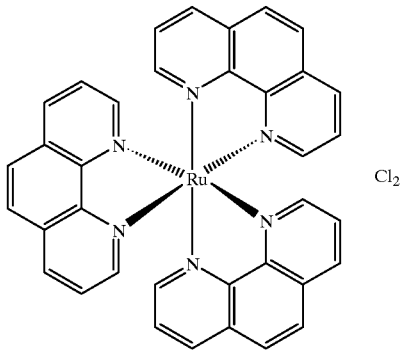

Example 2

Emulsions were prepared in the same manner as emulsion 104 prepared in Example 1, except that the potassium hexatriazoloruthenate (II) tetrahydride added in the aqueous solution of potassium bromide that was added at the last of the grain formation, was replaced by each of a complex α, a complex β, a complex γ, a complex δ, and a complex ϵ, so as to provide emulsions A-4α, A-4β, A-4γ, A-4δ, and A-4ϵ. Spectral sensitization and chemical sensitization were performed to these emulsions similar to the preparation of emulsion A-4r, so as to obtain emulsions A-4αr, A-4βr, A-4γr, A-4δr, and A-4ϵr. The spectral sensitization and chemical sensitization were optimized for each emulsion.

-continued

Complex δ

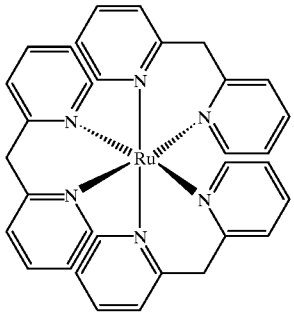

$Cl_2$

Complex ε

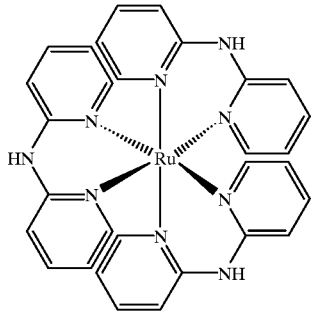

$Cl_2$

Further, emulsions were prepared in the same manner as emulsion A-10 prepared in Example 1, except that the potassium hexatriazoloruthenate (II) tetrahydride added over 7 minutes before the completion of the grain formation, were replaced by a complex α, a complex β, a complex γ, a complex δ, and a complex ϵ, so as to provide emulsions A-10α, A-10β, A-10γ, A-10δ, and A-10ϵ. By applying spectral sensitization and chemical sensitization to these emulsions similar to the preparation of the emulsion A-10r, emulsions A-10αr, A-10βr, A-10γr, A-10δr, and A-10ϵr were obtained. The spectral sensitization and chemical sensitization were optimized for each emulsion.

Silver halide grains were taken out of these emulsions, to observe the dislocation lines by using an electron microscope, under a cooled condition, using liquid nitrogen, at an acceleration voltage of 400 KV, according to a transmission method. Remarkable increase of the dislocation line density was observed in emulsions A-4αr, A-4βr, A-4γr, A-4δr, and A-4ϵr in comparison to emulsion A-3r. Remarkable increase of the dislocation line density was also observed in emulsions A-10αr, A-10βr, A-10γr, A-10δr, and A-10ϵr in comparison to the emulsion A-10r.

Subsequently, with utilizing these emulsions, photosensitive materials were produced in the same manner as in Example 1. The obtained photosensitive materials were designated as sample 201 to 210.

TABLE 5

| | Sample 104 | Sample 201 | Sample 202 | Sample 203 | Sample 204 | Sample 205 | Sample 110 | Sample 206 | Sample 207 | Sample 208 | Sample 209 | Sample 210 |
|---|---|---|---|---|---|---|---|---|---|---|---|---|
| Protective layer | | | | | | | | | | | | |
| Lime-processed gelatin | 1000 | 1000 | 1000 | 1000 | 1000 | 1000 | 1000 | 1000 | 1000 | 1000 | 1000 | 1000 |
| Matting agent(silica) | 50 | 50 | 50 | 50 | 50 | 50 | 50 | 50 | 50 | 50 | 50 | 50 |
| Surfactant(i) | 100 | 100 | 100 | 100 | 100 | 100 | 100 | 100 | 100 | 100 | 100 | 100 |
| Surfactant(j) | 300 | 300 | 300 | 300 | 300 | 300 | 300 | 300 | 300 | 300 | 300 | 300 |
| Water soluble polymer(k) | 15 | 15 | 15 | 15 | 15 | 15 | 15 | 15 | 15 | 15 | 15 | 15 |
| Hardener(l) | 40 | 40 | 40 | 40 | 40 | 40 | 40 | 40 | 40 | 40 | 40 | 40 |
| Interlayer | | | | | | | | | | | | |
| Lime-processed gelatin | 375 | 375 | 375 | 375 | 375 | 375 | 375 | 375 | 375 | 375 | 375 | 375 |
| Surfactant(j) | 15 | 15 | 15 | 15 | 15 | 15 | 15 | 15 | 15 | 15 | 15 | 15 |
| Zinc hydroxide | 1100 | 1100 | 1100 | 1100 | 1100 | 1100 | 1100 | 1100 | 1100 | 1100 | 1100 | 1100 |
| Water soluble polymer(k) | 15 | 15 | 15 | 15 | 15 | 15 | 15 | 15 | 15 | 15 | 15 | 15 |
| Cyan color-forming layer | | | | | | | | | | | | |
| Lime-processed gelatin | 2000 | 2000 | 2000 | 2000 | 2000 | 2000 | 2000 | 2000 | 2000 | 2000 | 2000 | 2000 |
| Emulsion(in terms of | A-4r | A-4αr | A-4βr | A-4γr | A-4σr | A-4ϵr | A-10r | A-10αr | A-10βr | A-10γr | A-10σr | A-10ϵr |
| coating amount of silver) | 1726 | 1726 | 1726 | 1726 | 1726 | 1726 | 1726 | 1726 | 1726 | 1726 | 1726 | 1726 |
| Cyan coupler(a) | 696 | 696 | 696 | 696 | 696 | 696 | 696 | 696 | 696 | 696 | 696 | 696 |
| Developing agent(b) | 526 | 526 | 526 | 526 | 526 | 526 | 526 | 526 | 526 | 526 | 526 | 526 |
| Developing agent(c) | 68 | 68 | 68 | 68 | 68 | 68 | 68 | 68 | 68 | 68 | 68 | 68 |
| Antifogging agent(d) | 9.70 | 9.70 | 9.70 | 9.70 | 9.70 | 9.70 | 9.70 | 9.70 | 9.70 | 9.70 | 9.70 | 9.70 |
| High-boiling organic solvent(e) | 534 | 534 | 534 | 534 | 534 | 534 | 534 | 534 | 534 | 534 | 534 | 534 |
| Surfactant(f) | 52 | 52 | 52 | 52 | 52 | 52 | 52 | 52 | 52 | 52 | 52 | 52 |
| Water soluble polymer(k) | 14 | 14 | 14 | 14 | 14 | 14 | 14 | 14 | 14 | 14 | 14 | 14 |
| Antihalation layer | | | | | | | | | | | | |
| Lime-processed gelatin | 750 | 750 | 750 | 750 | 750 | 750 | 750 | 750 | 750 | 750 | 750 | 750 |
| Dye(g) | 133 | 133 | 133 | 133 | 133 | 133 | 133 | 133 | 133 | 133 | 133 | 133 |
| High-boiling organic solvent(h) | 123 | 123 | 123 | 123 | 123 | 123 | 123 | 123 | 123 | 123 | 123 | 123 |

TABLE 5-continued

| | Sample 104 | Sample 201 | Sample 202 | Sample 203 | Sample 204 | Sample 205 | Sample 110 | Sample 206 | Sample 207 | Sample 208 | Sample 209 | Sample 210 |
|---|---|---|---|---|---|---|---|---|---|---|---|---|
| Surfactant(f) | 14 | 14 | 14 | 14 | 14 | 14 | 14 | 14 | 14 | 14 | 14 | 14 |
| Water soluble polymer(k) | 15 | 15 | 15 | 15 | 15 | 15 | 15 | 15 | 15 | 15 | 15 | 15 |
| Transparent PET Base(120 μm) | | | | | | | | | | | | |

*Figure represents the coating amount(mg/m$^2$)

These photosensitive materials were exposed, and treated with the heat developing processing, in the same manner as in Example 1. The photographic characteristics were evaluated from transmission density measurement of the colored samples.

Results are shown in Table 6.

TABLE 6

| | Sample 104 | Sample 201 | Sample 202 | Sample 203 | Sample 204 | Sample 205 | Sample 110 | Sample 206 | Sample 207 | Sample 208 | Sample 209 | Sample 210 |
|---|---|---|---|---|---|---|---|---|---|---|---|---|
| Minimum density (fogging density) | 0.23 | 0.23 | 0.25 | 0.22 | 0.22 | 0.24 | 0.17 | 0.17 | 0.19 | 0.17 | 0.16 | 0.18 |
| Relative sensitivity | 143 | 149 | 129 | 151 | 158 | 148 | 154 | 160 | 131 | 161 | 167 | 158 |
| Maximum color-developing density | 2.92 | 2.95 | 2.84 | 2.96 | 2.99 | 2.93 | 3.35 | 3.38 | 3.24 | 3.37 | 3.42 | 3.35 |
| Contrast | 1.15 | 1.18 | 1.10 | 1.17 | 1.22 | 1.16 | 1.42 | 1.44 | 1.33 | 1.45 | 1.49 | 1.43 |
| Remarks | This invention | This invention | This invention | This invention | This invention | This invention | This invention | This invention | This invention | This invention | This invention | This invention |

*Sensitivity was represented in terms of relative value assuming the sensitivity of Sample 101 to be 100.

From the results, it is understood that the remarkable effects of the present invention can also be obtained when the complex α, the complex β, the complex γ, the complex δ, and the complex ϵ are used.

In this connection, complexes α, β, γ and δ fall under the metal complex defined in (8) and complex ϵ falls under the metal complex defined in (10).

Example 3

An emulsion was prepared in the same manner as emulsion A-3 prepared in Example 1, except that 0.04 mg of potassium hexachloroiridate (IV) were added at the same time of addition of sodium benzenethiosulfinate, and 8.9 mg of potassium hexacyanoferrate (II) was added to the aqueous solution of potassium bromide, which was added at the last of the grain formation. The emulsion was designated as emulsion B-1o.

By changing the amounts of silver nitrate and potassium bromide that were added at the first of the formation of grains, the number of nuclei to be produced was altered from those adopted in the case of emulsion B-1o, to prepare an emulsion B-1m, comprising hexagonal tabular grains having an average grain size of 0.75 μm in terms of diameter equivalent to a sphere, an average grain thickness of 0.11 μm, and an average aspect ratio of 14.0, and an emulsion B-1u, comprising hexagonal tabular grains having an average grain size of 0.52 μm in terms of diameter equivalent to a sphere, an average grain thickness of 0.09 μm, and an average aspect ratio of 11.3. In these cases, the amounts of potassium hexachloroiridate (IV) and potassium hexacyanoferrate (II) were changed in inverse proportion to the volume of grains, and the amount of sodium p-iodoacetoamidobenzene sulfonate monohydride was changed in proportion to the circumferential length of a grain.

To each of these emulsions, 5.6 ml of an aqueous 1% potassium iodide solution was added at 40° C., and then were added the spectrally-sensitizing dye, the compound I, potassium thiocyanate, chloroauric acid, sodium thiosulfate, and mono(pentafluorophenyl)diphenylphosphineselenide, used in Example 1, to provide spectral sensitization and chemical sensitization. The amount of the spectrally-sensitizing dye to be added was changed in accordance with the surface area of a grain, based on emulsion A-3r in Example 1, and the amount of the chemical sensitizer to be added was controlled to be optimal in each emulsion. After the chemical sensitization was completed, a stabilizer S was added, with its amount changed in accordance with the surface area of a grain, based on emulsion A-3r of Example 1. The resulting emulsions were designated as emulsions B-1or, B-1mr and B-1ur.

Similarly, by changing the spectrally-sensitizing dye to green-sensitizing dyes and to a blue-sensitizing dye, as shown below, respectively, green-sensitive emulsions B-1og, B-1mg, and B-1ug, and blue-sensitive emulsions B-1ob, B-1mb and B-1ub, were prepared.

Sensitizing dye I for green-sensitive emulsion

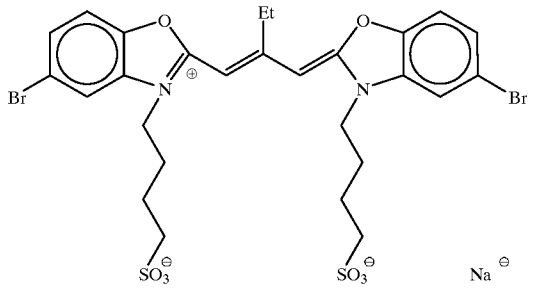

Next, an emulsion was prepared in the same manner as emulsion A-4 prepared in Example 1, except that 0.04 mg of potassium hexachloroiridate (IV) were added at the same time of addition of sodium benzenethiosulfinate, and 8.9 mg of potassium hexacyanoferrate (II) was added to the aqueous solution of potassium bromide, which was added at the last of the grain formation. The emulsion was designated as emulsion B-2o.

By changing the amounts of silver nitrate and potassium bromide that were added at the first of the formation of grains, the number of nuclei to be produced was altered from those adopted in the case of emulsion B-2O, to prepare an emulsion B-2m, comprising hexagonal tabular grains having an average grain size of 0.75 μm in terms of diameter equivalent to a sphere, an average grain thickness of 0.11 μm, and an average aspect ratio of 14.0, and an emulsion B-2u, comprising hexagonal tabular grains having an average grain size of 0.52 μm in terms of diameter equivalent to a sphere, an average grain thickness of 0.09 μm, and an average aspect ratio of 11.3. In these cases, the amounts of potassium hexachloroiridate (IV), potassium hexacyanoferrate (II) and potassium hexatriazoloruthenate (II) tetrahydride, were changed in inverse proportion to the volume of grains, and the amount of sodium p-iodoacetoamidobenzene sulfonate monohydride was changed in proportion to the circumferential length of a grain.

To each of these emulsions, 5.6 ml of an aqueous 1% potassium iodide solution was added at 40° C., and then were added the spectrally-sensitizing dye, the compound I, potassium thiocyanate, chloroauric acid, sodium thiosulfate, and mono(pentafluorophenyl)diphenylphosphineselenide, used in Example 1, to provide spectral sensitization and chemical sensitization. The amount of the spectrally-sensitizing dye to be added was changed in accordance with the surface area of a grain, based on emulsion A-4r in Example 1, and the amount of the chemical sensitizer to be added was controlled to be optimal in each emulsion. After the chemical sensitization was completed, the stabilizer S was added, with its amount changed in accordance with the surface area of a grain, based on emulsion A-4r of Example 1. The resulting emulsions were designated as emulsions B-2or, B-2mr and B-2ur.

Similarly, by changing the spectrally-sensitizing ye to a green-sensitizing dye and to a blue-sensitizing ye, respectively, green-sensitive emulsions B-2og, B-2mg, and B-2ug, and blue-sensitive emulsions B-2ob, B-2mb and B-2ub, were prepared.

Further, an emulsion was prepared in the same manner as emulsion A-46 prepared in Example 2, except that 0.04 mg of potassium hexachloroiridate (IV) were added at the same time of addition of sodium benzenethiosulfinate, and 8.9 mg of potassium hexacyanoferrate (II) was added to the aqueous solution of potassium bromide, which was added at the last of the grain formation. The emulsion was designated as emulsion B-3o.

By changing the amounts of silver nitrate and potassium bromide that were added at the first stage of the formation of grains, the number of nuclei to be produced was altered from those adopted in the case of the emulsion B-3o, to prepare an emulsion B-3 m, comprising hexagonal tabular grains having an average grain size of 0.75 μm in terms of diameter equivalent to a sphere, an average grain thickness of 0.11 μm, and an average aspect ratio of 14.0, and an emulsion B-3u, comprising hexagonal tabular grains having an average grain size of 0.52 μm in terms of diameter equivalent to a sphere, an average grain thickness of 0.09 μm, and an average aspect ratio of 11.3. In these cases, the amounts of potassium hexachloroiridate (IV), potassium hexacyanoferrate (II), and complex δ were changed in inverse proportion to the volume of a grain, and the amount of sodium p-iodoacetoamidobenzene sulfonate monohydride was changed in proportion to the circumferential length of a grain.

To each of these emulsions, 5.6 ml of an aqueous 1% potassium iodide solution was added at 40° C., and then were added the spectrally-sensitizing dye, the compound I, potassium thiocyanate, chloroauric acid, sodium thiosulfate, and mono(pentafluorophenyl)diphenylphosphineselenide, used in Example 1, to provide spectral sensitization and chemical sensitization. The amount of the spectrally-sensitizing dye to be added was changed in accordance with the surface area of a grain, based on emulsion A-10δr of Example 2, and the amount of the chemical sensitizer to be added was controlled to be optimal in each emulsion. After the chemical sensitization was completed, the stabilizer S as used in Example 1 was added, with its amount changed in accordance with the surface area of a grain, based on emulsion A-10r of Example 1. The resulting emulsions were designated as emulsions B-3or, B-3mr, and B-3ur.

Similarly, by changing the spectrally-sensitizing dye to a green-sensitizing dye and to a blue-sensitizing dye, respectively, green-sensitive emulsions B-3og, B-3mg, and B-3ug, and blue-sensitive emulsions B-3ob, B-3mb, and B-3ub, were prepared.

In succession, an emulsion was prepared in the same manner as emulsion A-9 prepared in Example 1, except that 15.9 mg of potassium hexacyanoferrate (II) and 0.03 mg of potassium hexachloroiridate (IV) were added over the last 10 minutes before the addition was completed, and 50 ml of an aqueous solution containing 1.0 g of potassium iodide over the last two minutes before the addition was completed. The emulsion was designated as an emulsion B-40.

The amounts of silver nitrate and sodium chloride that were added at the first of the formation of grains were changed, and the number of nuclei to be produced was altered from those adopted in the case of the emulsion B-40, to prepare an emulsion B-4 m comprising hexagonal tabular grains having an average grain size of 0.75 μm in terms of diameter equivalent to a sphere, an average grain thickness of 0.11 μm, and an average aspect ratio of 14.0, and an emulsion B-4u comprising hexagonal tabular grains having an average grain size of 0.52 μm in terms of diameter equivalent to a sphere, an average grain thickness of 0.09 μm, and an average aspect ratio of 11.3. In these cases, the amounts of the compound A, potassium thiocyanate, and the spectral-sensitizing dye were changed in proportion to the surface area of a grain, and the amounts of potassium hexachloroiridate (IV) and potassium hexacyanoferrate (II) were changed in inverse proportion to a volume of grain.

To each of these emulsions were added, the compound I, potassium thiocyanate, chloroauric acid, sodium thiosulfate and mono(pentafluorophenyl)diphenylphosphine selenide used in Example 1, to obtain emulsions provided with spectral sensitization and chemical sensitization. The amount of the chemical sensitizer to be added was controlled to be optimal in each emulsion. After the chemical sensitization was completed, a stabilizer S was added, while changing its amount in accordance with the surface area of a grain, based on the emulsion A-9r of Example 1. The resulting emulsions were designated as emulsions B-4or, B-4mr and B-4ur.

Similarly, by changing the spectrally-sensitizing dye, green-sensitive emulsions B-4og, B-4mg and B-4ug, and blue-sensitive emulsions B-4ob, B-4mb and B-4ub were prepared.

Further, an emulsion was prepared in the same manner as emulsion A-10 prepared in Example 1, except that 15.9 mg of potassium hexacyanoferrate (II) and 0.03 mg of potassium hexachloroiridate (IV) were added over the last 10 minutes before the addition was completed, and 50 ml of an aqueous solution containing 1.0 g of potassium iodide over the last two minutes before the addition was completed. The emulsion was designated as emulsion B-5o.

The amounts of silver nitrate and sodium chloride that were added at the first of the formation of grains were changed, and the number of nuclei to be produced was altered from those adopted in the case of the emulsion B-5o, to prepare an emulsion B-5m comprising hexagonal tabular grains having an average grain size of 0.75 μm in terms of diameter equivalent to a sphere, an average grain thickness of 0.11 μm, and an average aspect ratio of 14.0, and an emulsion B-5u comprising hexagonal tabular grains having an average grain size of 0.52 μm in terms of diameter equivalent to a sphere, an average grain thickness of 0.09 μm, and an average aspect ratio of 11.3. In these cases, the amounts of the compound A, potassium thiocyanate, and the spectral sensitizing dye were changed in proportion to the surface area of a grain, and the amounts of potassium hexachloroiridate (IV), potassium hexacyanoferrate (II), and potassium hexatriazoloruthenate (II) tetrahydride were changed in inverse proportion to the volume of a grain.

To each of these emulsions were added, the compound I, potassium thiocyanate, chloroauric acid, sodium thiosulfate and mono(pentafluorophenyl)diphenylphosphine selenide used in Example 1, to obtain emulsions provided with spectral sensitization and chemical sensitization. The amount of the chemical sensitizer to be added was controlled to be optimal in each emulsion. After the chemical sensitization was completed, the stabilizer S used in Example 1 was added, while changing its amount in accordance with the surface area of a grain, based on emulsion A-10r in Example 1. The resulting emulsions were designated as emulsions B-5or, B-Smr and B-5ur.

The spectral sensitizing dye was altered likewise to prepare green-sensitive emulsions B-5og, B-5mg and B-5ug, and blue-sensitive emulsions B-5ob, B-5mb and B-5ub.

Further, an emulsion was prepared in the same manner as emulsion A-10δ prepared in Example 2, except that 15.9 mg of potassium hexacyanoferrate (II) and 0.03 mg of potassium hexachloroiridate (IV) were added over the last 10 minutes before the addition was completed, and 50 ml of an aqueous solution containing 1.0 g of potassium iodide over the last two minutes before the addition was completed. The emulsion was designated as an emulsion B-6o.

The amounts of silver nitrate and sodium chloride which were added at the first of the formation of grains were changed, and the number of nuclei to be produced was altered from those adopted in the case of the emulsion B-6o, to prepare an emulsion B-6m comprising hexagonal tabular grains having an average grain size of 0.75 μm in terms of diameter equivalent to a sphere, an average grain thickness of 011 μm, and an average aspect ratio of 14.0, and an emulsion B-6u comprising hexagonal tabular grains having an average grain size of 0.52 μm in terms of diameter equivalent to a sphere, an average grain thickness of 0.9 μm, and an average aspect ratio of 11.3. In these cases, the amounts of the compound A, potassium thiocyanate, and the spectral sensitizing dye were changed in proportion to the surface area of a grain, and the amounts of potassium hexachloroiridate (IV), potassium hexacyanoferrate (II), and potassium hexatriazoloruthenate (II) tetrahydride were changed in inverse proportion to the volume of a grain.

To each of these emulsions were added, the compound I, potassium thiocyanate, chloroauric acid, sodium thiosulfate and mono(pentafluorophenyl)diphenylphosphine selenide used in Example 1, to obtain emulsions provided with spectral sensitization and chemical sensitization. The amount of the chemical sensitizer to be added was controlled to be optimal in each emulsion. After the chemical sensitization was completed, the stabilizer S was added, while changing its amount in accordance with the surface area of a grain, based on the emulsion A-10r of Example 1. The resulting emulsions were designated as emulsions B-6or, B-6mr and B-6ur.

Similarly, the spectral sensitizing dye was altered to prepare green-sensitive emulsions B-6og, B-6mg and B-6ug, and blue-sensitive emulsions B-6ob, B-6mb and B-6ub.

Next, an emulsified dispersion containing a yellow coupler and built-in type developing agent was prepared in the same manner as cyan coupler dispersion in Example 1.

8.95 g of a yellow coupler (m), 7.26 g of developing agent (n), 1.47 g of developing agent (c), 0.17 g antifogging agent (d), 0.28 g of antifogging agent (o), 18.29 g of high-boiling organic solvent (p), and 50.0 ml of ethyl acetate were dissolved at a temperature of 60° C. The resulting solution was mixed with 200 g of an aqueous solution comprising 18.0 g of lime-processed gelatin and 0.8 g of sodium dodecylbenzenesulfonate, and the mixture was emulsified and dispersed at 10,000 rpm for 20 minutes using a dissolver stirrer. After the dispersion, distilled water was added to bring the total weight to 300 g, and they were mixed at 2000 rpm for 10 minutes.

The dispersion of a magenta coupler was prepared in the same manner.

7.65 g of magenta coupler (q), 1.12 g of magenta coupler (r), 8.13 g of developing agent (b), 1.05 g of developing agent (c), 0.11 g antifogging agent (d), 7.52 g of high-boiling organic solvent (e), and 38.0 ml of ethyl acetate were dissolved at a temperature of 60° C. The resulting solution was mixed with 150 g of an aqueous solution comprising 12.2 g of lime-processed gelatin and 0.8 g of sodium dodecylbenzenesulfonate, and the mixture was emulsified and dispersed at 10,000 rpm for 20 minutes using a dissolver stirrer. After the dispersion, distilled water was added to bring the total weight to 300 g, and they were mixed at 2000 rpm for 10 minutes.

Yellow coupler (m)

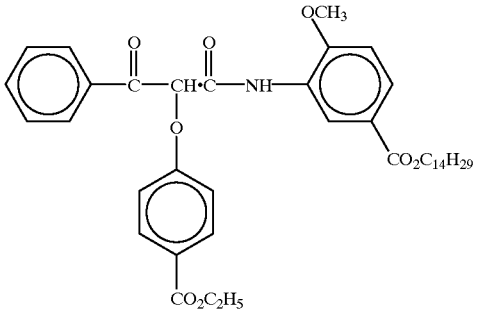

Further, dispersion of a dye to color an inter layer as a filter layer was prepared in the same manner.

The dye and the high-boiling organic solvent used to disperse the dye were shown below.

Yellow dye (t)

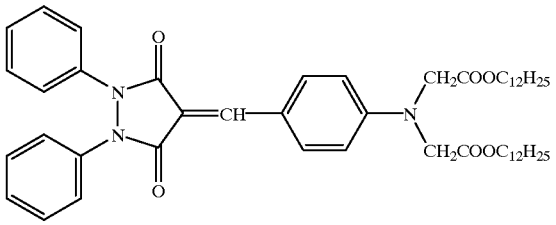

-continued

High-boiling organic solvent (u)
A mixture in 1:1 of

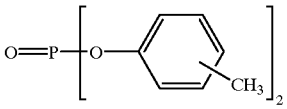

Ajinomoto
EMPARA K65

Magenta dye (v)

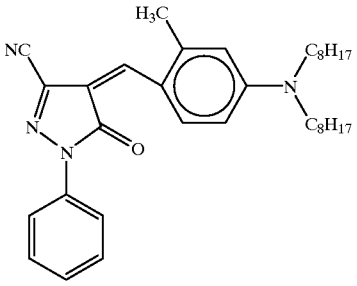

Formaldehyde scavenger (s)

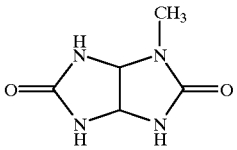

Samples 301 to 306 of a multi-layer color photographic light-sensitive material were prepared by coating, in combination, these dispersions and the silver halide emulsions prepared in the above, on a support, with the configuration shown in Table 1.

TABLE 7

| | Sample 301 | Sample 302 | Sample 303 | Sample 304 | Sample 305 | Sample 306 |
|---|---|---|---|---|---|---|
| Protective layer | | | | | | |
| Lime-processed gelatin | 914 | 914 | 914 | 914 | 914 | 914 |
| Matting agent(silica) | 50 | 50 | 50 | 50 | 50 | 50 |
| Surfactant(i) | 30 | 30 | 30 | 30 | 30 | 30 |
| Surfactant(j) | 40 | 40 | 40 | 40 | 40 | 40 |
| Water soluble polymer(k) | 15 | 15 | 15 | 15 | 15 | 15 |
| Hardener(l) | 110 | 110 | 110 | 110 | 110 | 110 |
| Interlayer | | | | | | |
| Lime-processed gelatin | 461 | 461 | 461 | 461 | 461 | 461 |
| Surfactant(j) | 5 | 5 | 5 | 5 | 5 | 5 |
| Zinc hydroxide | 340 | 340 | 340 | 340 | 340 | 340 |
| Formaldehyde scavenger(s) | 300 | 300 | 300 | 300 | 300 | 300 |
| Water soluble polymer(k) | 15 | 15 | 15 | 15 | 15 | 15 |
| Yellow color-forming layer (high-sensitivity layer) | | | | | | |
| Lime-processed gelatin | 1750 | 1750 | 1750 | 1750 | 1750 | 1750 |
| Emulsion(in terms of coating amount of silver) | B-1ob 525 | B-2ob 525 | B-3ob 525 | B-4ob 525 | B-5ob 525 | B-6ob 525 |

TABLE 7-continued

| | Sample 301 | Sample 302 | Sample 303 | Sample 304 | Sample 305 | Sample 306 |
|---|---|---|---|---|---|---|
| Yellow coupler(m) | 298 | 298 | 298 | 298 | 298 | 298 |
| Developing agent(n) | 242 | 242 | 242 | 242 | 242 | 242 |
| Developing agent(c) | 50 | 50 | 50 | 50 | 50 | 50 |
| Antifogging agent(d) | 5.8 | 5.8 | 5.8 | 5.8 | 5.8 | 5.8 |
| Antifogging agent(o) | 9.5 | 9.5 | 9.5 | 9.5 | 9.5 | 9.5 |
| High-boiling organic solvent(p) | 500 | 500 | 500 | 500 | 500 | 500 |
| Surfactant(f) | 27 | 27 | 27 | 27 | 27 | 27 |
| Water soluble polymer(k) | 1 | 1 | 1 | 1 | 1 | 1 |
| Yellow color-forming layer (medium-sensitivity layer) | | | | | | |
| Lime-processed gelatin | 1400 | 1400 | 1400 | 1400 | 1400 | 1400 |
| Emulsion(in terms of coating amount of silver) | B-1mb 211 | B-2mb 211 | B-3mb 211 | B-4mb 211 | B-5mb 211 | B-6mb 211 |
| Yellow coupler(m) | 277 | 277 | 277 | 277 | 277 | 277 |
| Developing agent(n) | 225 | 225 | 225 | 225 | 225 | 225 |
| Developing agent(c) | 46 | 46 | 46 | 46 | 46 | 46 |
| Antifogging agent(d) | 5.3 | 5.3 | 5.3 | 5.3 | 5.3 | 5.3 |
| Antifogging agent(o) | 8.8 | 8.8 | 8.8 | 8.8 | 8.8 | 8.8 |
| High-boiling organic solvent(p) | 566 | 566 | 566 | 566 | 566 | 566 |
| Surfactant(f) | 25 | 25 | 25 | 25 | 25 | 25 |
| Water soluble polymer(k) | 2 | 2 | 2 | 2 | 2 | 2 |
| Yellow color-forming layer (low-sensitivity layer) | | | | | | |
| Lime-processed gelatin | 1400 | 1400 | 1400 | 1400 | 1400 | 1400 |
| Emulsion(in terms of coating amount of silver) | B-1ub 250 | B-2ub 250 | B-3ub 250 | B-4ub 250 | B-5ub 250 | B-6ub 250 |
| Yellow coupler(m) | 277 | 277 | 277 | 277 | 277 | 277 |
| Developing agent(n) | 225 | 225 | 225 | 225 | 225 | 225 |
| Developing agent(c) | 46 | 46 | 46 | 46 | 46 | 46 |
| Antifogging agent(d) | 5.3 | 5.3 | 5.3 | 5.3 | 5.3 | 5.3 |
| Antifogging agent(o) | 8.8 | 8.8 | 8.8 | 8.8 | 8.8 | 8.8 |
| High-boiling organic solvent(p) | 566 | 566 | 566 | 566 | 566 | 566 |
| Surfactant(f) | 25 | 25 | 25 | 25 | 25 | 25 |
| Water soluble polymer(k) | 2 | 2 | 2 | 2 | 2 | 2 |
| Interlayer (yellow filter layer) | | | | | | |
| Lime-processed gelatin | 560 | 560 | 560 | 560 | 560 | 560 |
| Surfactant(f) | 15 | 15 | 15 | 15 | 15 | 15 |
| Surfactant(j) | 24 | 24 | 24 | 24 | 24 | 24 |
| dye(t) | 85 | 85 | 85 | 85 | 85 | 85 |
| High-boiling organic solvent(u) | 85 | 85 | 85 | 85 | 85 | 85 |
| Zinc hydroxide | 125 | 125 | 125 | 125 | 125 | 125 |
| Water soluble polymer(k) | 15 | 15 | 15 | 15 | 15 | 15 |
| Magenta color-forming layer (high-sensitivity layer) | | | | | | |
| Lime-processed gelatin | 781 | 781 | 781 | 781 | 781 | 781 |
| Emulsion(in terms of coating amount of silver) | B-1og 892 | B-2og 892 | B-3og 892 | B-4og 892 | B-5og 892 | B-6og 892 |
| Magenta coupler(q) | 80 | 80 | 80 | 80 | 80 | 80 |
| Magenta coupler(r) | 12 | 12 | 12 | 12 | 12 | 12 |
| Developing agent(b) | 85 | 85 | 85 | 85 | 85 | 85 |
| Developing agent(c) | 11 | 11 | 11 | 11 | 11 | 11 |
| Antifogging agent(d) | 1.2 | 1.2 | 1.2 | 1.2 | 1.2 | 1.2 |
| High-boiling organic solvent(e) | 79 | 79 | 79 | 79 | 79 | 79 |
| Surfactant(f) | 8 | 8 | 8 | 8 | 8 | 8 |
| Water soluble polymer(k) | 8 | 8 | 8 | 8 | 8 | 8 |

TABLE 7-continued

| | Sample 301 | Sample 302 | Sample 303 | Sample 304 | Sample 305 | Sample 306 |
|---|---|---|---|---|---|---|
| Magenta color-forming layer (medium-sensitivity layer) | | | | | | |
| Lime-processed gelatin | 659 | 659 | 659 | 659 | 659 | 659 |
| Emulsion | B-1mg 669 | B-2mg 669 | B-3mg 669 | B-4mg 669 | B-5mg 669 | B-6mg 669 |
| Magenta coupler(q) | 103 | 103 | 103 | 103 | 103 | 103 |
| Magenta coupler(r) | 15 | 15 | 15 | 15 | 15 | 15 |
| Developing agent(b) | 110 | 110 | 110 | 110 | 110 | 110 |
| Developing agent(c) | 14 | 14 | 14 | 14 | 14 | 14 |
| Antifogging agent(d) | 1.5 | 1.5 | 1.5 | 1.5 | 1.5 | 1.5 |
| High-boiling organic solvent(e) | 102 | 102 | 102 | 102 | 102 | 102 |
| Surfactant(f) | 11 | 11 | 11 | 11 | 11 | 11 |
| Water soluble polymer(k) | 14 | 14 | 14 | 14 | 14 | 14 |
| Magenta color-forming layer (low-sensitivity layer) | | | | | | |
| Lime-processed gelatin | 711 | 711 | 711 | 711 | 711 | 711 |
| Emulsion | B-1ug 235 | B-2ug 235 | B-3ug 235 | B-4ug 235 | B-5ug 235 | B-6ug 235 |
| Magenta coupler(q) | 274 | 274 | 274 | 274 | 274 | 274 |
| Magenta coupler(r) | 40 | 40 | 40 | 40 | 40 | 40 |
| Developing agent(b) | 291 | 291 | 291 | 291 | 291 | 291 |
| Developing agent(c) | 38 | 38 | 38 | 38 | 38 | 38 |
| Antifogging agent(d) | 3.9 | 3.9 | 3.9 | 3.9 | 3.9 | 3..9 |
| High-boiling organic solvent(e) | 269 | 269 | 269 | 269 | 269 | 269 |
| Surfactant(f) | 29 | 29 | 29 | 29 | 29 | 29 |
| Water soluble polymer(k) | 14 | 14 | 14 | 14 | 14 | 14 |
| Interlayer (magenta filter layer) | | | | | | |
| Lime-processed gelatin | 850 | 850 | 850 | 850 | 850 | 850 |
| Surfactant(f) | 15 | 15 | 15 | 15 | 15 | 15 |
| Surfactant(j) | 24 | 24 | 24 | 24 | 24 | 24 |
| Dye(v) | 200 | 200 | 200 | 200 | 200 | 200 |
| High-boiling organic solvent(h) | 200 | 200 | 200 | 200 | 200 | 200 |
| Formaldehyde scavenger(s) | 300 | 300 | 300 | 300 | 300 | 300 |
| Zinc hydroxide | 2028 | 2028 | 2028 | 2028 | 2028 | 2028 |
| Water soluble polymer(k) | 15 | 15 | 15 | 15 | 15 | 15 |
| Cyan color-forming layer (high-sensitivity layer) | | | | | | |
| Lime-processed gelatin | 842 | 842 | 842 | 842 | 842 | 842 |
| Emulsion | B-1or 1040 | B-2or 1040 | B-3or 1040 | B-4or 1040 | B-5or 1040 | B-6or 1040 |
| Cyan coupler(a) | 64 | 64 | 64 | 64 | 64 | 64 |
| Developing agent(b) | 75 | 75 | 75 | 75 | 75 | 75 |
| Developing agent(c) | 6 | 6 | 6 | 6 | 6 | 6 |
| Antifogging agent(d) | 0.9 | 0.9 | 0.9 | 0.9 | 0.9 | 0.9 |
| High-boiling organic solvent(e) | 49 | 49 | 49 | 49 | 49 | 49 |
| Surfactant(f) | 5 | 5 | 5 | 5 | 5 | 5 |
| Water soluble polymer(k) | 18 | 18 | 18 | 18 | 18 | 18 |
| Cyan color-forming layer (medium-sensitivity layer) | | | | | | |
| Lime-processed gelatin | 475 | 475 | 475 | 475 | 475 | 475 |
| Emulsion | B-1mr 602 | B-2mr 602 | B-3mr 602 | B-4mr 602 | B-5mr 602 | B-6mr 602 |
| Cyan coupler(a) | 134 | 134 | 134 | 134 | 134 | 134 |
| Developing agent(b) | 102 | 102 | 102 | 102 | 102 | 102 |
| Developing agent(c) | 13 | 13 | 13 | 13 | 13 | 13 |
| Antifogging agent(d) | 1.9 | 1.9 | 1.9 | 1.9 | 1.9 | 1.9 |
| High-boiling organic solvent(e) | 103 | 103 | 103 | 103 | 103 | 103 |

TABLE 7-continued

| | Sample 301 | Sample 302 | Sample 303 | Sample 304 | Sample 305 | Sample 306 |
|---|---|---|---|---|---|---|
| Surfactant(f) | 10 | 10 | 10 | 10 | 10 | 10 |
| Water soluble polymer(k) | 15 | 15 | 15 | 15 | 15 | 15 |
| Cyan color-forming layer (low-sensitivity layer) | | | | | | |
| Lime-processed gelatin | 825 | 825 | 825 | 825 | 825 | 825 |
| Emulsion | B-1ur 447 | B-2ur 447 | B-3ur 447 | B-4ur 447 | B-5ur 447 | B-6ur 447 |
| Cyan coupler(a) | 234 | 234 | 234 | 234 | 234 | 234 |
| Developing agent(b) | 179 | 179 | 179 | 179 | 179 | 179 |
| Developing agent(c) | 23 | 23 | 23 | 23 | 23 | 23 |
| Antifogging agent(d) | 3.3 | 3.3 | 3.3 | 3.3 | 3.3 | 3.3 |
| High-boiling organic solvent(e) | 179 | 179 | 179 | 179 | 179 | 179 |
| Surfactant(f) | 17 | 17 | 17 | 17 | 17 | 17 |
| Water soluble polymer(k) | 10 | 10 | 10 | 10 | 10 | 10 |
| Halation prevention layer | | | | | | |
| Lime-processed gelatin | 440 | 440 | 440 | 440 | 440 | 440 |
| Surfactant(f) | 14 | 14 | 14 | 14 | 14 | 14 |
| Dye(g) | 260 | 260 | 260 | 260 | 260 | 260 |
| High-boiling organic solvent(h) | 260 | 260 | 260 | 260 | 260 | 260 |
| Water soluble polymer(k) | 15 | 15 | 15 | 15 | 15 | 15 |
| Dye contained PEN base (96 μm) | | | | | | |

*Figure represents the coating amount (mg/m$^2$)

Test specimens were cut from these light-sensitive materials, and exposed to light at an intensity of 200 lux for 1/100 seconds through an optical wedge, in the same condition as in Example 1.

15 ml/m$^2$ of 40° C. hot water was supplied to the surface of the light-sensitive material after the exposure. The film surfaces of the test specimen and processing material P-1 were overlapped on each other, and thereafter thermally developed at 86° C. for 17 seconds by using a heat drum. 10 ml/m$^2$ of water was applied to the surface of the light-sensitive material from which P-1 had been peeled off. A processing material P-2 was overlapped on the surface of the light-sensitive material, and they were further heated at 50° C. for 30 seconds.

On the test specimen of the light-sensitive material that was peeled from the processing material, a gray color-developed image corresponding to the exposure had been formed. The R-, G- and B-transmission density of the color-developed test specimen obtained after the thermal development was measured, to make so-called characteristic curves, from which minimum density (fog density), relative sensitivity, and contrast, corresponding to each of blue-, green-, and red-sensitive layers were calculated. As to the sensitivity, the reciprocal of exposure amount giving a density 0.15 higher than the minimum density after the treatment, in terms of optical density, was determined as the sensitivity, and the sensitivity found was shown in terms of relative value by assuming the sensitivity of each layer of the sample 301 to be 100. Contrast was expressed by an inclination (γ) between the point where the sensitivity was calculated and the point where the density was 2.0 on the characteristic curve.

The results are shown in Table 8.

TABLE 8

| | Sample 301 | | | Sample 302 | | | Sample 303 | | | Sample 304 | | | Sample 305 | | | Sample 306 | | |
|---|---|---|---|---|---|---|---|---|---|---|---|---|---|---|---|---|---|---|
| | B | G | R | B | G | R | B | G | R | B | G | R | B | G | R | B | G | R |
| Minimum density (Fogging density) | 0.41 | 0.30 | 0.22 | 0.42 | 0.29 | 0.23 | 0.40 | 0.28 | 0.22 | 0.33 | 0.25 | 0.21 | 0.31 | 0.22 | 0.19 | 0.30 | 0.21 | 0.19 |
| Relative sensitivity | 100 | 100 | 100 | 128 | 134 | 136 | 138 | 144 | 147 | 102 | 108 | 109 | 129 | 137 | 140 | 142 | 152 | 155 |
| Contrast | 0.45 | 0.59 | 0.61 | 0.78 | 0.84 | 0.92 | 0.80 | 0.86 | 0.94 | 0.52 | 0.63 | 0.65 | 0.81 | 0.92 | 0.96 | 0.83 | 0.93 | 0.98 |
| Remarks | Comparative example | | | This invention | | | This invention | | | Comparative example | | | This invention | | | This invention | | |

From these results, it is understood that the effects of the present invention were attained even in multilayer color photographic light-sensitive materials. Specifically, comparing sample 301 with samples 302 and 303, sample 301 constituted of the emulsion using no metal complex dopant for use in the present invention, had low sensitivity and contrast, whereas samples 302 and 303 using the emulsion using the metal complex dopant for use in the present invention, produced high sensitivity and high contrast.

Also, in samples 304 and 306 using tabular grains comprising high silver chloride, the effects obtained by using the metal complex dopant for use in the present invention were observed significantly.

Example 4

The structures of the metal complexes used in Examples 4 to 6 are shown below.

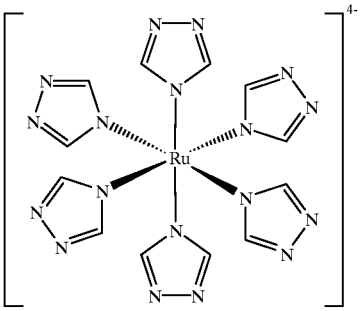

$[Ru(trz)_6]^{4-}$

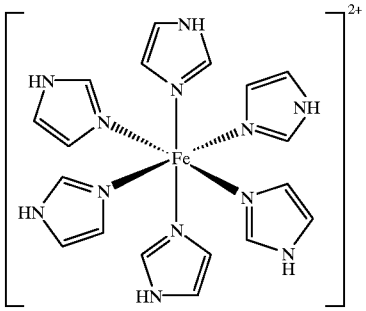

$[Fe(Im)_6]^{2+}$

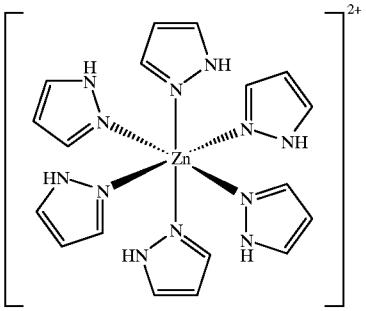

$[Zn(pz)_6]^{2+}$

-continued

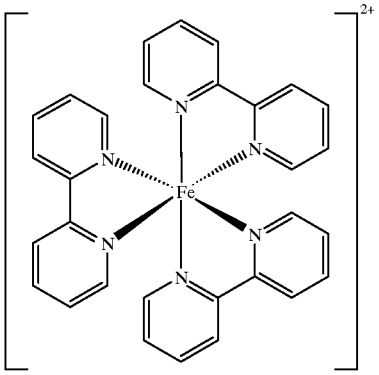

$[Fe(bpy)_3]^{2+}$

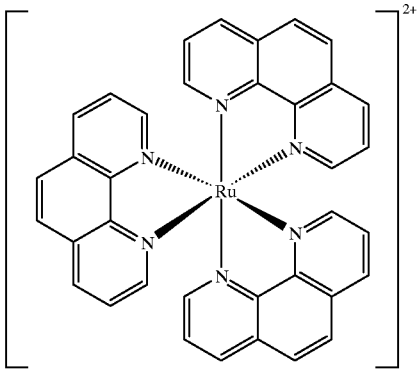

$[Ru(phen)_3]^{2+}$

| Compound | The number of the ligand of the heterocyclic compound, in the coordination number of the metal atom |
|---|---|
| $[Ru(trz)_6]^{4-}$ | 6/6 |
| $[Fe(Im)_6]^{2+}$ | 6/6 |
| $[Zn(pz)_4]^{2+}$ | 6/6 |
| $[Fe(bpy)_3]^{2+}$ | 6/6 (bidentate) |
| $[Ru(phen)_3]^{2+}$ | 6/6 (bidentate) |

(1) Preparation of Emulsions

Tabular silver iodobromide emulsion 1-A (emulsion for comparison)

(Preparation of Seed Crystals)

1600 cc of an aqueous solution containing 8.3 g of gelatin having a low molecular weight (molecular weight: 15,000) and 4.3 g of KBr was stirred while being kept at 40° C. To this solution, 41 cc of a 1.2 M $AgNO_3$ aqueous solution and 41 cc of a 1.26 M KBr aqueous solution containing 4.3 mol % of KI were simultaneously added in 40 seconds by a double jet method. Then, 36 g of gelatin (lime-treated gelatin) was added and the temperature of the reaction mixture was raised to 58° C. in 20 minutes. After the pAg of the reaction mixture was adjusted to 8.44, the reaction mixture was ripened for 15 minutes by the addition of ammonia and thereafter neutralized. Next, 647 cc of a 1.9 M $AgNO_3$ aqueous solution and a 1.9 M KBr aqueous solution were simultaneously added in 55 minutes by accelerating the flow rate (final flow rate was 5 times the initial flow rate) while keeping pAg at 8.10. After that, the temperature of the reaction mixture of emulsion was lowered to 35° C., and thereafter the reaction mixture was washed with water according to a usual flocculation method. After the water washing step, 49 g of gelatin was added and dispersed in the flocculation product, which was then adjusted to pH: 6.2 and pAg: 8.9 and was kept in a housing.

(Grain Growth)

To 48 g of the above-described seed crystals containing silver iodobromide in an amount corresponding to 9.3 g of $AgNO_3$, 1145 cc of water and 36 g of gelatin (lime-treated gelatin) were added and the reaction mixture was adjusted to pH: 5.5 and pAg: 8.44 while being kept at 75° C. and stirred. After that, 479 cc of a 1.9 M $AgNO_3$ aqueous solution and a 1.7 M KBr aqueous solution containing 2.7 mol % of KI were added simultaneously in 48 minutes by accelerating the flow rate (final flow rate was 2.4 times the initial flow rate) while keeping pAg at 8.29. Further, 50 cc of a 1.9 M $AgNO_3$ aqueous solution and a 1.9 M KBr aqueous solution were added simultaneously in 5 minutes at a constant flow rate while keeping pAg at 8.44. The temperature of the reaction mixture was then lowered to 40° C. in 25 minutes and an aqueous solution containing 10.5 g of sodium p-iodoacetamidobenzene sulfonate (monohydrate), serving as an iodide-ion-releasing agent, was added. Then, 40 cc of a 0.8 M sodium sulfite was added in 1 minute at a constant flow rate to thereby grow iodide ions while controlling the pH to 9.0. Two minutes later, the temperature of the reaction mixture was raised to 55° C. in 15 minutes and the pH was returned to 5.5. Next, sodium benzenethiosulfonate and $K_2IrCl_6$ were each added as a solution in amounts of $3.8\times10^{-6}$ mol/mol of silver and $1\times10^{-8}$ mol/mol of silver, respectively, relative to the total amount of silver of the grains. After that, 269 cc of a 1.9 M $AgNO_3$ aqueous solution and a 1.9 M KBr aqueous solution containing no dopant were added simultaneously in 30 minutes at a constant flow rate while keeping pAg at 8.59.

(Washing, Dispersing)

Then, the resulting emulsion was cooled to 35° C., and the emulsion was washed with water by a usual flocculation method. Then the pH was raised, 75 g of gelatin (lime-processed gelatin) was added to disperse the emulsion, and then, pH and pAg were adjusted respectively to 5.8 and 8.9, and the resultant emulsion was collected in a housing.

Photographs of the grains of the emulsion were taken under a transmission electron microscope using a replica method and measurements of shapes were conducted with 1000 grains (the same method was used for the following emulsions 1-B~1-H).

In the emulsion obtained, the percentage of tabular grains was 98%(in number) or more of the total grains and the percentage of the projected area taken up by the tabular grains in the total projected area of all the grains was more than 99% (the same results were obtained in the following emulsions 1-B~1-H).

The average equivalent-sphere diameter of the total grains was 1.20 μm (the same results were obtained in the following emulsions 1-B~1-H), the average equivalent-circle diameter of the total tabular grains was 1.90 μm, the average grain thickness of the total tabular grains was 0.317 μm, and the average aspect ratio of the total tabular grains was 6.0.

Further, the dislocation line was observed (positions of introduction, density, and distribution) by a high-voltage transmission electron microscope (accelerated voltage: 400 kV), regarding 200 grains in the emulsion, in the manner as described in this text (the observation was conducted at specimen inclination angles of −10°, −5°, 0°, +5° and +10° for each grain; and the same method was used for the following emulsions 1-B~1-H, too).

In the emulsion obtained, the percentage (in number) of the tabular grains containing 10 or more dislocation lines per grain substantially only in grain fringes was 80% or more of the total grains. Tabular silver iodobromide emulsion 1-B (emulsion for comparison)

The tabular silver iodobromide emulsion 1-B was prepared in the same way as in the preparation of the emulsion 1-A but with the exceptions described below.

In the preparation of the emulsion 1-A (grain growth), in place of the 1.9 M KBr aqueous solution containing no dopant, a 1.9 M KBr aqueous solution, which contained $[Ru(trz)_6]^{4-}$ (trz=1,2,4-triazole) in an amount of $1\times10^{-5}$ mol/mol of silver relative to the total amount of silver of the grains, was used and added simultaneously with 269 cc of the 1.9 M $AgNO_3$ aqueous solution.

The shape, structure, halogen composition, configuration of dislocation lines, and the like of the grains obtained were the same as those of the emulsion 1-A. Tabular silver iodobromide emulsion 1-C (emulsion for comparison)

The tabular silver iodobromide emulsion 1-C was prepared in the same way as in the preparation of the emulsion 1-A but with the exceptions described below.

In the preparation of the emulsion 1-A (seed crystals preparing step), 647 cc of the 1.9 M $AgNO_3$ aqueous solution and the 1.9 M KBr aqueous solution were added by accelerating the flow rate, while keeping the pAg at 8.58 instead of 8.10.

Further, in the preparation of the emulsion 1-A (grain growth), 479 cc of the 1.9 M $AgNO_3$ aqueous solution and the 1.7 M KBr aqueous solution containing 2.7 mol % of KI were added by accelerating the flow rate, while keeping the pAg at 8.58 instead of 8.29.

As to the grain shapes, the average equivalent-circle diameter of the total tabular grains was 2.10 μm, the average grain thickness of the total tabular grains was 0.260 μm, and the average aspect ratio of the total tabular grains was 8.0.

In the emulsion obtained, the percentage (in number) of the tabular grains having 10 or more dislocation lines per grain substantially only in grain fringes was 80% or more of the total grains.

Tabular silver iodobromide emulsion 1-D (emulsion of this invention)

The tabular silver iodobromide emulsion 1-D was prepared in the same way as in the preparation of the emulsion 1-A but with the exceptions described below.

In the preparation of the emulsion 1-A (seed crystals preparing step), 647 cc of the 1.9 M $AgNO_3$ aqueous solution and the 1.9 M KBr aqueous solution were added by accelerating the flow rate, while keeping the pAg at 8.58 instead of 8.10.

Further, in the preparation of the emulsion 1-A (grain growth), 479 cc of the 1.9 M $AgNO_3$ aqueous solution and the 1.7 M KBr aqueous solution containing 2.7 mol % of KI were added by accelerating the flow rate, while keeping the pAg at 8.58 instead of 8.29.

Further, in the preparation of the emulsion 1-A (grain growth), in place of the 1.9 M KBr aqueous solution containing no dopant, a 1.9 M KBr aqueous solution, which contained $[Ru(trz)_6]^{4-}$ (trz=1,2,4-triazole) in an amount of $1\times10^{-5}$ mol/mol of silver relative to the total amount of silver of the grains, was used and added simultaneously with 269 cc of the 1.9 M $AgNO_3$ aqueous solution.

The shape, structure, halogen composition, configuration of dislocation lines, and so on of the grains obtained were the same as those of the emulsion 1-C. Tabular silver iodobromide emulsion l-E (emulsion for comparison)

(Nucleation and Grain Growth)

1200 cc of an aqueous solution containing 6.2 g of gelatin having a low molecular weight (molecular weight: 15,000) and 6.4 g of KBr was stirred while being kept at 35° C. To this solution, 43 cc of a 0.1 M $AgNO_3$ aqueous solution and 43 cc of a 0.1 M KBr aqueous solution were simultaneously added in 5 seconds by a double jet method. After that, 38 g of gelatin (lime-treated gelatin) was added and the reaction mixture was heated to 75° C. in 35 minutes and was ripened for 15 minutes at that temperature. Next, 608 cc of a 1.9 M $AgNO_3$ aqueous solution and a 1.9 M KBr aqueous solution containing 1 mol % of KI were simultaneously added in 100 minutes by accelerating the flow rate (final flow rate was 11 times the initial flow rate) while keeping pAg at 8.07.

The temperature of the reaction mixture was then lowered to 40° C. in 25 minutes and an aqueous solution containing 12.7 g of sodium p-iodoacetamidobenzene sulfonate (monohydrate), serving as an iodide ions releasing agent, was added. Then, 50 cc of a 0.8 M aqueous sodium sulfite solution was added in 1 minute at a constant flow rate to thereby grow iodide ions while controlling the pH to 9.0. Two minutes later, the temperature of the reaction mixture was raised to 55° C. in 15 minutes and the pH was returned to 5.5. Next, sodium benzenethiosulfonate and $K_2IrCl_6$ were each added as a solution in amounts of $3.8\times10^{-6}$mol/mol of silver and $1\times10^{-8}$ mol/mol of silver, respectively, relative to the total amount of silver of the grains. After that, 100 cc of an aqueous solution containing 12 g of gelatin (lime-processed gelatin) was added thereto, and 269 cc of a 1.9 M $AgNO_3$ aqueous solution and a 1.9 M KBr aqueous solution containing no dopant were added simultaneously in 30 minutes at a constant flow rate while keeping pAg at 8.59.

(Water-washing and Dispersing)

Water-washing and dispersing were carried out in the same way as in the preparation of the emulsion 1-A.

Details of the grains obtained are described below.

In the emulsion obtained, 98% or more of the projected area of the total grains was made up of tabular grains each having an aspect ratio of 8 or more.

The percentage of the projected area of hexagonal tabular grains having a ratio between neighboring sides (i.e., the ratio of the length of the longest side to the length of the shortest side) of 1.2 to 1 was 80% or more of the projected area of total grains in the emulsion.

The average equivalent-circle diameter of the total tabular grains was 2.52 μm, the average grain thickness of the total tabular grains was 0.180 μm, and the average aspect ratio of the total tabular grains was 14.0.

The variation coefficient of the distribution of equivalent-sphere diameters of the total silver halide grains was 11%, the variation coefficient of the distribution of equivalent-circle diameters of the total tabular grains was 12%, and the variation coefficient of the distribution of the grain thicknesses of the total tabular grains was 12%.

The variation coefficient of the inter-grain distribution of silver iodide contents, measured with 200 grains by the method using EPMA, as described in European Patent No. 147,868 and so on, was 11%.

In the emulsion obtained, the percentage (in number) of the tabular grains having 30 or more dislocation lines per grain substantially only in grain fringes was 80% or more of the total grains.

The intra-grain distribution of silver iodide contents was measured with 20 grains by the method using an analytical electron microscope, as described in JP-A-7-219102, at 50 nm intervals of electron beam spots. According to the results, the grain fringe region was about 0.15 μm on average, the average silver iodide content in grain central portion was 1.0 mol %, and the average silver iodide content in grain fringe was 5.5 mol %.

Proportions of planes of grain surface of the obtained emulsion were measured by the method described in T. Tani, J. Imaging Sci., 29, 165 (1985) and the proportion of the {100} plane to the {111} plane was found to be 4.4%. Further, the proportion of the {100} plane in tabular grain edges, obtained by the method described in JP-A-8-334850, was 36%.

Tabular silver iodobromide emulsion 1-F (emulsion of the present invention)

The tabular silver iodobromide emulsion 1-F was prepared in the same way as in the preparation of the emulsion 1-E but with the exceptions described below.

In the preparation of the emulsion l-E (nucleation grain growth), in place of the 1.9 M KBr aqueous solution containing no dopant, a 1.9 M KBr aqueous solution, which contained $[Ru(trz)_6]^{4-}$ (trz=1,2,4-triazole) in an amount of $1\times10^{-5}$ mol/mol of silver relative to the total amount of silver of the grains, was used and added simultaneously with 269 cc of the 1.9 M $AgNO_3$ aqueous solution.

The shape, structure, halogen composition, configuration of dislocation lines, and the like of the grains obtained were the same as those of the emulsion 1-E.

The silver halide grains in the emulsion 1-F of the present invention was observed by a transmission electron microscope. The photograph of the tabular silver iodobromide grains of the emulsion 1-F of the present invention taken by a transmission electron microscope is shown in FIG. 1. The silver halide grains in the emulsion 1-F were confirmed that they were hexagonal tabular silver iodobromide grains, in which dislocation lines were randomly arranged only in a fringe region within about 0.15 μm from the grain edge. The number of the dislocation lines was 30 or more per grain.

Tabular silver iodobromide emulsion 1-G (emulsion for comparison)

The tabular silver iodobromide emulsion 1-G was prepared in the same way as in the preparation of the emulsion 1-E but with the exceptions described below.

In the preparation of the emulsion 1-E (nucleation and grain growth), 45 g of trimellitic acid-treated gelatin was added in place of the addition of 38 of the gelatin (lime-treated gelatin).

Further, 608 cc of the 1.9 M $AgNO_3$ aqueous solution and the 1.9 M KBr aqueous solution containing 1 mol % of KI were simultaneously added in 100 minutes by accelerating the flow rate, while keeping the pAg at 8.50 instead of 8.07.

As to the grain shapes, the average equivalent-circle diameter of the total tabular grains was 3.02 μm, the average grain thickness of the total tabular grains was 0.126 μm, and the average aspect ratio of the total tabular grains was 24.0.

In the emulsion obtained, the percentage (in number) of the tabular grains having 10 or more dislocation lines per grain substantially only in grain fringes was 60% or more of the total grains.

Tabular silver iodobromide emulsion 1-H (emulsion of the present invention)

The tabular silver iodobromide emulsion 1-H was prepared in the same way as in the preparation of the emulsion 1-E but with the exceptions described below.

In the preparation of the emulsion 1-E (nucleation and grain growth), 45 g of trimellitic acid-treated gelatin was added in place of the addition of 38 of the gelatin (lime-treated gelatin).

Further, 608 cc of the 1.9 M $AgNO_3$ aqueous solution and the 1.9 M KBr aqueous solution containing 1 mol % of KI were simultaneously added in 100 minutes by accelerating the flow rate, while keeping the pAg at 8.50 instead of 8.07.

Further, in place of the 1.9 M KBr aqueous solution containing no dopant, a 1.9 M KBr aqueous solution, which contained $[Ru(trz)_6]^{4-}$ (trz=1,2,4-triazole) in an amount of $1\times10^{-5}$ mol/mol of silver relative to the total amount of silver of the grains, was used and added simultaneously with 269 cc of the 1.9 M $AgNO_3$ aqueous solution.

The shape, structure, halogen composition, and so on of the grains obtained were the same as those of the emulsion 1-G. In the emulsion obtained, the percentage (in number) of the tabular grains having 10 or more dislocation lines per grain substantially only in grain fringes was 75% or more of the total grains.

(2) Chemical Sensitization

Under a condition in which temperature was 56° C., pH was 5.8 and pAg was 8.4, the spectral sensitization and chemical sensitization of the emulsions 1-A ~1-H were performed by adding the following red-sensitive spectral sensitizing dyes I, II and III to red-sensitive emulsions, the following green-sensitive spectral sensitizing dyes IV, V and VI to green-sensitive emulsions, and the following blue-sensitive spectral sensitizing dye VII to blue-sensitive emulsions; by adding thereafter a mixed solution composed of potassium thiocyanate and chloroauric acid; and by finally adding sodium thiosulfate, a selenium sensitizer, and the following compound I. The chemical sensitization was stopped by using the following mercapto compound. When added, the amounts of the spectral sensitizing dyes and the chemical sensitizers were controlled so that the sensitivity of each of the emulsions at 1/100 second exposure became a maximum. The sensitivity was expressed as the logarithmic value of the reciprocal of an exposing light amount providing a density higher than fog density by 0.15 on the characteristic curve to be obtained by subjecting light-sensitive materials to exposure and development as described later. As shown in tables given later, the emulsions were designated by adding a suffix r, g, or b according to the spectral sensitizing dye employed.

Sensitizing dye I for red-sensitive emulsion

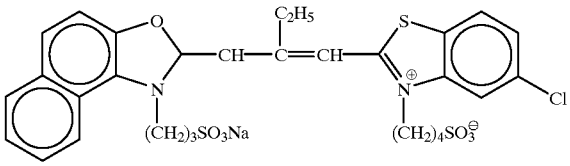

Sensitizing dye II for red-sensitive emulsion

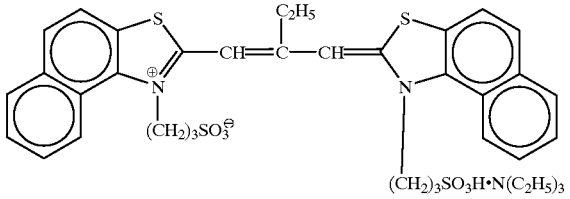

-continued

Sensitizing dye III for red-sensitive emulsion

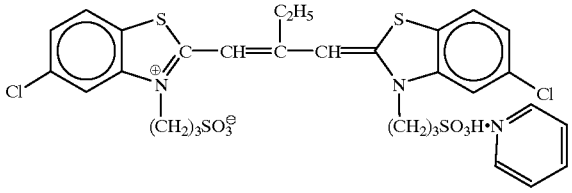

Sensitizing dyes I:II:III = 40:2:58
for red-sensitive emulsion (molar ratio)

Sensitizing dye IV for green-sensitive emulsion

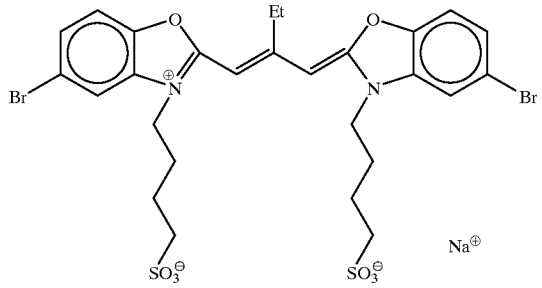

Sensitizing dye V for green-sensitive emulsion

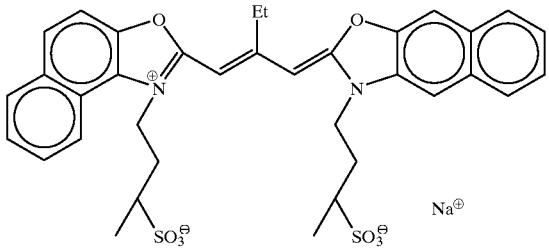

Sensitizing dye VI for green-sensitive emulsion

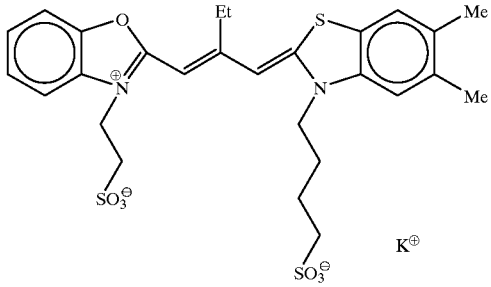

Sensitizing dyes IV:V:VI = 77:20:3
for green-sensitive emulsion (molar ratio)

Sensitizing dye VII for blue-sensitive emulsion

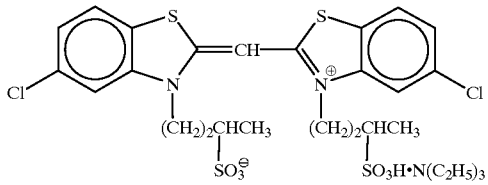

Compound I

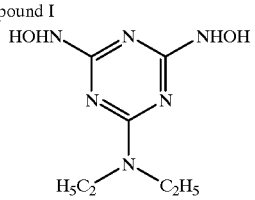

-continued

Selenium sensitizer

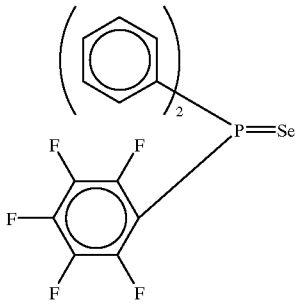

Mercapto compound

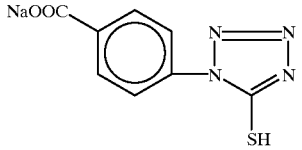

(3) Preparation and Evaluation of a Dispersion and a Coated Sample

<Preparation of a dispersion of zinc hydroxide (for the fifth and twelfth layers)>

A dispersion of zinc hydroxide used as a base precursor was prepared in the following manner.

31 g of zinc hydroxide powder, whose primary particles had a grain size of 0.2 $\mu$m, 1.6 g of carboxymethyl cellulose and 0.4 g of sodium polyacrylate, as a dispersant, 8.5 g of lime-processed ossein gelatin, and 158.5 ml of water were mixed together, and the mixture was dispersed by a mill containing glass beads for 1 hour. After dispersion, the glass beads were filtered off, to obtain 188 g of a dispersion of zinc hydroxide.

<Preparation of emulsified dispersion of developing agent and coupler>

(1) Emulsified Dispersion of Developing Agent and Yellow Coupler 10 g of a yellow coupler YC−1, 8.2 g of developing agent (1), 1.6 g of developing agent (2), 21 g of high-boiling organic solvent (1), and 50.0 ml of ethyl acetate were dissolved at a temperature of 60° C. (II-liquid). The resulting solution (II-liquid) was mixed with 170 g of an aqueous solution (I-liquid) comprising 12 g of lime-processed gelatin and 1 g of surfactant (1), and the mixture was emulsified and dispersed at 10,000 rpm for 20 minutes using a dissolver stirrer. After dispersion, distilled water was added to bring the total weight to 300 g, and they were mixed at 2000 rpm for 10 minutes.

Yellow coupler YC-(1)

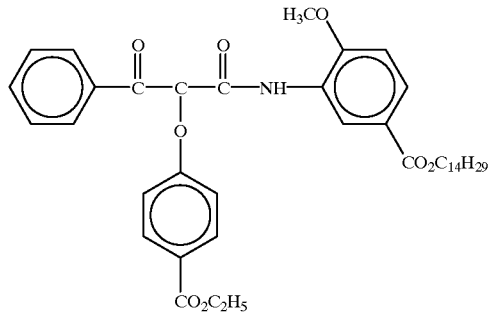

-continued

Color-developing agent-(1)

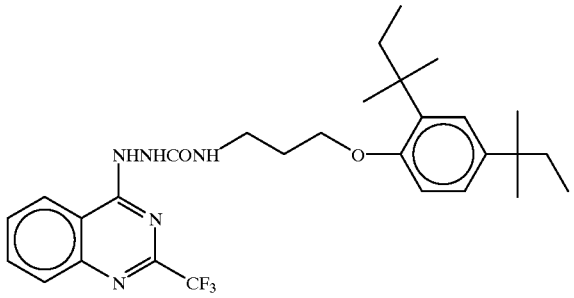

Color-developing agent-(2)

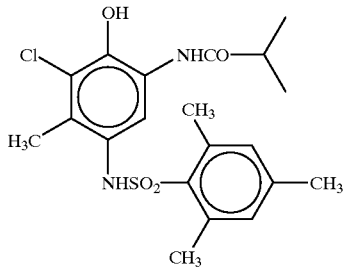

High-boiling organic solvent-(1)

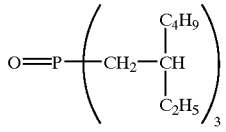

Surface-active agent (1)

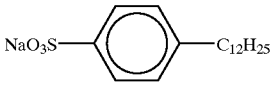

(2) Emulsified Dispersion of Developing Agent and Magenta Coupler 7.5 g and 7.5 g of magenta couplers MC-1 and MC-2 respectively, 8.2 g of developing agent (3), 1.05 g of developing agent (2), 11 g of high-boiling organic solvent (1), and 24.0 ml of ethyl acetate were dissolved at a temperature of 60° C. (II-liquid). The resulting II-liquid was mixed with 170 g of an aqueous solution (I-liquid) comprising 12 g of lime-processed gelatin and 1 g of surfactant (1), and the mixture was emulsified and dispersed at 10,000 rpm for 20 minutes using a dissolver stirrer. After dispersion, distilled water was added to bring the total weight to 300 g, and they were mixed at 2000 rpm for 10 minutes.

Magenta coupler
MC-(1)

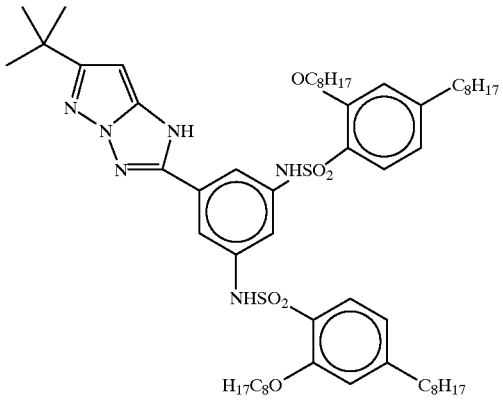

MC-(2)

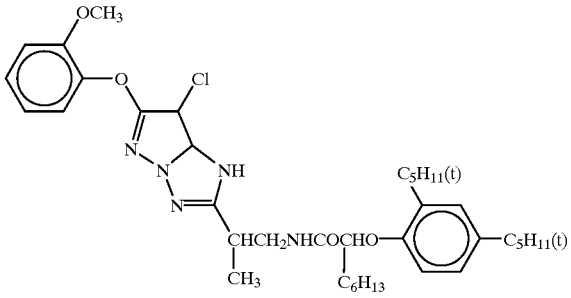

Color-developing
agent (3)

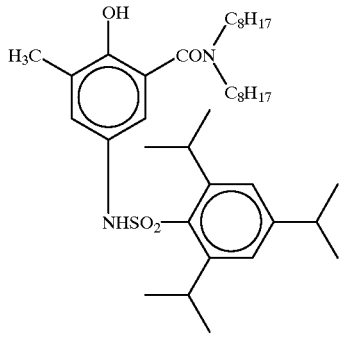

(3) Emulsified Dispersion of Developing Agent and Cyan Coupler 10.7 g of a cyan coupler CC-1, 8.2 g of developing agent (3), 1.05 g of developing agent (2), 11 g of high-boiling organic solvent (1), and 24.0 ml of ethyl acetate were dissolved at a temperature of 60° C. (II-liquid). The resulting II-liquid was mixed with 170 g of an aqueous solution (I-liquid) comprising 12 g of lime-processed gelatin and 1 g of surfactant (1), and the mixture was emulsified and dispersed at 10,000 rpm for 20 minutes using a dissolver stirrer. After dispersion, distilled water was added to bring the total weight to 300 g, and they were mixed at 2000 rpm for 10 minutes.

Cyan coupler CC-(1)

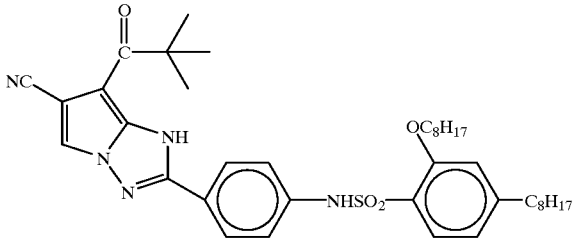

<Preparation of dye dispersion for yellow filter layer, magenta filter layer, and antihalation layer>

(1) Dye Dispersion for Yellow Filter Layer 14 g of YF-1 and 13 g of a high-boiling organic solvent (2) were weighed, and ethyl acetate was added thereto, and the mixture was heated to about 60° C. and dissolved, to make a uniform solution. To 100 cc of this solution, 1.0 g of a surface active agent (1), and 190 cc of a 6.6% aqueous solution of lime-processed gelatin heated to about 60° C., were added, and the mixture was dispersed by a homogenizer for 10 minutes at 10,000 rpm.

(2) Dye Dispersion for Magenta Filter Layer 13 g of MF-1 and 13 g of a high-boiling organic solvent (2) were weighed, and ethyl acetate was added thereto, and the mixture was heated to about 60° C. and dissolved, to make a uniform solution. To 100 cc of this solution, 1.0 g of a surface active agent (1) and 190 cc of 6.6% aqueous solution of lime-processed gelatin heated to about 60° C. were added, and the mixture was dispersed by a homogenizer for 10 minutes at 10,000 rpm.

(3) Dye Dispersion for Antihalation Layer 20 g of CF-1 and 15 g of a high-boiling organic solvent (1) were weighed, and ethyl acetate was added thereto, and the mixture was heated to about 60° C. and dissolved, to make a uniform solution. To 100 cc of this solution, 1.0 g of a surface active agent (1) and 190 cc of 6.6% aqueous solution of lime-processed gelatin heated to about 60° C. were added, and the mixture was dispersed by a homogenizer for 10 minutes at 10,000 rpm.

YF-1

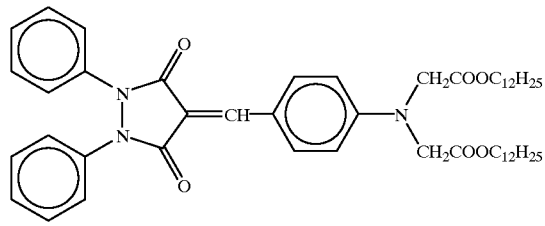

-continued

MF-1

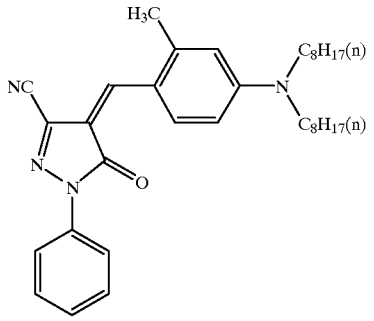

CF-1

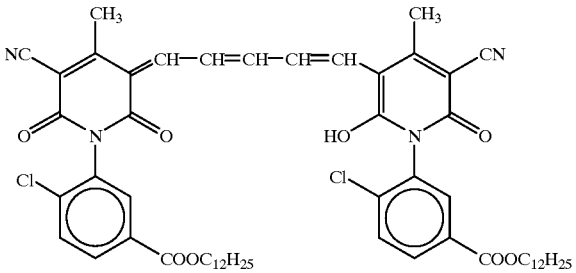

-continued

High-boiling organic solvent (2)

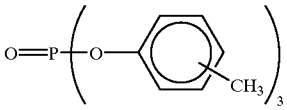

These dispersions were combined with the silver halide emulsions prepared previously to prepare coating solutions and the coating solutions were coated on a support to form layers according to the layer configurations shown in Table 9. In this way, color multilayer photographic light-sensitive materials as samples 401~408 were prepared. The emulsions A~D for color forming layers other than these layers are shown in Table 10. These emulsions were prepared according to the method for preparing tabular grains described in the text of this specification and the grain sizes and aspect ratios were adjusted. The spectral sensitization and chemical sensitization were carried out in the same ways as in the examples of the present invention.

The samples thus prepared were stored for 7 days under a condition of 25° C. and 65% relative humidity. After the storage period, the samples were subjected to cutting.

TABLE 9

Light-sensitive materials 401~408

| Layer Composition | Added material | Amount to be added (mg/m$^2$) |
|---|---|---|
| Protective layer | Lime-processed gelatin | 904 |
| Thirteenth layer | Matting agent(silica) | 38 |
| | Surfactant(2) | 30 |
| | Surfactant(3) | 25 |
| | Water-soluble polymer(1) | 20 |
| | Hardener(1) | 104 |
| Interlayer | Lime-processed gelatin | 760 |
| Twelfth layer | Surfactant | 10 |
| | Zinc hydroxide | 341 |
| | Water-soluble polymer | 30 |
| Yellow color-forming layer (high-sensitivity layer) | Lime-processed gelatin | 560 |
| | Any emulsion among Emulsion 1-Ab (Sensitizing dye was VII) to 1-Hb(Sensitizing dye was VII) | 750 (in terms of silver) |
| Eleventh layer | Antifogging agent(1) | *0.40(Emulsion 1-Ab) |
| | Yellow coupler YC-(1) | 228 |
| | Developing agent(1) | 185 |
| | Developing agent(2) | 38 |
| | Surfactant(1) | 26 |
| | High-boiling organic solvent(1) | 156 |
| | Water-soluble polymer(1) | 15 |
| Yellow color-forming layer (low-sensitivity layer) | Lime-processed gelatin | 1725 |
| | Emulsion C(Sensitizing dye was VII) | 370 |
| | Emulsion D(Sensitizing dye was VII) | 230 |
| Tenth layer | | (in terms of silver) |
| | Antifogging agent(1) | 3.92 |
| | Yellow coupler YC-(1) | 357 |
| | Developing agent(1) | 290 |
| | Developing agent(2) | 59 |
| | Surfactant(1) | 42 |
| | High-boiling organic solvent(1) | 476 |
| | Water-soluble polymer(1) | 43 |

TABLE 9-continued

Light-sensitive materials 401~408

| Layer Composition | Added material | Amount to be added (mg/m$^2$) |
|---|---|---|
| Interlayer yellow filter | Lime-processed gelatin | 1000 |
| | Yellow dye YF-1 | 140 |
| Ninth layer | High-boiling organic solvent(2) | 130 |
| | Surfactant(1) | 15 |
| | Water-soluble polymer(1) | 17 |
| Magenta color-forming layer(high-sensitivity layer) | Lime-processed gelatin | 496 |
| | Any Emulsion among Emulsion 1-Ag(Sensitizing dyes were IV,V,VI) to 1-Hg(Sensitizing dyes were IV,V,VI) | 1082 (in terms of silver) |
| Eighth layer | Antifogging agent(1) | *0.47 (Emulsion 1-Ag) |
| | Magenta coupler MC-(1) | 62 |
| | Magenta coupler MC-(2) | 8 |
| | Developing agent(3) | 68 |
| | Developing agent(2) | 8.7 |
| | Surfactant(1) | 6.5 |
| | High-boiling organic solvent(1) | 78 |
| | Water-soluble polymer 1 | 28 |
| Magenta color-forming layer(medium-sensitivity layer) | Lime-processed gelatin | 551 |
| | Emulsion A(Sensitizing dyes were IV,V,VI) | 346 (in terms of silver) |
| Seventh layer | Antifogging agent(1) | 1.54 |
| | Magenta coupler MC-(1) | 100 |
| | Magenta coupler MC-(2) | 15 |
| | Developing agent(3) | 109 |
| | Developing agent(2) | 14 |
| | Surfactant(1) | 33 |
| | High-boiling organic solvent(1) | 101 |
| | Water-soluble polymer(1) | 23 |
| Magenta color-forming layer (low-sensitivity layer) | Water-soluble polymer(1) | 665 |
| | Emulsion B(Sensitizing dyes were IV,V,VI) | 300 (in terms of silver) |
| Sixth layer | Antifogging agent(1) | 1.27 |
| | Magenta coupler MC-(1) | 274 |
| | Magenta coupler MC-(2) | 36.5 |
| | Developing agent(3) | 300 |
| | Developing agent(2) | 38.5 |
| | Surfactant(1) | 33 |
| | High-boiling organic solvent(1) | 272 |
| | Water-soluble polymer(1) | 26 |
| Interlayer Magenta filter | Lime-processed gelatin | 871 |
| | Magenta dye MF-1 | 150 |
| Fifth layer | High-boiling organic solvent(2) | 25 |
| | Zinc hydroxide | 2030 |
| | Surfactant(1) | 115 |
| | Water-soluble polymer 1 | 44 |
| Cyan color-forming layer (high-sensitivity layer) | Lime-processed gelatin | 1000 |
| | Any Emulsion among Emulsion 1-Ar (Sensitizing dyes were I,II,III) to 1-Hr (Sensitizing dyes were I,II,III) | 1490 (in terms of silver) |
| Forth layer | Antifogging agent(1) | *0.22 (Emulsion 1-Ar) |
| | Cyan coupler CC-1 | 189 |
| | Developing agent(3) | 145 |
| | Developing agent(2) | 18.5 |
| | Surfactant(1) | 15 |
| | High-boiling organic solvent(1) | 26 |
| | Water-soluble polymer(1) | 16 |
| Cyan color-forming layer (medium-sensitivity layer) | Lime-processed gelatin | 292 |
| | Emulsion A(Sensitive dyes were I,II,III) | 391 (in terms of silver) |
| Third layer | Antifogging agent(1) | 2.04 |
| | Cyan coupler CC-1 | 90 |
| | Developing agent(3) | 69 |
| | Developing agent(2) | 8.8 |
| | Surfactant(1) | 7 |
| | High-boiling organic solvent(1) | 104 |
| | Water-soluble polymer(1) | 18 |
| Cyan color-forming layer (low-sensitivity layer) | Lime-processed gelatin | 730 |
| | Emulsion B(Sensitive dyes were I,II,III) | 321 (in terms of silver) |
| Second layer | Antifogging agent(1) | 3.34 |
| | Cyan coupler CC-1 | 232 |
| | Developing agent(1) | 178 |
| | Developing agent(2) | 23 |
| | Surfactant(1) | 17 |

TABLE 9-continued

Light-sensitive materials 401~408

| Layer Composition | Added material | Amount to be added (mg/m$^2$) |
|---|---|---|
| | High-boiling organic solvent(1) | 173 |
| | Water-soluble polymer(1) | 32 |
| Interlayer | Lime-processed gelatin | 429 |
| Antihalation | Cyan dye CF-1 | 132 |
| First layer | High-boiling organic solvent(2) | 212 |
| | Surfactant(1) | 17 |
| | Water-soluble polymer(1) | 24 |
| Transparent PET base (120 $\mu$m), both sides of which were each coated with a gelatin subbing | | |
| Antistatic layer | Lime-processed gelatin (M.W. 12000) | 60 |
| | Fine grains of a composite of tin oxide-antimony oxide having an average grain diameter of 0.005 $\mu$m (secondary-aggregated particles diameter of about 0.08 $\mu$m at the specific resistance of 5 $\Omega \cdot cm^2$) | 180 |
| | Polyethylene-p-nonylphenol (polymerization degree: 10) | 5 |
| Backing coat second layer | Lime-processed gelatin (M.W. 12000) | 2000 |
| | Surfactant(3) | 11 |
| | PMMA latex (diameter; 6 $\mu$m) | 9 |
| | Hardener(2) | 455 |
| Backing coat third layer | Methyl methacrylate/styrene/2-ethlhexyl acrylate/methacrylic acid copolymer | 1000 |
| | Surfactant(3) | 1.5 |
| | Surfactant(4) | 20 |
| | Surfactant(5) | 2.5 |

*The amount of antifogging agent(1) was changed proportionally to surface area of emulsion particle.

TABLE 10

| | Average content of AgI (mol %) | Average grain diameter (sphere-equivalent) ($\mu$m) | Deviation coefficient of grain diameter (%) | ratio of diameter/thickness | Ratio of silver amounts (core/intermediate/shell) (the values in parenthesis are AgI content) | Grain structure/shape |
|---|---|---|---|---|---|---|
| Emulsion A | 5.4 | 0.65 | 20 | 5.4 | 14/65/31(0/2/13) | Triple structure tabular grains |
| Emulsion B | 3.7 | 0.49 | 15 | 3.2 | 7/32/61(5/0/5) | Triple structure tabular grains |
| Emulsion C | 7.2 | 0.50 | 22 | 4.3 | 17/37/46(1/7/10) | Triple structure tabular grains |
| Emulsion D | 3.7 | 0.43 | 16 | 4.6 | 5/54/41(0/0/9) | Triple structure tabular grains |

Surface-active agent (2)

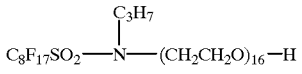

Surface-active agent (3)

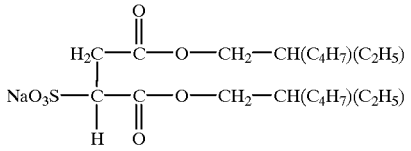

-continued

Surface-active agent (4)

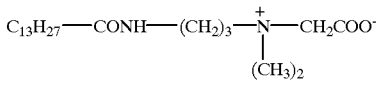

Surface-active agent (5)

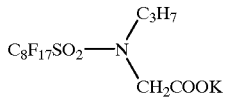

-continued

Water-soluble polymer (1)

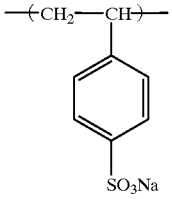

Hardener (1)

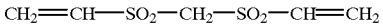

Hardener (2)

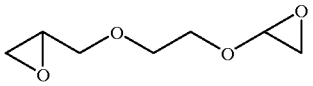

Antifoggant (1)

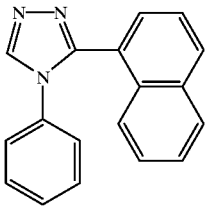

Next, processing materials P-1 and P-2 as shown in Tables 11, 12 and 13 were prepared.

TABLE 11

Processing Material P-1

| Layer constitution | Added material | Amount to be added (mg/m$^2$) |
|---|---|---|
| Fourth layer | Lime-processed gelatin | 220 |
| Protective | Water-soluble polymer(2) | 60 |
| layer | Water-soluble polymer(3) | 200 |
| | Potassium nitrate | 12 |
| | PMMA latex (diameter: 6 $\mu$m) | 10 |
| | Surfactant(3) | 7 |
| | Surfactant(4) | 7 |
| | surfactant(5) | 10 |
| Third layer | Lime-processed gelatin | 240 |
| Interlayer | Water-soluble polymer(2) | 24 |
| | Hardener(2) | 180 |
| | Stirfactant(3) | 9 |
| Second layer | Lime-processed gelatin | 2400 |
| Base-producing | Water-soluble polymer(3) | 360 |
| layer | Water-soluble polymer(4) | 700 |
| | Water-soluble polymer(5) | 1000 |
| | Guanidine pocolinate | 2910 |
| | Potassium quinolinate | 225 |
| | Sodium quinolinate | 180 |
| | Surfactant(3) | 24 |
| First layer | Lime-processed gelatin | 280 |
| Interlayer | Water-soluble polymer(2) | 12 |
| Subbig layer | Surfactant(3) | 14 |
| | Hardener(2) | 185 |
| | Transparent base A (43 $\mu$m) | |

TABLE 12

Constitution of Base A

| Name of layer | Composition | Amount to be added (mg/m$^2$) |
|---|---|---|
| Subbing layer of surface | Lime-processed gelatin | 100 |
| Polymer layer | Polyethylene terephthalate | 62500 |
| Subbing layer of back surface | Polymer (Methyl methacrylate/ styrene/2 - ethylhexyl acrylate/methacrylic acid copolymer) | 1000 |
| | PMMA latex | 120 |

TABLE 13

Processing Material P-2

| Layer constitution | Added material | Amount to be added (mg/m$^2$) |
|---|---|---|
| Fourth layer | Lime-processed gelatin | 220 |
| Protective layer | Water-soluble polymer (2) | 60 |
| | Water-soluble polymer (3) | 200 |
| | Potassium nitrate | 12 |
| | PMMA latex (diameter: 6 $\mu$m) | 10 |
| | Surfactant(3) | 7 |
| | Surfactant(4) | 7 |
| | Surfactant(5) | 10 |
| Third layer | Lime-processed gelatin | 240 |
| Interlayer | Water-soluble polymer (2) | 24 |
| | Hardener(2) | 180 |
| | Surfactant(3) | 9 |
| Second layer | Lime-processed gelatin | 2400 |
| Fixing agent layer | Silver halide solvent (1) | 5500 |
| | Water-soluble polymer (5) | 2000 |
| | Surfactant(3) | 24 |
| First layer | Lime-processed gelatin | 280 |
| Interlayer | Water-soluble polymer (2) | 12 |
| Subbing layer | Surfactant(3) | 14 |
| | Hardener(2) | 185 |
| Transparent base A (43 $\mu$m) (the same base as to P-1) | | |

Water soluble polymer (2)

K(kappa)-Carrageenan

Water soluble polymer (3)

Sumikagel L-5H (trade name: manufactured by Sumitomo Kagaku CO.)

Water soluble polymer (4)

Dextran (molecular weight 70,000)

Water soluble polymer (5)

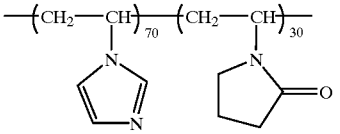

Silver halide solvent (1)

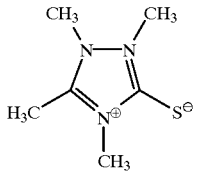

<Evaluation>

The light-sensitive materials of samples 401~408 were exposed to light of 500 lux for 1/100 second via an optical wedge. After the exposure, 15 ml/m$^2$ of warm water at 40° C. was supplied to the surface of the light-sensitive material, the light-sensitive material and the processing material P-1 were put together face to face of their film surfaces, and heat development was carried out at 83° C. for 17 seconds by use of a heat drum. A gray-colored wedge-shaped image was obtained when the light-sensitive material was peeled off from the processing material P-1 after the processing. A yellow-colored wedge-shaped image was obtained in the case where the sample was exposed using a blue filter. A magenta-colored wedge-shaped image was obtained in the case where the sample was exposed using a green filter. A cyan-colored wedge-shaped image was obtained in the case where the sample was exposed using a red filter.

The gray-colored samples were subjected to a second-step processing (fixing) by use of a second processing material P-2. The second-step processing was carried out by coating 10 cc/m$^2$ of water on the surface of the light-sensitive material after being processed as described above, putting the light-sensitive material and the processing material P-2 together face to face, and thereafter heating the materials to 60° C. to keep them at that temperature for 30 seconds.

The colored samples thus obtained were subjected to the transmission density measurement using a blue filter, a green filter, and a red filter to obtain so-called characteristic curves. The relative sensitivity was given by the logarithmic value of the reciprocal of an exposing light amount corresponding to a density higher than fog density by 0.15 based on the characteristic curve of each color. The average of the relative sensitivities obtained from the three colors was taken as the sensitivity of each sample. The sensitivity was expressed as a relative value by regarding the value of the sample 401 as 100.

As for the measurement of change of gradation (gamma) upon exposure to high-intensity illumination, the following procedure was conducted. That is, 1/100 second exposure and 1/10000 second exposure (by the same exposing light amount) were carried out in the same way as above and characteristic curves were obtained for each of three colors. On each curve, the inclination of a straight line, connecting a point corresponding to a density higher than fog density by 0.1 and a point corresponding to a density higher than fog density by 0.8, was obtained and used as a relative gamma value. The average of these relative gamma values of the three colors was obtained. In addition, a gamma value for 1/10000 second exposure was expressed by a relative value based on a gamma value for 1/100 second exposure for each sample so that the change of gradation upon exposure to high-intensity illumination was obtained (i.e., the gamma value for 1/10000 second exposure was expressed as a relative value by regarding the gamma value at 1/100 second exposure as 100 for each sample).

Further, in order to compare the results with those of a conventional liquid development process, the samples after being exposed in the same way as above were processed by using CN-16 (trade name, a color negative processing solution system, manufactured by Fuji Photo Film Co., Ltd.) in a developing condition of 38° C. and 185 seconds. Then, sensitivities, and changes of gradation upon exposure to high-intensity illumination, were obtained in the same way as above. The results are shown in Table 14.

TABLE 14

| Sample No. | Emulsions for red-, green- and blue-sensitive high-sensitivity layers | Average circle-equivalent diameter to total tabular grains (μm) | Average aspect ratio of total tabular grains | Dopant |
|---|---|---|---|---|
| 401 | 1-Ar.g.b | 1.90 | 6.0 | — |
| 402 | 1-Br.g.b | 1.90 | 6.0 | $[Ru(trz)_6]^{4-}$ |
| 403 | 1-Cr.g.b | 2.10 | 8.0 | — |
| 404 | 1-Dr.g.b | 2.10 | 8.0 | $[Ru(trz)_6]^{4-}$ |
| 405 | 1-Er.g.b | 2.52 | 14.0 | — |
| 406 | 1-Fr.g.b | 2.52 | 14.0 | $[Ru(trz)_6]^{4-}$ |
| 407 | 1-Gr.g.b | 3.02 | 24.0 | — |
| 408 | 1-Hr.g.b | 3.02 | 24.0 | $[Ru(trz)_6]^{4-}$ |

| | Heat-development | | CN-16 | | |
|---|---|---|---|---|---|
| Sample No. | Sensitivity (1/100") | Gradation (1/100") | Sensitivity (1/100") | Gradation (1/100") | Remarks |
| 401 | 100 | 98 | 100 | 98 | Comparative example |
| 402 | 105 | 100 | 105 | 99 | Comparative example |
| 403 | 120 | 94 | 112 | 95 | Comparative example |
| 404 | 138 | 100 | 123 | 99 | This invention |
| 405 | 138 | 86 | 129 | 92 | Comparative example |
| 406 | 166 | 98 | 141 | 98 | This invention |
| 407 | 162 | 76 | 141 | 88 | Comparative example |
| 408 | 200 | 96 | 158 | 97 | This invention |

As is apparent from these results, tone softening in particular upon exposure to high-intensity illumination was significant at heat development, when tabular grains having a large average equivalent-circle diameter were used without being doped with a metal complex having, as a ligand, a heterocyclic compound in a number more than half of the coordination number of the metal atom. However, it can be understood that these properties at heat development could be remarkably improved according to the present invention, by using the photographic emulsion containing a metal complex having, as a ligand, a heterocyclic compound in a number more than half of the coordination number of the metal atom. This improvement effect is an effect that is found specifically in a system in which the light-sensitive material incorporating a developing agent is heat-developed, and it is a novel effect that cannot be expected from technologies hitherto known. Accordingly, the present invention provides a silver halide color photographic light-sensitive material capable of producing proper gradation with high sensitivity even if a process, which is simple and rapid and places little load on the environment, is carried out.

Example 5

Samples were prepared in the same way as in Example 4 but with the exception described below in the emulsion preparation, and the samples thus prepared were subjected to the same test as in Example 1. The same good results were obtained and the effects of the present invention were confirmed.

In the emulsions 1-B, 1-D, 1-F, and 1-H, in place of the 1.9 M KBr aqueous solution containing $[Ru(trz)_6]^{4-}$ (trz=1,2,4-triazole) in an amount of $1\times10^{-5}$ mol/mol of silver relative to the total amount of silver of the grains, any one of 1.9 M KBr aqueous solutions, which contained $[Fe(Im)_6]^{2+}$ (Im=imidazole), $[Zn(pz)_6]^{2+}$ (pz=pyrazole), $[Fe(bpy)_3]^{2+}$ (bpy=2,2'-bipyridine), or $[Ru(phen)_3]^{2+}$ (phen=1,10-phenanthroline), respectively, in an amount of $1\times10^{-5}$ mol/mol of silver relative to the total amount of silver of the grains, was used and added simultaneously with 269 cc of the 1.9 M $AgNO_3$ aqueous solution.

Besides, for the purpose of comparison, even if an equimolar amount of a compound (i.e., the following compound (a)), in which the number of the heterocyclic compound linked by a coordinate bond to the Fe atom was reduced from 3 to 2 in the above-mentioned $[Fe(bpy)_3]^{2+}$, was used in place of $[Ru(trz)_6]^{4-}$ in Example 4, the same good results were obtained and the effects of the present invention were confirmed.

On the other hand, if an equimolar amount of a compound for comparison (i.e., the following compound (b)), in which the number of the heterocyclic compound linked by a coordinate bond to the Fe atom was reduced from 3 to 1 in the above-mentioned $[Fe(bpy)_3]^{2+}$, was used in place of $[Ru(trz)_6]^{4-}$ in Example 4, the sensitivity was not upgraded but degraded to the contrary and the effects of the present invention were not realized.

(a)

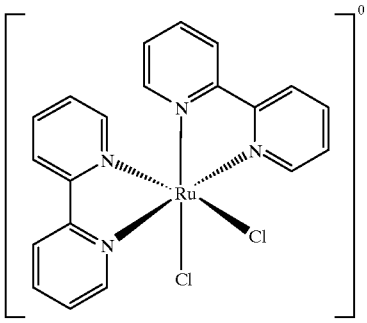

(b)

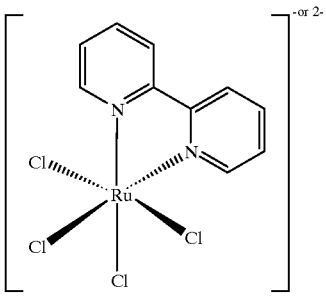

Example 6

A sample was prepared in the same way as in Example 4, except that the support was replaced by a support prepared according to the process indicated below. Then, the sample was subjected to the same test as in Example 4 and excellent results as in Example 4 were obtained. Accordingly, the effects of the present invention were confirmed.

1) Support

The support that was used in this example was prepared as follows:

100 weight parts of polyethylene-2,6-naphthalate polymer, and 2 weight parts of Tinuvin P. 326 (trade name, manufactured by Ciba-Geigy Co.), as an ultraviolet absorbing agent, were dried, then melted at 300° C.; subsequently they were extruded through a T-type die, and. stretched 3.3 times in the lengthwise direction at 140° C., and then 3.3 times in the width direction at 130° C.; and further they were thermally fixed for 6 seconds at 250° C., thereby a PEN film having a thickness of 90 μm was obtained. To the PEN film, appropriate amounts of a blue dye, a magenta dye, and a yellow dye (I-1, I-4, I-6, I-24, I-26, I-27, and II-5, as described in Kokai Giho: Kogi No. 94-6023) were added. Further, this film was wound around a stainless steel core (spool) having a diameter of 20 cm, and thermal history was imparted thereto at 110° C. for 48 hours, to obtain a support having suppressed core-set-curl.

2) Coating of an Undercoat Layer

After both surfaces of the above support were subjected to corona discharge, UV discharge, and glow discharge treatments, each side of the support was coated with an undercoat solution having a composition of 0.1 g/m$^2$ of gelatin, 0.01 g/m$^2$ of sodium a-sulfo-di-2-ethylhexylsuccinate, 0.04 g/m$^2$ of salicylic acid, 0.2 g/m$^2$ of p-chlorophenol, 0.012 g/m$^2$ of $(CH_2=CHSO_2CH_2CH_2NHCO)_2CH_2$, and 0.02 g/m$^2$ of polyamide-epichlorohydrin polycondensation product (the weight of each component in the undercoat layer was in terms per unit area, 10 cc/m$^2$, a bar coater was used). The undercoat layer was provided on the side that was heated at a higher temperature at the time of stretching. Drying was carried out at 115° C. for 6 minutes (the roller and the transportation apparatus in the drying zone all were set at 115° C.).

3) Coating of a Backing Layer

An antistatic layer, a transparent magnetic recording layer, and a slipping (sliding) layer, each having the compositions mentioned below, were coated on one side of the above support coated with the undercoat layer, as a backing layer.

3-1) Coating of an antistatic layer 0.2 g/m$^2$ of a dispersion of fine grain powder of a composite of stannic oxide-antimony oxide having an average grain diameter of 0.005 μm and the specific resistance of 5 Ω·cm (secondary aggregation grain diameter of about 0.08 μm), 0.05 g/m$^2$ of gelatin, 0.02 g/m$^2$ of $(CH_2=CHSO_2CH_2CH_2NHCO)_2CH_2$, and 0.005 g/m$^2$ of poly(polymerization degree: 10)oxyethylene-p-nonylphenol were coated, in which the weight of each component in the antistatic layer was in terms per unit area.

3-2) Coating of a magnetic recording layer 3-Poly(polymerization degree: 15)oxyethylene-propyloxytrimethoxysilan (15 weight%)—coated Co-γ-iron oxide (specific surface area, 43 m$^2$/g; major axis, 0.14 μm; minor axis, 0.03 μm; saturation magnetization, 89 emu/g, $Fe^{2+}/Fe^{3+}$=6/94; the surface was treated with 2 weight % respectively, based on iron oxide, of aluminum oxide and silicon oxide) (0.06 g/m$^2$), diacetylcellulose (dispersion of the iron oxide was carried out by an open kneader and a sand mill) (1.2 g/m$^2$), and $C_2H_5C(CH_2CONH\text{-}C_6H_3(CH_3)NCO)_3$ (0.3 g/m$^2$), as a hardener, were coated using acetone, methylethylketone, cyclohexanone, and dibutylphthalate, as solvents, by means of a bar coater, to obtain a magnetic recording layer having a thickness of 1.2 μm. The weight of each component in the magnetic recording layer was in terms per unit area. 50 mg/m$^2$ of $C_6H_{13}CH(OH)C_{10}H_{20}COOC_{40}H_{81}$, as a slipping agent, 50 mg/m$^2$ of silica grains (1.0 μm), as a matting agent, and 10 mg/m$^2$ of 3-poly(polymerization degree: 15)oxyethylene-propyloxytrimethoxysilan (15 weight %)-coated aluminum oxides (0.20 μm and 1.0 μm), as an abrasive, were each added thereto. Drying was conducted at 115° C. for 6 min (the roller and the transportation apparatus in the drying zone all were set at 115° C.). The increment of the color density of DB of the magnetic recording layer was about 0.1 when X-light (blue filter) was used. The saturation magnetization moment of the magnetic recording layer was 4.2 emu/g, the coercive force was $7.3\times10^4$ A/m, and the squareness ratio was 65%.

(3-3) Formation of a sliding layer

The sliding layer was prepared by coating each of the following components in the following weight per unit area of the layer: hydroxyethyl cellulose (25 mg/m$^2$), $C_6H_3CH(OH)C_{10}H_{20}COOC_{40}H_{81}$(6 mg/m$^2$), and a silicone oil (BYK-310, trade name, manufactured by BYK Chemie Japan Co., Ltd.)(1.5 mg/m$^2$). It should be noted that the coating liquid was prepared by melting the components in xylene/propyleneglycolmonomethyl ether (1/1) at 105° C., adding the molten product to and dispersing in propyleneglycolmonomethyl ether (tenfold amount) at room temperature, and further dispersing the dispersion in acetone to prepare a dispersion (average particle size: 0.10 μm). Drying was performed at 115° C. for 6 minutes (all of the rollers and conveyors in the drying zone were maintained at 115° C.). The resultant sliding layer was found to have excellent characteristics. That is, the coefficient of kinetic friction was 0.10 (stainless steel hard ball having a diameter of 5 mm; load: 100g; speed: 6 cm/minute) and the coefficient of static friction was 0.08 (clip method). The coefficient of kinetic friction between an emulsion surface and the sliding layer was 0.15.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide photographic emulsion comprising silver halide grains, wherein 50% or more of the projected area of the silver halide grains contained is occupied by tabular grains having an aspect ratio of 2 or more and a grain thickness of 0.2 μm or less that have a phase containing 10% or more of silver bromide, and wherein in the phase, the tabular grains each contain a metal complex dopant in an amount necessary to increase the density of dislocations;

wherein the metal complex dopant contained has, as a ligand, a heterocyclic compound in a number (the number of coordinated atoms when the heterocyclic compound is a chelate compound) exceeding one-half of the coordination number of the metal atom.

2. The silver halide photographic emulsion as claimed in claim 1, wherein 50% or more of the projected area is occupied by tabular grains having a grain thickness of 0.15 μm or less.

3. The silver halide photographic emulsion as claimed in claim 1, wherein the content of silver bromide is 10% or more and the phase containing the metal complex dopant further contains 1 mol % or more of silver iodide.

4. The silver halide photographic emulsion as claimed in claim 1, wherein the metal complex dopant to be contained is a complex containing magnesium, calcium, strontium, barium, titanium, chromium, manganese, iron, cobalt, nickel, ruthenium, rhodium, palladium, osmium, iridium, platinum, gold, copper, zinc, cadmium or mercury, as a central metal.

5. A silver halide photographic light-sensitive material, which contains a silver halide photographic emulsion comprising silver halide grains, wherein 50% or more of the projected area of the silver halide grains contained is occupied by tabular grains having an aspect ratio of 2 or more and a grain thickness of 0.2 μm or less that have a phase containing 10% or more of silver bromide, and wherein in the phase, the tabular grains each contain a metal complex dopant in an amount necessary to increase the density of dislocations;

wherein in the emulsion, the metal complex dopant contained has, as a ligand, a heterocyclic compound in a number (the number of coordinated atoms when the heterocyclic compound is a chelate compound) exceeding one-half of the coordination number of the metal atom.

6. The silver halide photographic light-sensitive material as claimed in claim 5, wherein in the emulsion, 50% or more of the projected area is occupied by tabular grains having a grain thickness of 0.15 μm or less.

7. The silver halide photographic light-sensitive material as claimed in claim 5, wherein in the emulsion, the content of silver bromide is 10% or more and the phase containing the metal complex dopant further contains 1 mol % or more of silver iodide.

8. The silver halide photographic light-sensitive material as claimed in claim 5, wherein in the emulsion, the metal complex dopant contained is a complex containing magnesium, calcium, strontium, barium, titanium, chromium, manganese, iron, cobalt, nickel, ruthenium, rhodium, palladium, osmium, iridium, platinum, gold, copper, zinc, cadmium or mercury, as a central metal.

9. The silver halide color photographic light-sensitive material as claimed in claim 5, wherein a developing agent is contained.

10. The silver halide color photographic light-sensitive material as claimed in claim 9, wherein a compound represented by the following formula (I), (II), (III) or (IV) is contained, as the developing agent:

formula (I)

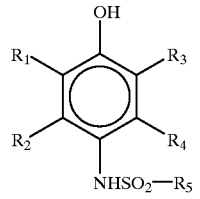

formula (II)

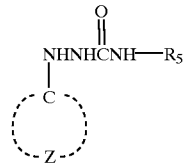

formula (III)

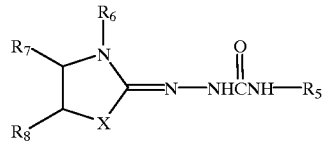

formula (IV)

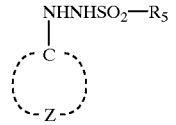

wherein $R_1$, $R_2$, $R_3$, and $R_4$ each represent a hydrogen atom, a halogen atom, an alkyl group, an aryl group, an alkylcarbonamide group, an arylcarbonamide group, an alkylsulfonamide group, an arylsulfonamide group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, or an acyloxy group; $R_5$ represents an alkyl group, an aryl group, or a heterocyclic group; Z represents a group of atoms to form an aromatic ring (including a heteroaromatic ring), if Z is a group of atoms necessary to form a benzene ring, the sum of Hammett's constant (σ) of its substituents is 1 or more; $R_6$ represents an alkyl group; X represents an oxygen atom, a sulfur atom, a selenium atom, or an alkyl- or aryl-substituted tertiary nitrogen atom; $R_7$ and $R_8$ each represent a hydrogen atom or a substituent, and $R_7$ and $R_8$ may bond together to form a double bond or a ring; further, at least one ballasting group having 8 or more carbon atoms is contained in each of formulae (I) to (IV), in order to make the molecule soluble in an oil.

11. A silver halide color photographic light-sensitive material containing a silver halide emulsion and a developing agent on a support, wherein at least one kind of the silver halide emulsion is a silver halide emulsion comprising silver halide grains, in which 50% or more of the projected area of the silver halide grains contained is occupied by tabular grains having an aspect ratio of 2 or more and grain thickness of 0.2 μm or less that have a phase containing 10% or more of silver bromide, and wherein the grains contain a metal complex dopant having, as a ligand, an organic compound that does not have any electronic charge and that does not form any coordination bond with a metal other than the central metal, or with a metal ion thereof, in which the number of the organic compound exceeds one-half of the coordination number of the metal atom (when the ligand is a multidentate ligand, the number of coordinating atoms in the ligand exceeds one-half of the coordination number of the central metal, and the ligand is an organic compound that does not have any charge and that does not form any coordination bond with a metal other than the central metal or with a metal ion thereof).

12. The silver halide color photographic light-sensitive material as claimed in claim 11, wherein the metal complex dopant contained is a complex containing magnesium, calcium, strontium, barium, titanium, chromium, manganese, iron, cobalt, nickel, ruthenium, rhodium, palladium, osmium, iridium, platinum, gold, copper, zinc, cadmium or mercury, as a central metal.

13. The silver halide color photographic light-sensitive material as claimed in claim 11, wherein a compound represented by the following formula (I), (II), (III) or (IV) is contained, as a developing agent:

formula (I)

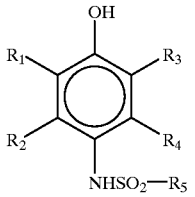

formula (II)

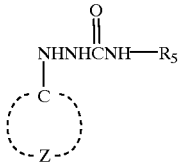

-continued formula (III)

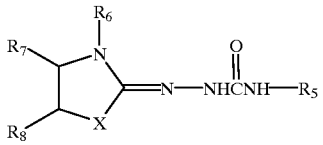

formula (IV)

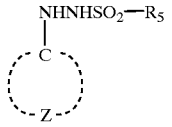

wherein $R_1$, $R_2$, $R_3$, and $R_4$ each represent a hydrogen atom, a halogen atom, an alkyl group, an aryl group, an alkylcarbonamide group, an arylcarbonamide group, an alkylsulfonamide group, an arylsulfonamide group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, or an acyloxy group; $R_5$ represents an alkyl group, an aryl group, or a heterocyclic group; Z represents a group of atoms to form an aromatic ring (including a heteroaromatic ring), if Z is a group of atoms necessary to form a benzene ring, the sum of Hammett's constant (σ) of its substituents is 1 or more; $R_6$ represents an alkyl group; X represents an oxygen atom, a sulfur atom, a selenium atom, or an alkyl- or aryl-substituted tertiary nitrogen atom; $R_7$ and $R_8$ each represent a hydrogen atom or a substituent, and $R_7$ and $R_8$ may bond together to form a double bond or a ring; further, at least one ballasting group having 8 or more carbon atoms is contained in each of formulae (I) to (IV), in order to make the molecule soluble in an oil.

14. A silver halide color photographic light-sensitive material containing a silver halide emulsion and a developing agent on a support, wherein at least one kind of the silver halide emulsion is a silver halide emulsion comprising silver halide grains, in which 50% or more of the projected area of the silver halide grains contained is occupied by tabular grains having an aspect ratio of 2 or more and grain thickness of 0.2 μm or less that have a phase containing 10% or more of silver bromide, and wherein a metal complex dopant represented by any one of the following formula A, B or C is contained in the grains:

$[ML_nX_{(c-n)}]^z$ formula A $[ML'_mX_{(c-2m)}]^z$ formula B $[ML''_2]^z$ formula C wherein M represents an arbitrary central metal or central metal ion, L, L' and L" represent a compound having a chain or cyclic hydrocarbon as the mother structure, or a compound in which a part of the carbon or hydrogen atoms of the mother structure is substituted by another atom or atomic group, and at least one compound of each of L, L' and L" is a compound capable of being coordinated to two or more metal ions at the same time, with the proviso that L is a monodentate compound coordinated to a central metal or a central metal ion, L' is a bidentate compound coordinated to a central metal or a central metal ion, and L" is a tridentate compound coordinated to a central metal or a central metal ion, in each formula, in the case L, L' and L" are present in a plurality, they can be the same compound, or different compounds, X represents an arbitrary ligand, C is 4 or 6 with the proviso that when C is 6, n is 4, 5 or 6, and m is 2 or 3, and when C is 4, n is 3 or 4, and m is 2, and z represents an integer (charge number) from −6 to +4.

15. The silver halide color photographic light-sensitive material as claimed in claim 14, wherein the metal complex dopant contained is a complex containing magnesium, calcium, strontium, barium, titanium, chromium, manganese, iron, cobalt, nickel, ruthenium, rhodium, palladium, osmium, iridium, platinum, gold, copper, zinc, cadmium or mercury, as a central metal.

16. The silver halide color photographic light-sensitive material as claimed claim 14, wherein a compound represented by the following formula (I), (II), (III) or (IV) is contained, as a developing agent:

formula (I)

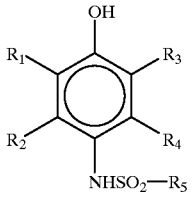

formula (II)

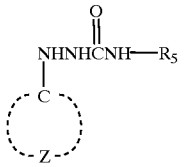

formula (III)

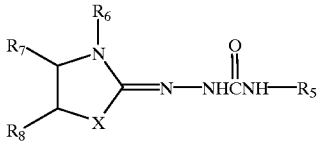

formula (IV)

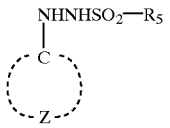

wherein $R_1$, $R_2$, $R_3$, and $R_4$ each represent a hydrogen atom, a halogen atom, an alkyl group, an aryl group, an alkylcarbonamide group, an arylcarbonamide group, an alkylsulfonamide group, an arylsulfonamide group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, or an acyloxy group; $R_5$ represents an alkyl group, an aryl group, or a heterocyclic group; Z represents a group of atoms to form an aromatic ring (including a heteroaromatic ring), if Z is a group of atoms necessary to form a benzene ring, the sum of Hammett's constant ($\sigma$) of its substituents is 1 or more; $R_6$ represents an alkyl group; X represents an oxygen atom, a sulfur atom, a selenium atom, or an alkyl- or aryl-substituted tertiary nitrogen atom; $R_7$ and $R_8$ each represent a hydrogen atom or a substituent, and $R_7$ and $R_8$ may bond together to form a double bond or a ring; further, at least one ballasting group having 8 or more carbon atoms is contained in each of formulae (I) to (IV), in order to make the molecule soluble in an oil.

17. A silver halide color photographic light-sensitive material containing a silver halide emulsion and a developing agent on a support, wherein at least one kind of the silver halide emulsion is a silver halide emulsion comprising silver halide grains, in which 50% or more of the projected area of the silver halide grains contained is occupied by tabular grains having an aspect ratio of 2 or more and grain thickness of 0.2 $\mu$or less that have a phase containing 10% or more of silver bromide, and wherein the grains contain a metal complex dopant having, as a ligand, an organic compound that has a moiety capable of having a negative charge, in which the number of the organic compound exceeds one-half of the coordination number of the metal atom.

18. The silver halide color photographic light-sensitive material as claimed in claim 17, wherein the metal complex dopant contained is a complex containing magnesium, calcium, strontium, barium, titanium, chromium, manganese, iron, cobalt, nickel, ruthenium, rhodium, palladium, osmium, iridium, platinum, gold, copper, zinc, cadmium or mercury, as a central metal.

19. The silver halide color photographic light-sensitive material as claimed in claim 17, wherein a compound represented by the following formula (I), (II), (III) or (IV) is contained, as a developing agent:

formula (I)

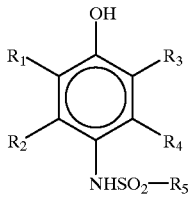

formula (II)

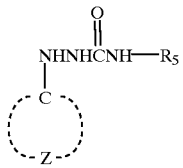

formula (III)

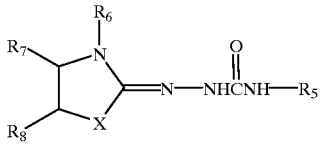

formula (IV)

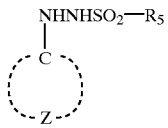

wherein $R_1$, $R_2$, $R_3$, and $R_4$ each represent a hydrogen atom, a halogen atom, an alkyl group, an aryl group, an alkylcarbonamide group, an arylcarbonamide group, an alkylsulfonamide group, an arylsulfonamide group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, or an acyloxy group; $R_5$ represents an alkyl group, an aryl group, or a heterocyclic group; Z represents a group of atoms to form an aromatic ring (including a heteroaromatic ring), if z is a group of atoms necessary to form a benzene ring, the sum of Hammett's constant (σ) of its substituents is 1 or more; $R_6$ represents an alkyl group; X represents an oxygen atom, a sulfur atom, a selenium atom, or an alkyl- or aryl-substituted tertiary nitrogen atom; $R_7$ and $R_8$ each represent a hydrogen atom or a substituent, and $R_7$ and $R_8$ may bond together to form a double bond or a ring; further, at least one ballasting group having 8 or more carbon atoms is contained in each of formulae (I) to (IV), in order to make the molecule soluble in an oil.

20. A method for forming a color image, comprising: subjecting a light-sensitive material to exposure image-wise, that is attached to a processing material face to face each other in the state that water equivalent to one-tenth to one-fold as much as that required for maximally swelling all the coated films of the light-sensitive material and the processing material is maintained between the light-sensitive material and the processing material, and heating the processing material and the light-sensitive material at a temperature of 60° C. or higher but 100° C. or lower for a time period of 5 seconds or more but 60 seconds or less, thereby forming an image in the light-sensitive material, wherein the processing material has a composition layer including a processing layer containing a base and/or a base precursor, applied on a support;

wherein the light-sensitive material contains a silver halide photographic emulsion comprising silver halide grains, wherein 50% or more of the projected area of the silver halide grains contained is occupied by tabular grains having an aspect ratio of 2 or more and a grain thickness of 0.2 μm or less that have a phase containing 10% or more of silver bromide, and wherein in the phase, the tabular grains each contain a metal complex dopant in an amount necessary to increase the density of dislocations;

wherein in the emulsion, the metal complex dopant contained has, as a ligand, a heterocyclic compound in a number (the number of coordinated atoms when the heterocyclic compound is a chelate compound) exceeding one-half of the coordination number of the metal atom.

21. A method for forming a color image, comprising: subjecting a light-sensitive material to exposure image-wise, that is attached to a processing material face to face each other in the state that water equivalent to one-tenth to one-fold as much as that required for maximally swelling all the coated films of the light-sensitive material and the processing material is maintained between the light-sensitive material and the processing material, and heating the processing material and the light-sensitive material at a temperature of 60° C. or higher but 100° C. or lower for a time period of 5 seconds or more but 60 seconds or less, thereby forming an image in the light-sensitive material, wherein the processing material has a composition layer including a processing layer containing a base and/or a base precursor, applied on a support;

wherein the light-sensitive material contains a silver halide emulsion and a developing agent on a support, wherein at least one kind of the silver halide emulsion is a silver halide emulsion comprising silver halide grains, in which 50% or more of the projected area of the silver halide grains contained is occupied by tabular grains having an aspect ratio of 2 or more and grain thickness of 0.2 μm or less that have a phase containing 10% or more of silver bromide, and wherein the grains contain a metal complex dopant having, as a ligand, an organic compound that does not have any electronic charge and that does not form any coordination bond with a metal other than the central metal, or with a metal ion thereof, in which the number of the organic compound exceeds one-half of the coordination number of the metal atom (when the ligand is a multidentate ligand, the number of coordinating atoms in the ligand exceeds one-half of the coordination number of the central metal, and the ligand is an organic compound that does not have any charge and that does not form any coordination bond with a metal other than the central metal or with a metal ion thereof).

22. A method for forming a color image, comprising: subjecting a light-sensitive material to exposure image-wise, that is attached to a processing material face to face each other in the state that water equivalent to one-tenth to one-fold as much as that required for maximally swelling all the coated films of the light-sensitive material and the processing material is maintained between the light-sensitive material and the processing material, and heating the processing material and the light-sensitive material at a temperature of 60° C. or higher but 100° C. or lower for a time period of 5 seconds or more but 60 seconds or less, thereby forming an image in the light-sensitive material, wherein the processing material has a composition layer including a processing layer containing a base and/or a base precursor, applied on a support;

wherein the light-sensitive material contains a silver halide emulsion and a developing agent on a support, wherein at least one kind of the silver halide emulsion is a silver halide emulsion comprising silver halide grains, in which 50% or more of the projected area of the silver halide grains contained is occupied by tabular grains having an aspect ratio of 2 or more and grain thickness of 0.2 μm or less that have a phase containing 10% or more of silver bromide, and wherein a metal complex dopant represented by any one of the following formula A, B or C is contained in the grains:

$$[ML_nX_{(c-n)}]^z \quad \text{formula A}$$

$$[ML'_mX_{(c-2m)}]^z \quad \text{formula B}$$

$$[ML''_2]^z \quad \text{formula C}$$

wherein M represents an arbitrary central metal or central metal ion, L, L' and L" represent a compound having a chain or cyclic hydrocarbon as the mother structure, or a compound in which a part of the carbon or hydrogen atoms of the mother structure is substituted by another atom or atomic group, and at least one compound of each of L, L' and L" is a compound capable of being coordinated to two or more metal ions at the same time, with the proviso that L is a monodentate compound coordinated to a central metal or a central metal ion, L' is a bidentate compound coordinated to a central metal or a central metal ion, and L" is a tridentate compound coordinated to a central metal or a central metal ion, in each formula, in the case L, L' and L" are present in a plurality, they can be the same compound, or different compounds, X represents an arbitrary ligand, C is 4 or 6 with the proviso that when C is 6, n is 4, 5 or 6, and m is 2 or 3, and when C is 4, n is 3 or 4, and m is 2, and z represents an integer (charge number) from −6 to +4.

23. A method for forming a color image, comprising: subjecting a light-sensitive material to exposure image-wise, that is attached to a processing material face to face each other in the state that water equivalent to one-tenth to one-fold as much as that required for maximally swelling all the coated films of the light-sensitive material and the processing material is maintained between the light-sensitive material and the processing material, and heating the processing material and the light-sensitive material at a temperature of 60° C. or higher but 100 ° C. or lower for a time period of 5 seconds or more but 60 seconds or less, thereby forming an image in the light-sensitive material, wherein the processing material has a composition layer including a processing layer containing a base and/or a base precursor, applied on a support;

wherein the light-sensitive material contains a silver halide emulsion and a developing agent on a support, wherein at least one kind of the silver halide emulsion is a silver halide emulsion comprising silver halide grains, in which 50% or more of the projected area of the silver halide grains contained is occupied by tabular grains having an aspect ratio of 2 or more and grain thickness of 0.2 $\mu$m or less that have a phase containing 10% or more of silver bromide, and wherein the grains contain a metal complex dopant having, as a ligand, an organic compound that has a moiety capable of having a negative charge, in which the number of the organic compound exceeds one-half of the coordination number of the metal atom.

* * * * *